US011678711B2

(12) United States Patent
Shiffer

(10) Patent No.: US 11,678,711 B2
(45) Date of Patent: Jun. 20, 2023

(54) MACHINE-VENDIBLE FOLDABLE BICYCLE HELMET METHODS AND SYSTEMS

(71) Applicant: Membrain Safety Solutions, LLC, Los Angeles, CA (US)

(72) Inventor: Isis Shiffer, Brooklyn, NY (US)

(73) Assignee: Membrain Safety Solutions, LLC, Los Angeles, CA (US)

( * ) Notice: Subject to any disclaimer, the term of this patent is extended or adjusted under 35 U.S.C. 154(b) by 151 days.

(21) Appl. No.: 17/215,396

(22) Filed: Mar. 29, 2021

(65) Prior Publication Data

US 2021/0212407 A1 Jul. 15, 2021

Related U.S. Application Data

(63) Continuation of application No. 16/189,423, filed on Nov. 13, 2018, now Pat. No. 10,959,480, which is a continuation of application No. PCT/US2017/051277, filed on Sep. 13, 2017.

(60) Provisional application No. 62/458,767, filed on Feb. 14, 2017, provisional application No. 62/415,057, filed on Oct. 31, 2016, provisional application No. 62/393,911, filed on Sep. 13, 2016.

(51) Int. Cl.

| | |
|---|---|
| ***A42B 3/32*** | (2006.01) |
| ***A42B 3/12*** | (2006.01) |
| ***A42B 3/06*** | (2006.01) |

(52) U.S. Cl.

CPC ..... *A42B 3/322* (2013.01); *A42B 3/065* (2013.01); *A42B 3/066* (2013.01); *A42B 3/124* (2013.01)

(58) Field of Classification Search

CPC ..... A42B 3/322; A42B 3/066; A42B 3/124; A42B 3/065

See application file for complete search history.

(56) References Cited

U.S. PATENT DOCUMENTS

| | | | | |
|---|---|---|---|---|
| 1,996,254 A | | 4/1935 | Ernest | |
| 2,659,481 A | * | 11/1953 | Jones | A42B 1/18 206/8 |
| 3,026,525 A | * | 3/1962 | Gyorfy | A42B 3/322 2/202 |
| 3,169,251 A | | 2/1965 | Humes | |

(Continued)

FOREIGN PATENT DOCUMENTS

| | | |
|---|---|---|
| CN | 203416852 U | 2/2014 |
| CN | 104432928 A | 3/2015 |

(Continued)

OTHER PUBLICATIONS

Japanese Office Action for JP Application No. 2019-535205 dated Jun. 7, 2021.

(Continued)

*Primary Examiner* — Khaled Annis

(74) *Attorney, Agent, or Firm* — RMCK Law Group PLC

(57) ABSTRACT

A bicycle helmet that fits over a surface of a head of a user generally includes at least one segment of flexible cell structures that form a radial honeycomb matrix movable between a folded condition where each side of the at least one segment is disposed generally parallel and an expanded condition where the radial honeycomb matrix of the at least one segment is configured to be expanded at least partially over the head of the user and arranged radially relative to the surface of the head of the user.

15 Claims, 47 Drawing Sheets

(56) References Cited

U.S. PATENT DOCUMENTS

| | | | | | |
|---|---|---|---|---|---|
| 3,514,787 | A * | 6/1970 | Kennedy, Jr. | A42B 3/322 | D29/104 |
| 3,811,130 | A * | 5/1974 | Townsend, Jr. | A42C 5/04 | 428/116 |
| 3,991,422 | A * | 11/1976 | Saotome | A42B 3/322 | 2/410 |
| RE29,452 | E * | 10/1977 | Townsend, Jr. | A42C 5/04 | 2/200.1 |
| 4,607,397 | A * | 8/1986 | Laxo | A42B 3/322 | 2/410 |
| D297,173 | S * | 8/1988 | Andersen | D26/136 | |
| 5,012,533 | A | 5/1991 | Raffler | | |
| 5,139,017 | A | 8/1992 | McCloud | | |
| 5,173,970 | A * | 12/1992 | Shifrin | A42B 3/00 | 2/209.12 |
| 5,628,071 | A | 5/1997 | Nezer | | |
| 5,687,426 | A | 11/1997 | Sperber | | |
| D387,501 | S | 12/1997 | Cheng | | |
| 5,745,924 | A | 5/1998 | Egger | | |
| 5,774,901 | A * | 7/1998 | Minami | A42B 3/147 | 2/421 |
| 6,256,796 | B1 * | 7/2001 | Fleming | A42B 1/24 | 2/244 |
| 7,328,462 | B1 | 2/2008 | Straus | | |
| 7,669,378 | B2 * | 3/2010 | Tsunoda | F16F 7/121 | 52/79.8 |
| 7,958,572 | B2 | 6/2011 | Loury et al. | | |
| D758,340 | S * | 6/2016 | Katopis | D14/205 | |
| 9,675,127 | B2 * | 6/2017 | Guadagnin | A42B 3/04 | |
| 10,085,508 | B2 * | 10/2018 | Surabhi | A42B 3/065 | |
| 10,188,159 | B2 * | 1/2019 | Armour | A61F 5/055 | |
| 10,357,072 | B2 * | 7/2019 | Chong | A42B 1/205 | |
| D899,697 | S * | 10/2020 | Shiffer | D29/102 | |
| 2004/0261157 | A1 | 12/2004 | Talluri | | |
| 2005/0257312 | A1 | 11/2005 | Puchalski | | |
| 2007/0226881 | A1 | 10/2007 | Reinhard et al. | | |
| 2007/0277295 | A1 | 12/2007 | Bullock | | |
| 2010/0031426 | A1 | 2/2010 | Lapham | | |
| 2013/0305435 | A1 | 11/2013 | Surabhi | | |
| 2014/0013492 | A1 | 1/2014 | Bottlang et al. | | |
| 2014/0189939 | A1 | 7/2014 | Cheng | | |
| 2018/0027914 | A1 * | 2/2018 | Cook | A42B 3/12 | |
| 2018/0049508 | A1 * | 2/2018 | Terry | A42B 3/322 | |
| 2018/0252286 | A1 | 9/2018 | Abdolahian et al. | | |
| 2019/0142100 | A1 * | 5/2019 | Shiffer | G09F 23/00 | 2/417 |
| 2022/0104574 | A1 * | 4/2022 | Varga | A42B 3/124 | |

FOREIGN PATENT DOCUMENTS

| | | | |
|---|---|---|---|
| CN | 104687626 | A | 6/2015 |
| CN | 205585390 | U | 9/2016 |
| CN | 206275234 | U | 6/2017 |
| DE | 202008013670 | U1 | 1/2009 |
| FR | 2781650 | A1 | 2/2000 |
| GB | 2565524 | A | 2/2019 |
| IT | PD20120335 | A1 | 5/2014 |
| JP | S56131015 | A | 10/1981 |
| JP | 2002044708 | A | 2/2002 |
| JP | 2007092198 | A | 4/2007 |
| JP | 2007331725 | A | 12/2007 |
| JP | 3205084 | U | 7/2016 |
| KR | 20150113232 | A | 10/2015 |
| WO | 2017046757 | A1 | 3/2017 |

OTHER PUBLICATIONS

Extended European Search Report for EP Application No. 17851421.2 dated Apr. 8, 2020.

International Search Report and Written Opinion for International Application No. PCT/US2017/051277 dated Dec. 14, 2017, 14 pages.

First Examination Report for IN Application No. 201917014347 dated Sep. 8, 2021.

* cited by examiner

MACHINE-VENDIBLE FOLDABLE BICYCLE HELMET METHODS AND SYSTEMS

CROSS-REFERENCE TO RELATED APPLICATIONS

This application is a continuation of U.S. application Ser. No. 16/189,423, which was filed on Nov. 13, 2018, entitled Machine-Vendible Foldable Bicycle Helmet Methods and Systems, which is a continuation of International Application No. PCT/US2017/051277, which was filed on Sep. 13, 2017, which claims the benefit of U.S. Provisional Application Ser. No. 62/393,911, which was filed on Sep. 13, 2016, entitled EcoHelmet; U.S. Provisional Application Ser. No. 62/415,057, which was filed on Oct. 31, 2016, entitled Bicycle Helmet; and U.S. Provisional Application Ser. No. 62/458,767 filed Feb. 14, 2017, entitled Bicycle Helmet. The above applications are hereby incorporated by reference as if fully set forth herein in their entirety.

This application is related to U.S. Design application Ser. No. 29/612,613, filed Aug. 2, 2017, which is a continuation-in-part of U.S. Design application Ser. No. 29/593,908, filed Feb. 14, 2017, which is a continuation-in-part of U.S. Design application Ser. No. 29/582,807 filed Oct. 31, 2016. The above design applications are hereby incorporated by reference as if fully set forth herein in their entirety.

FIELD

The present disclosure relates to a folding bicycle helmet having a radially-aligned honeycomb matrix that may be expanded over a head of the user from a collapsed and folded condition to an expanded condition that provides head protection while riding a bicycle.

BACKGROUND

Typically, helmets are bulky and are inconvenient especially when not being worn. When not being worn, the helmet may be left with a bicycle leaving it exposed to possible damage from the environment or to a security risk if not otherwise locked to the bicycle. When not being worn, the helmet may be taken with the user but there are usually no convenient ways to store the helmet causing it to be left behind. Properly wearing helmets may be shown to reduce head injuries in the event of a bicycle accident up to 85%. In bicycle share program scenarios, users are either required to bring their own helmets, buy one specifically for the bicycle rental, or rent a helmet. In such bicycle share programs, only about 10% of users wear helmets. Accordingly, the inventor has recognized a need for improved methods, systems, products, and components to provide an improved bicycle helmet for enabling easy vending, transport, deployment of the improved bicycle helmets throughout an ecosystem of bicycle sales, rental, and use.

SUMMARY

The many embodiments of the present disclosure include a helmet for use with bicycles or other instances where head protection is desirable. The helmet may collapse or fold to a reduced size when not in use. Provided herein are improved methods, systems, products, and components (all of these collectively referred to in the alternative as a "platform" or a "solution," except where context indicates otherwise), including the improved bicycle helmet, its accessories, and a host system for various information technology capabilities, for enabling packaging, security, safety, tracking, compliance, and quality in the ecosystem for bicycles and bicycle sharing programs.

The many embodiments of the present disclosure include a bicycle helmet that fits over a head of a user. The bicycle helmet includes at least one segment of flexible material that forms a honeycomb matrix movable from a folded condition where each side of the at least one segment is disposed generally parallel and an expanded condition where the honeycomb matrix is expanded and at least partially disposed over the head of the user. Cells of the honeycomb matrix are radially oriented in a direction that is perpendicular to a surface of a head of a user.

The many embodiments of the present disclosure include a bicycle helmet that also includes a chin strap connected to at least one side of the at least one segment of flexible material.

The many embodiments of the present disclosure include a bicycle helmet with at least one segment that includes a middle segment of flexible material between two side segments of flexible material and the middle segment and the side segments are each movable from a folded condition where each side of the side segments are disposed generally parallel and an expanded condition where the middle segment and the side segments are expanded and in cooperation are at least partially disposed over the head of the user.

The many embodiments of the present disclosure include a bicycle helmet with the honeycomb matrix of the at least one segment including a plurality of cells that is disposed in a position that is generally perpendicular to a surface of the head of the user when in the expanded condition.

In embodiments, a bicycle helmet that fits over a surface of the head of the user includes at least one segment of flexible cell structures that form a radial honeycomb matrix movable between a folded condition where each side of the at least one segment is disposed generally parallel and an expanded condition where the radial honeycomb matrix of the at least one segment is configured to be expanded at least partially over the head of the user and arranged radially relative to the surface of the head of the user.

In embodiments, a bicycle helmet includes a chin strap assembly connected to at least one side of the at least one segment of flexible material.

In embodiments, the at least one segment includes a middle segment between two side segments each including flexible cell structures that form the radial honeycomb matrix movable from the folded condition where each side of the side segments is disposed generally parallel and an expanded condition where the middle segment and the side segments are expanded and in cooperation are at least partially disposed over the head of the user and arranged radially relative to the surface of the head of the user.

In embodiments, the flexible cell structures of the radial honeycomb matrix of the at least one segment are each configured to be located adjacent to and positioned generally perpendicular to a portion of the surface of the head of the user.

In embodiments, a bicycle helmet includes a chin strap mechanism having at least one strap connected to the at least one segment. In embodiments, the chin strap mechanism is configured to be releasably coupled around the head of the user.

In embodiments, a bicycle helmet includes a helmet location indicator mechanism configured to connect over a wireless network with one of a mobile device, a vending kiosk, a proximity detector, and a computer.

In embodiments, the at least one segment includes a middle segment between two side segments each including flexible cell structures that form the radial honeycomb matrix movable from the folded condition where each side of the side segments is disposed generally parallel and an expanded condition where the middle segment and the side segments are expanded and in cooperation form an exterior curvature of the bicycle helmet that is on an opposite side of the helmet from an interior curvature that is configured to be at least partially disposed over the head of the user. The flexible cell structures of the radial honeycomb matrix in the expanded condition are each arranged radially in a direction that is perpendicular to the interior curvature configured to be disposed over the head of the user.

In embodiments, a bicycle helmet includes at least one strap positioned over the helmet configured to limit an amount of expansion of the honeycomb matrix when moving into the expanded condition.

In embodiments, a bicycle helmet includes a chin strap assembly connected to the at least one side of the at least one segment of flexible material. In embodiments, a portion of the chin strap assembly includes the at least one strap positioned over the helmet.

In embodiments, a portion of the chin strap assembly is made of the same material as the at least one strap positioned over the helmet.

In embodiments, the honeycomb matrix includes a plurality of walls that is arranged to form cells of the honeycomb matrix. A first portion of the plurality of walls extends from a front of the helmet to a rear of the helmet and a second portion of the plurality of walls extends from a central location of the helmet part way toward the front and the rear of the helmet resulting in a reduced number of cells proximate the front and rear of the helmet relative to the central location that is distal from the front and rear of the helmet.

In embodiments, a bicycle helmet includes a helmet location indicator mechanism connected to the bicycle helmet and configured to connect over a wireless network with one of a mobile device, a vending kiosk, a proximity detector, and a computer. In embodiments, an inventory control facility processes at least a portion of helmet inventory and sale by detecting the helmet location indicator mechanism.

In embodiments, a bicycle helmet includes a telltale mechanism connected to the bicycle helmet that indicates that the bicycle helmet has been opened to its expanded condition.

In embodiments, a bicycle helmet includes at least one light mechanism connected to the bicycle helmet that is configured to switch on illumination when the bicycle helmet is opened to its expanded condition.

In embodiments, at least one light mechanism connected to the bicycle helmet is a telltale mechanism that is configured to switch on illumination when the bicycle helmet is opened to its expanded condition and indicates that the bicycle helmet has been used.

In embodiments, at least one segment in its expanded condition is configured to display a portion of one of advertising, a graphic, and text on an outer surface that defines an exterior curvature of the least one segment of the bicycle helmet.

In embodiments, at least one segment in its folded condition is configured to reduce visibility of the portion of one of advertising, a graphic, and text on the outer surface that defines the exterior curvature of the least one segment of the bicycle helmet and is configured to reveal the portion of one of advertising, a graphic, and text on the outer surface as the least one segment of the bicycle helmet moves from the folded condition to the expanded condition.

In embodiments, a bicycle helmet that fits over a head of a user includes a honeycomb matrix movable from a folded condition where the honeycomb matrix is collapsed and an expanded condition where the honeycomb matrix is expanded and at least partially disposed over the head of the user and arranged radially relative to the surface of the head of the user. The bicycle helmet also includes at least one strap that is configured to limit an amount of expansion of the honeycomb matrix in the expanded condition.

In embodiments, the at least one strap that is configured to limit the amount of expansion is disposed over an outer surface of the honeycomb matrix when the helmet is disposed in the expanded condition.

In embodiments, a bicycle helmet includes the at least one strap that is configured to limit the amount of expansion is configured to one of gather, fold, or coil when the honeycomb matrix is in the folded condition.

In embodiments, a bicycle helmet includes a chin strap mechanism having at least one strap that is attached to a strap attachment region of an exterior wall of the honeycomb matrix with a portion of the at least one strap that is configured to limit an amount of expansion of the honeycomb matrix.

In embodiments, the honeycomb matrix defines a recess configured to accept at least a portion of the at least one strap that is configured to limit an amount of expansion of the honeycomb matrix when the honeycomb matrix is in the expanded condition.

In embodiments, a bicycle helmet that fits over a head of a user including a honeycomb matrix movable between a folded condition where the honeycomb is unopened and an expanded condition where the honeycomb matrix is opened up and at least partially disposed over the head of the user. The honeycomb matrix includes a plurality of cells that are disposed in a position that is generally perpendicular to a surface of the head of the user when in the expanded condition. The honeycomb matrix includes a reduced number of cells proximate a front and a rear of the helmet relative to a central location that is distal from the front and rear of the helmet.

In embodiments, the honeycomb matrix includes the plurality of cells that includes cells each radially aligned with each other.

In embodiments, a bicycle helmet includes at least one strap positioned over the honeycomb matrix and configured to limit an amount of expansion of the honeycomb matrix when moving into the expanded condition.

In embodiments, a bicycle helmet includes a chin strap assembly connected to an exterior wall of the honeycomb matrix. In embodiments, a portion of the chin strap assembly includes the at least one strap positioned over the honeycomb matrix.

In embodiments, a portion of the chin strap assembly is made of the same material as the at least one strap positioned over the honeycomb matrix.

In embodiments, a bicycle helmet includes at least one light mechanism connected to the bicycle helmet that is configured to switch on illumination when the bicycle helmet is opened to its expanded condition.

In embodiments, a middle segment between two side segments each includes plurality of cells that form the honeycomb matrix movable from the folded condition where each side of the side segments are disposed generally parallel and an expanded condition where the middle segment and the side segments are expanded and in cooperation and form an exterior curvature of the bicycle helmet that is on an opposite side of the helmet from an interior curvature that is configured to be at least partially disposed over the head of the user.

In embodiments, the honeycomb matrix in its expanded condition is configured to display a portion of one of advertising, a graphic, and text on an outer surface that defines an exterior curvature of the bicycle helmet. In embodiments, the honeycomb matrix in its folded condition is configured to reduce visibility of the portion of one of advertising, a graphic, and text on the outer surface that defines the exterior curvature of the bicycle helmet and is configured to reveal the portion of one of advertising, a graphic, and text on the outer surface as the honeycomb matrix moves from the folded condition to the expanded condition.

In embodiments, a method for protecting a head of a user of a bicycle from impact includes expanding at least one segment of flexible cell structures that form a honeycomb matrix movable from a folded condition where each side of the at least one segment is disposed generally parallel to an expanded condition where the honeycomb matrix is at least partially disposed over the head of the user. In embodiments, the cell structures of the honeycomb matrix of the at least one segment are disposed in a position that is generally perpendicular to a surface of the head of the rider when in the expanded condition.

In embodiments, the method includes closing a chin strap mechanism under a chin on the head of the user.

In embodiments, the method includes signaling a location of the bicycle helmet from a mechanism on the bicycle helmet that is configured to connect over a wireless network with one of a mobile device, a vending kiosk, a proximity detector, and a computer.

In embodiments, the method includes limiting the expansion of the honeycomb matrix when moving into the expanded condition with at least one strap positioned over the helmet configured to limit an amount of the expansion.

In embodiments, the method includes indicating with a telltale mechanism connected to the bicycle helmet that the bicycle helmet has been opened to its expanded condition.

In embodiments, the method includes providing illumination from the bicycle helmet with at least one light mechanism that is configured to switch on illumination when the bicycle helmet is opened to its expanded condition.

DETAILED DESCRIPTION

Figure 1:
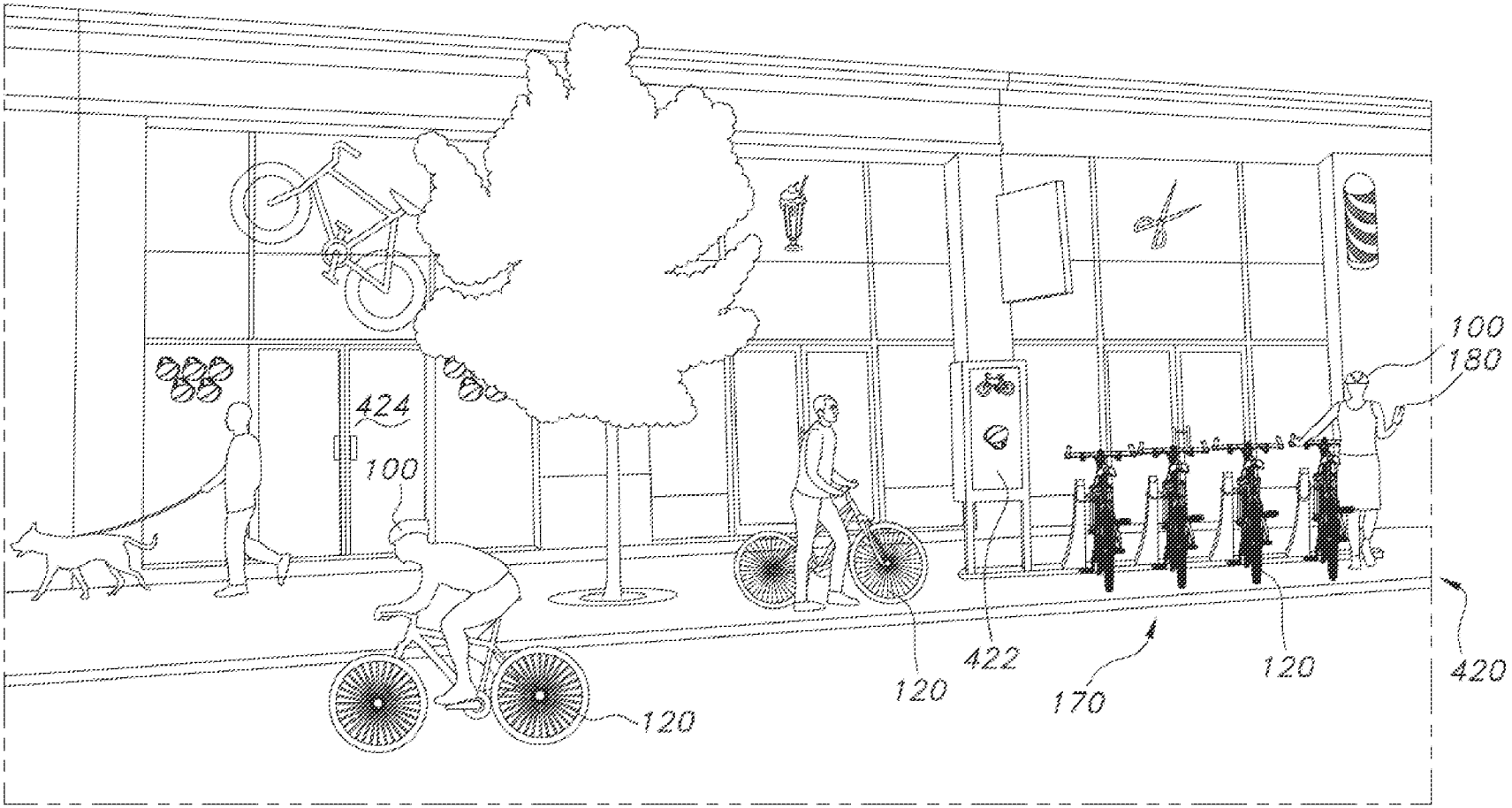
FIG. 1 is a diagrammatic view of bicycle helmets deployed into an environment including availability in a bicycle sharing, helmet vending environment in accordance with the present disclosure.

With reference to the Figures, the present disclosure includes a bicycle helmet 100 that may be worn by a user 110 and may be shown to protect the user 110 when in a crash or fall while riding a bicycle 120, especially relative to situations where a rider opts for no helmet at all. The construction of the bicycle helmet 100 includes a honeycomb-shaped matrix 130 whose orientation and configuration may be shown to provide sufficient head protection in most bicycle scenarios and provide the structural integrity of the bicycle helmet 100. The construction of the bicycle helmet 100 and the orientation and configuration of the matrix may include numerous ornamental features independent and distinct from its numerous technical and functional features disclosed herein.

In many embodiments of the present disclosure, the one or more bicycle helmets 100 may be deployed in a stored, collapsed, folded, or the like condition 140, which is depicted in many figures including FIG. 13 through FIG. 20. The bicycle helmet 100 may then be expanded and moved to its expanded, operational, open, or the like condition 142, which is depicted in the figures including FIG. 5 through FIG. 12. Movement between the folded condition 140 and the expanded condition 142 are depicted in the figures including FIGS. 2, 3 and 4.

In the folded condition 140, the bicycle helmet 100 may be stored until use, sale, giveaway, or the like. When the bicycle helmet 100 is deployed to its expanded condition 142, the bicycle helmet 100 may be worn on a head 150 of the user 110 for their safety while riding. By way of these examples, an outer surface 152 of the head 150 has contours 154 over which cell structures 160 of the honeycomb matrix 130 may be radially disposed in a direction that is generally perpendicular to the outer surface 152 of the head 150. When the journey is complete or at stops along the way, the user 110 may return the bicycle helmet 100 to its folded condition 140 and later unfold and expand it again (and again, as needed) to deploy it to its expanded condition 142. In embodiments, the bicycle helmet 100 may be moved between its folded condition 140 and its expanded condition 142 many times over its lifetime. In embodiments, a bicycle helmet may be moved between a folded condition and an expanded condition a predetermined amount of movements to define a service lifetime. In embodiments, a bicycle helmet may be moved between a folded condition and an expanded condition once or a limited number indicative of single use and then recycled or discarded. In embodiments, repeated movement between the folded condition 140 and the expanded condition 142 of the bicycle helmet 100 within its service lifetime may be shown to not impede the efficacy of the impact protection offered by the bicycle helmet 100.

Figure 55:
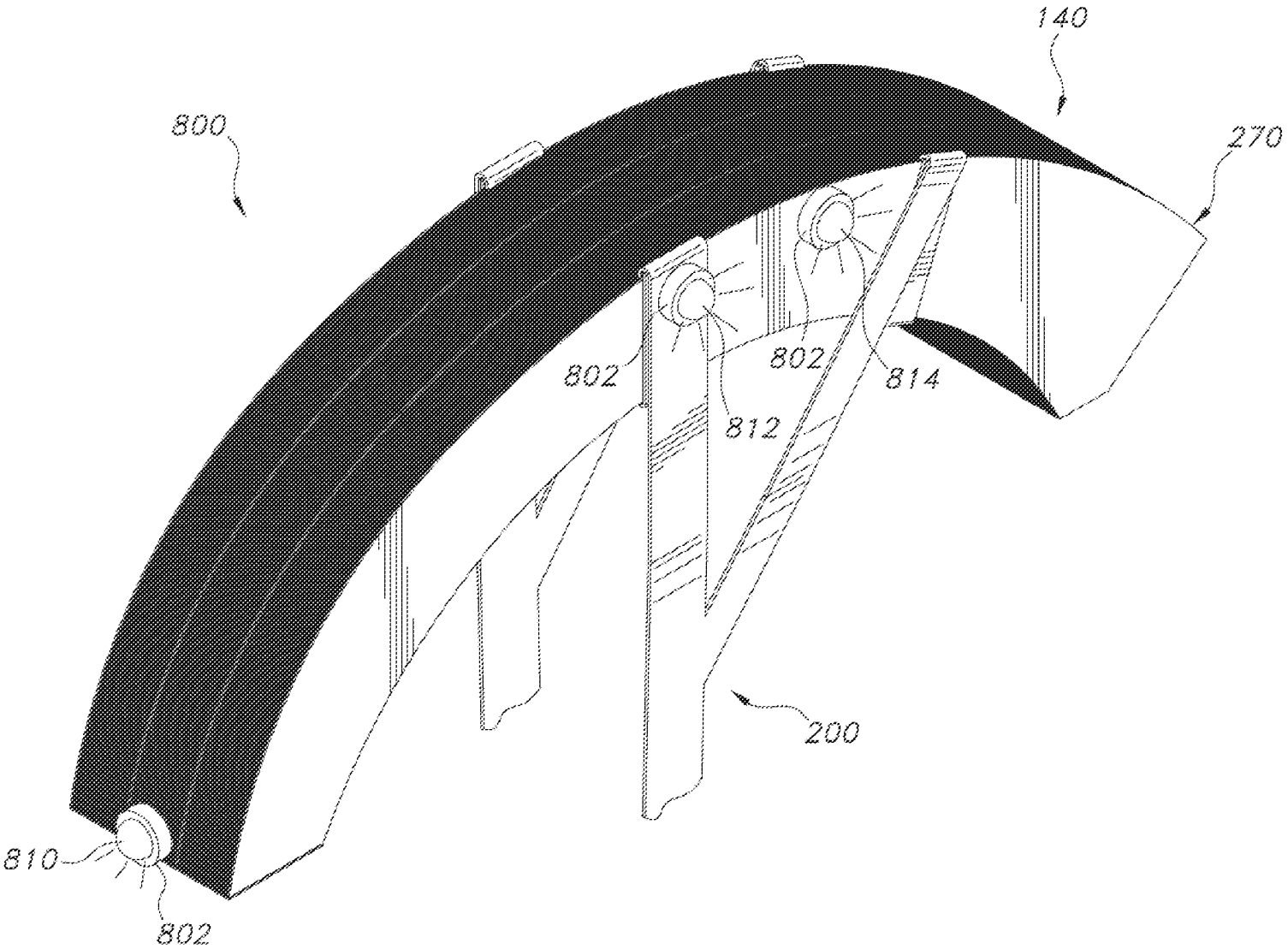
FIGS. 55 and 56 are diagrammatic views of embodiments of bicycle helmets with lighting mechanism deployed during use in accordance with the present disclosure.
Figure 56:
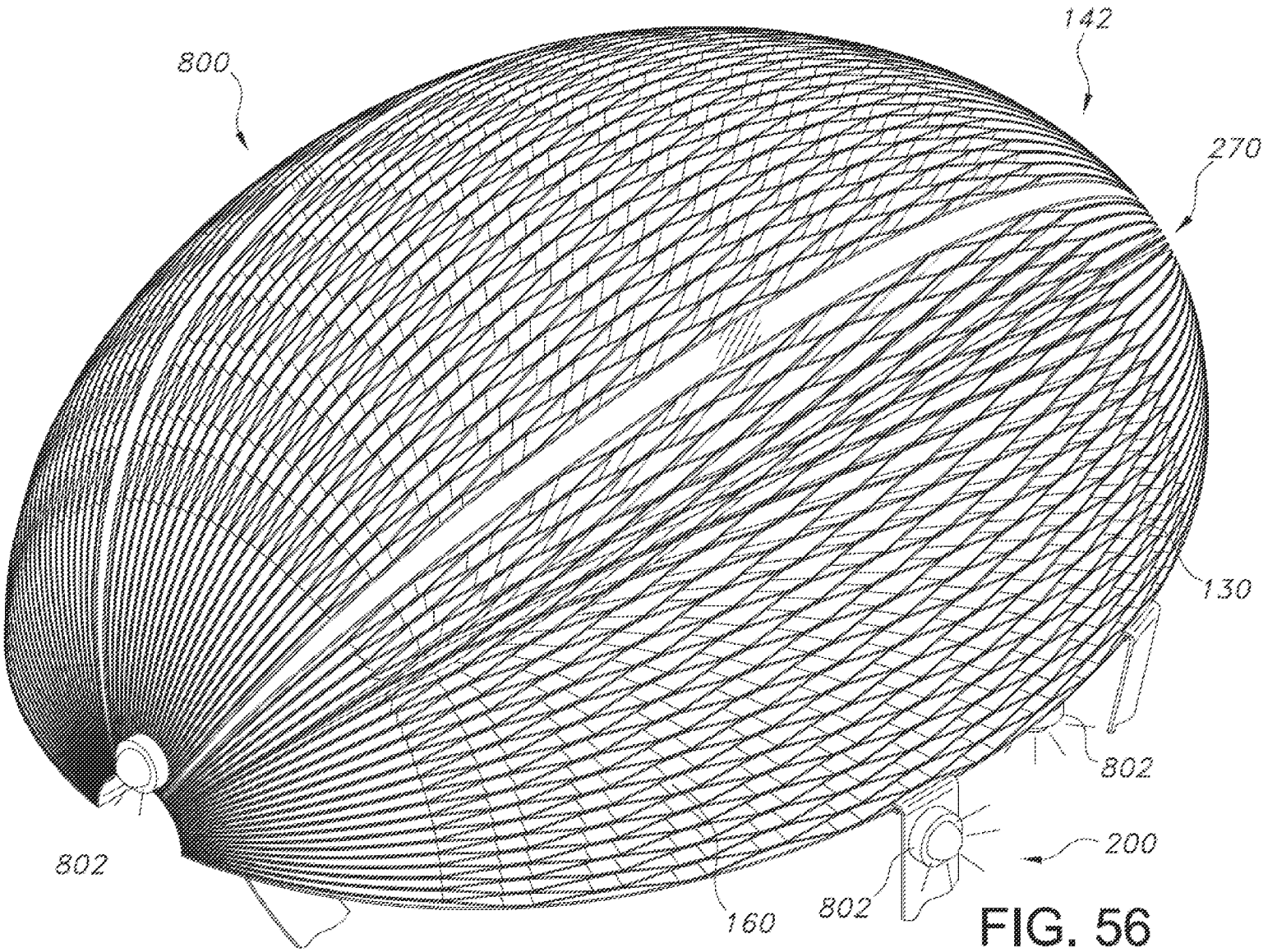

In embodiments, the bicycle helmet 100 may have a portion of its structure purposely include or define a telltale indicating use but otherwise not compromise the overall structural integrity of the bicycle helmet 100. In embodiments, the bicycle helmet 100 may be configured to have one or more reflectors or one or more light mechanisms operational during use, as shown in FIGS. 55 and 56. In many examples, the one or more light mechanism may be activated when the bicycle helmet 100 is moved from the folded condition 140 to the expanded condition 142. In embodiments, activation of the one or more light mechanisms by moving the bicycle helmet 100 from the folded condition 140 to the expanded condition 142 may be a telltale indicating use, one-time use, or the like. In embodiments, the activation of the one or more light mechanisms by moving the bicycle helmet 100 from the folded condition 140 to the expanded condition 142 may serve as a trackable indicator of use, one-time use, or the like.

In embodiments, the bicycle helmet 100 may be vended automatically from a vending machine, as shown in FIG. 1. The vending may occur with the bicycle helmet 100 in the folded condition 140. In embodiments, the vending of the bicycle helmet 100 may occur in combination with a transaction that may include one or more of renting, sharing, purchase, giveaways, promotional offers, or the like. In embodiments, the bicycle helmet 100 may contain and display advertising. In embodiments, the bicycle helmet 100 may contain and display advertising visible when the bicycle helmet 100 is in its expanded condition 142 but not fully visible when in its folded condition 140. In embodiments, the bicycle helmet 100 may reveal advertising or a graphic on an exterior curvature on its outer surface when moved into the expanded condition 142. In one example, the advertising is from an entity (or related entity) providing the bicycle rental, sharing, purchase, use, or the like that provides one or more bicycles the bicycle helmets 100 for each of the bicycles.

FIG. 1 depicts the many embodiments for vending of bicycle helmets including the bicycle helmet 100. In embodiments, users including the user 110 may arrange to rent one or more bicycles including the bicycle 120 through one or more bicycle systems 170 that deploy bicycle sharing, rental arrangements, private use liveries, vending machines, or the like that may be available throughout the world in public and private use. In embodiments, the user 110 may register for one or more of the bicycle systems 170 including sharing programs, rental arrangements, or the like and, therefore, may maintain an identity, profile, system information, or the like including a user profile 172 (or a portion thereof) that is unique to the one or more bicycle systems 170. In embodiments, users may use a connected device 180 including mobile phones, a mobile phone of the user 110, web browsers, kiosks, or the like to access, interact with and deploy one or more ride sharing applications or the like and to configure various preferences and/or priorities associated with the user profile 172.

Figure 2:
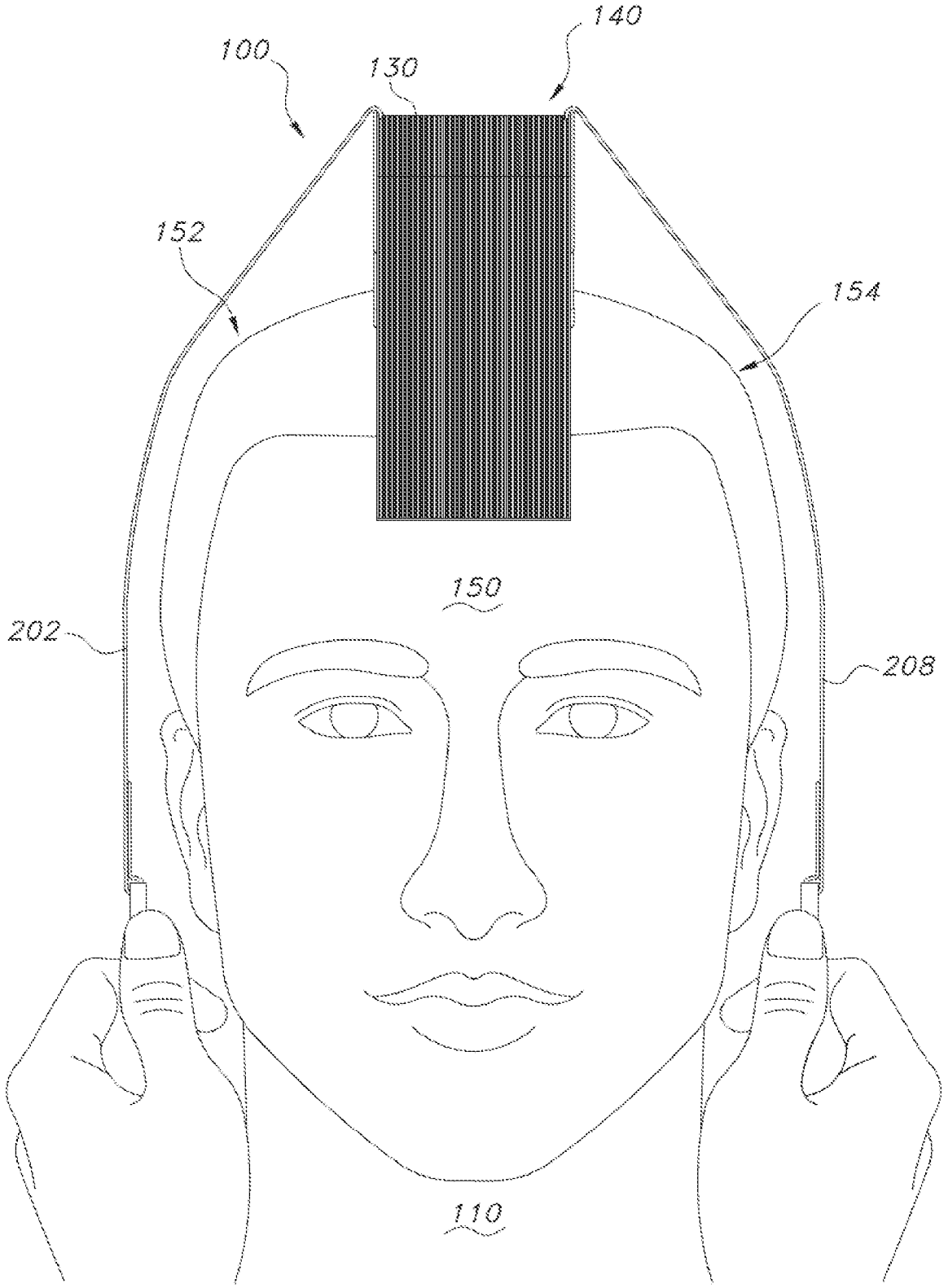
FIG. 2 is a diagrammatic view of a user expanding a bicycle helmet from its collapsed or folded condition in accordance with the present disclosure.
Figure 3:
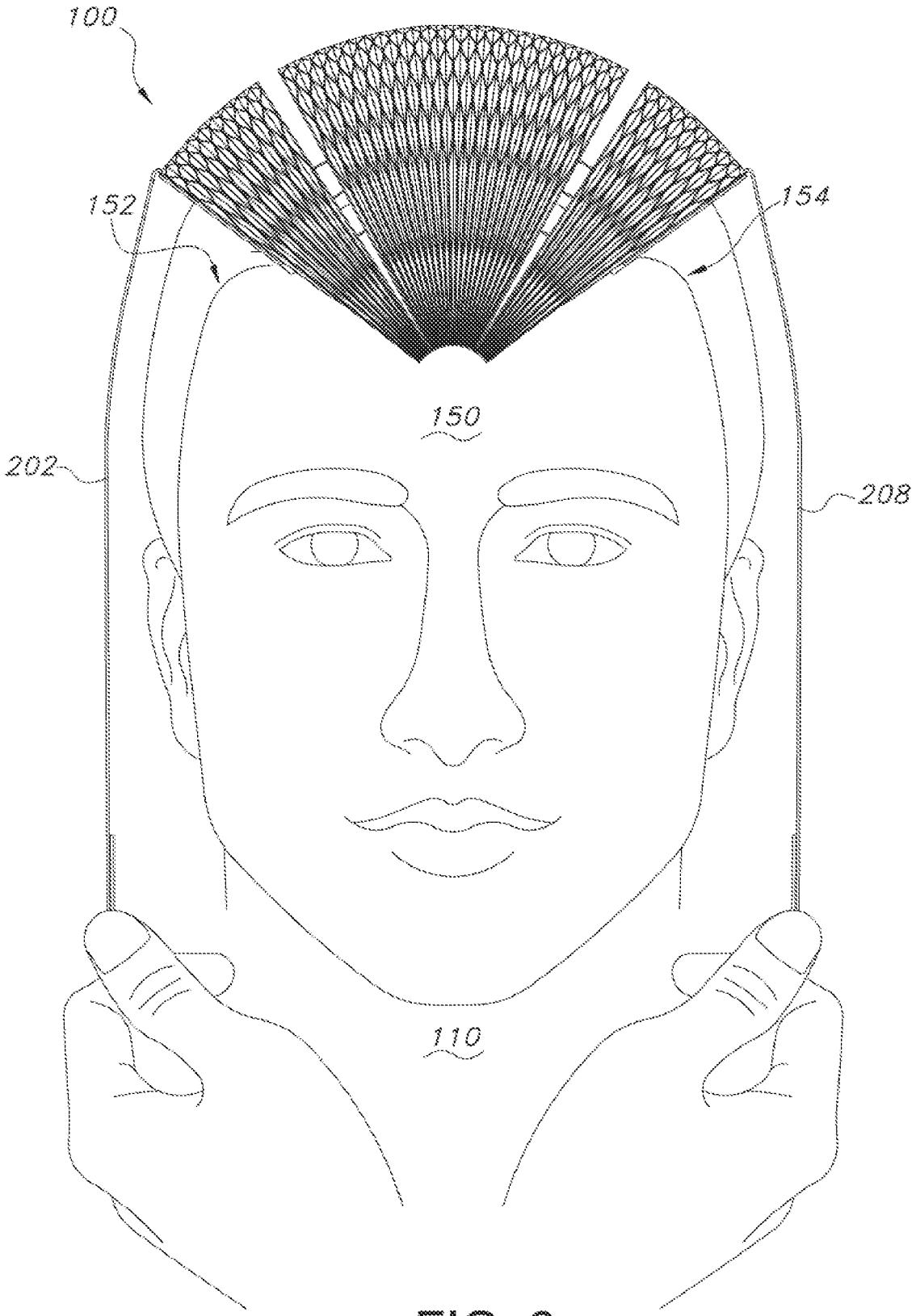
FIG. 3 is a diagrammatic view of the user further expanding the bicycle helmet of FIG. 2.
Figure 4:
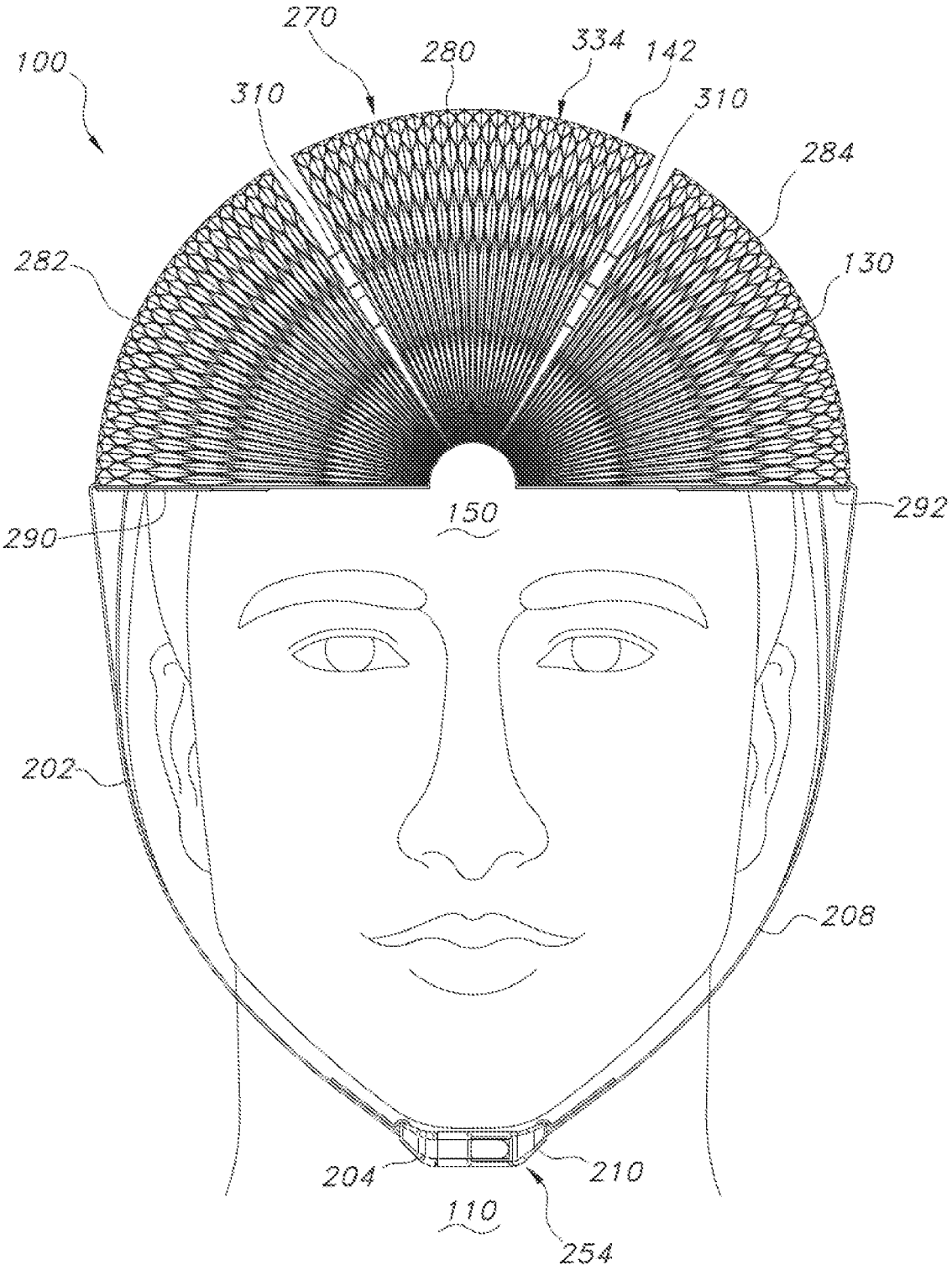
FIG. 4 is a diagrammatic view of the user tightening a chin strap of the expanded helmet of FIG. 3.

Referring to FIGS. 2, 3 and 4, the user 110 may expand the bicycle helmet 100 to its expanded condition 142 and use it as impact protection. In embodiments, the user 110 may place the helmet 100 on their head, shown in in FIG. 2, and grasp straps of the chin strap assembly 200 to begin to pull the helmet 100 over the head 150 of the user 110. FIG. 3 depicts an initial expansion of the bicycle helmet 100 as the user 110 continues to pull on a first side strap 202 connected to a first latch 204 and a second side strap 208 connected to a second latch 210. The user 110 may complete the process of securing the bicycle helmet 100 to their head 150 by securing the first latch 204 to the second latch 210 resulting in the chin strap assembly 200 being secured over a chin 220 of the user 110. With the chin strap assembly 200 adjusted for comfort, the closing of the chin strap assembly 200 over and around the chin 220 of the user 110 may place the bicycle helmet 100 into its expanded condition 142 and be properly located over the head 150 of the user 110.

In embodiments, the bicycle helmet 100 may be made from a thin and flexible material 230. The thin and flexible material 230 may form the cell structures 160 of the honeycomb matrix 130. In embodiments, the honeycomb matrix 130 may be a paper matrix. When the bicycle helmet 100 is in its expanded condition 142 and the honeycomb matrix 130 is positioned around the head 150 of the user 110, the honeycomb matrix 130 itself may be shown to provide sufficient protection and structural integrity to protect the head 150 of the user 110. By way of these examples, the honeycomb matrix 130 may serve as structural elements in the bicycle helmet 100. In embodiments, the honeycomb matrix 130 may serve as the only structural element, the only protective element, and the structure that permits the bicycle helmet 100 to move between the folded condition 140 and the expanded condition 142. In embodiments, the honeycomb matrix 130 is constructed of a radially-disposed matrix of cells. In embodiments, the honeycomb matrix 130 is constructed of a radially-disposed matrix of cells where radially-disposed includes any orientation of the cell structures 160 relative to one another that does not include them being parallel to one another. In embodiments, adjacent cell structures 160 of the honeycomb matrix 130 are not parallel.

In embodiments, the thin and flexible helmet material 230 of the bicycle helmet 100 may be a paper material, a polypropylene material, and the like. In embodiments, the thin and flexible helmet material 230 may also be a paper material substitute, corn plastics, PET plastics, sucrose based plastics, cornstarch based plastics, hemp, woven plastic, recycled paper, and other organic fibers. In many examples, the thin and flexible helmet material 230 may be less than 1 mm in thickness. In many examples, the configuration of the thin and flexible helmet material 230 as deployed as the honeycomb matrix 130 may permit the bicycle helmet 100 to be deployed in the folded condition 140 and then move multiple times between the folded condition 140 and the expanded condition 142. In embodiments, the ability of the honeycomb matrix 130 to flex is what may permit the bicycle helmet 100 to move between the folded condition 140 and the expanded condition 142.

The bicycle helmet 100 may be worn by the user in the operational or expanded condition 142 and may protect the user when the user experiences a crash, a fall or other head impact while using a bicycle. The bicycle helmet 100, when worn in an expanded condition 142, may protect the user by absorbing at least some of the impact resulting from a blow to a user's head 150. It may be shown that the user 110 may be protected from experiencing detrimental a blow or impact to the head 150 with the bicycle helmet 100 from almost any direction during a crash or other impact into or from an object that could be the ground, a curb, a motor vehicle, another bicycle, another person, an animal, a building, a signpost, and the like.

The bicycle helmet 100 may also include the chin strap assembly 200. The chin strap assembly 200 may secure the bicycle helmet 100 to the head 150 of the user 110 by wrapping underneath the chin 220 of the user. The chin strap assembly 200 may include the first side strap 202 connected to the first latch 204 and the second side strap 208 connected to the second latch 210 that may connect and disconnect to the first latch 204 to secure the chin strap assembly 200. The chin strap assembly 200 may be made from polypropylene braided mesh, cotton mesh, and other suitable strap material. In further examples, the chin strap assembly 200 may be made of paper, leather, composite material, polypropylene material, and the like.

Figure 5:
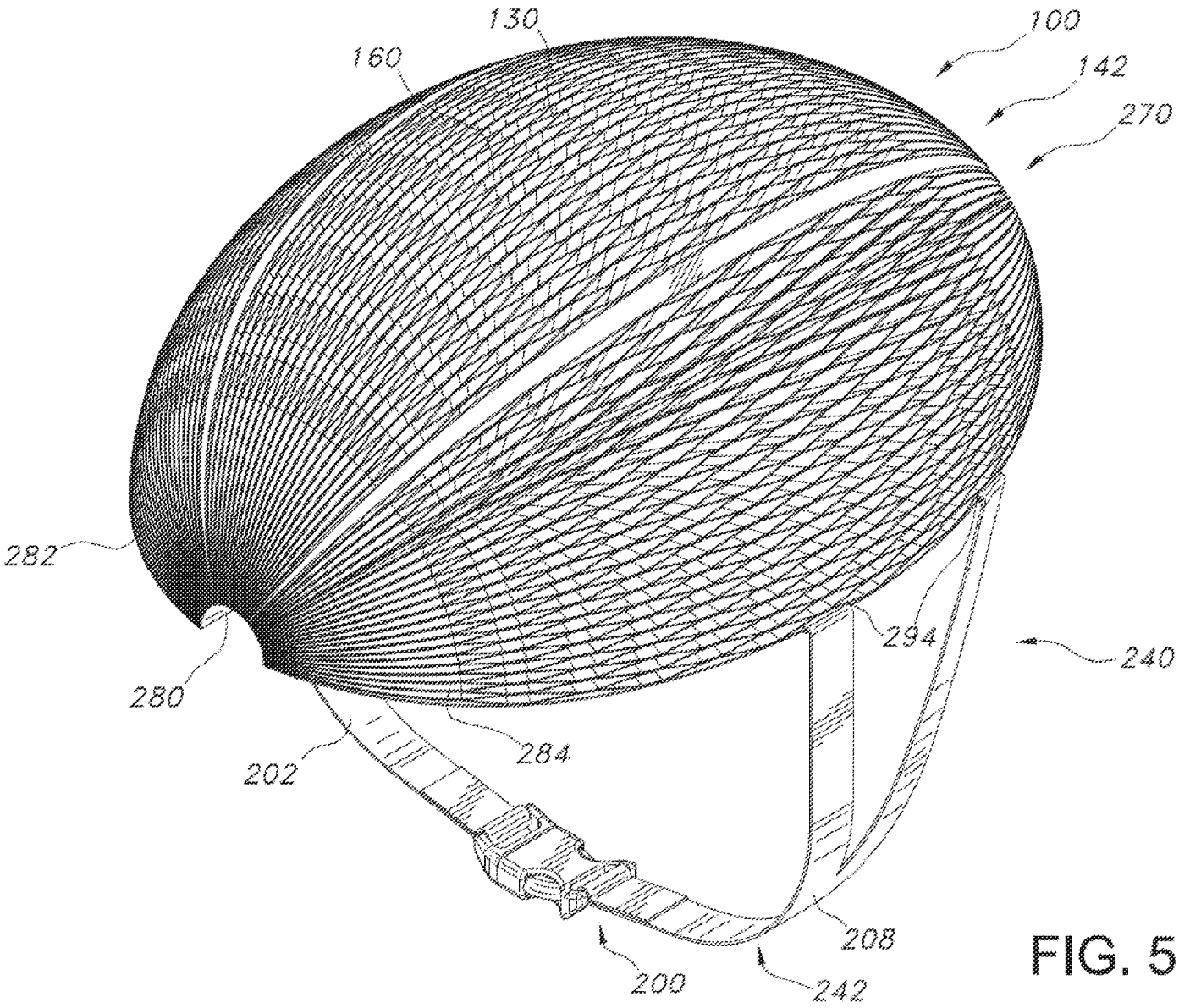
FIG. 5 is a top perspective view of a bicycle helmet in an operational or expanded condition in accordance with the present disclosure.
Figure 10:
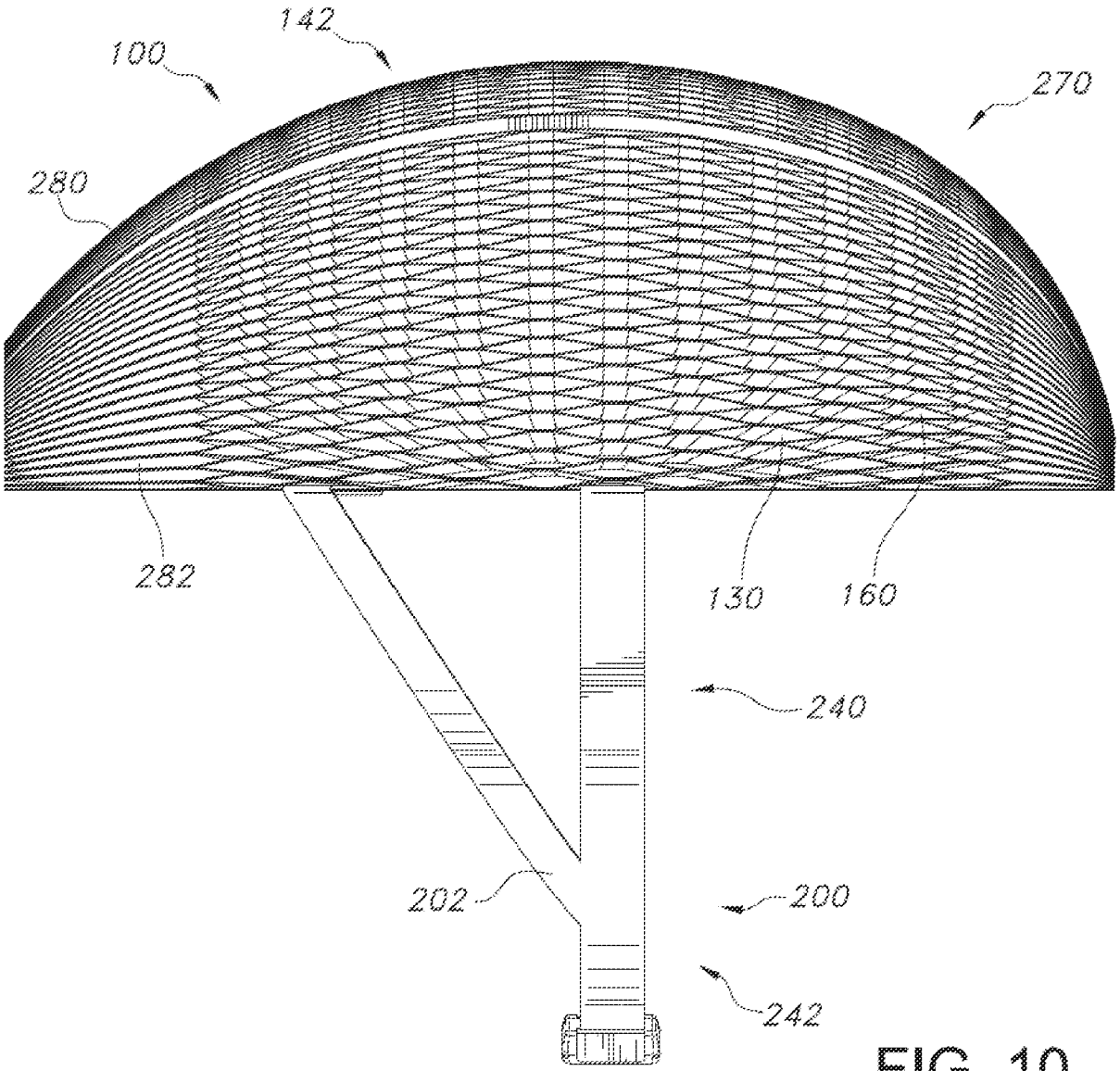
FIG. 10 is a left side view of the bicycle helmet of FIG. 5.
Figure 11:
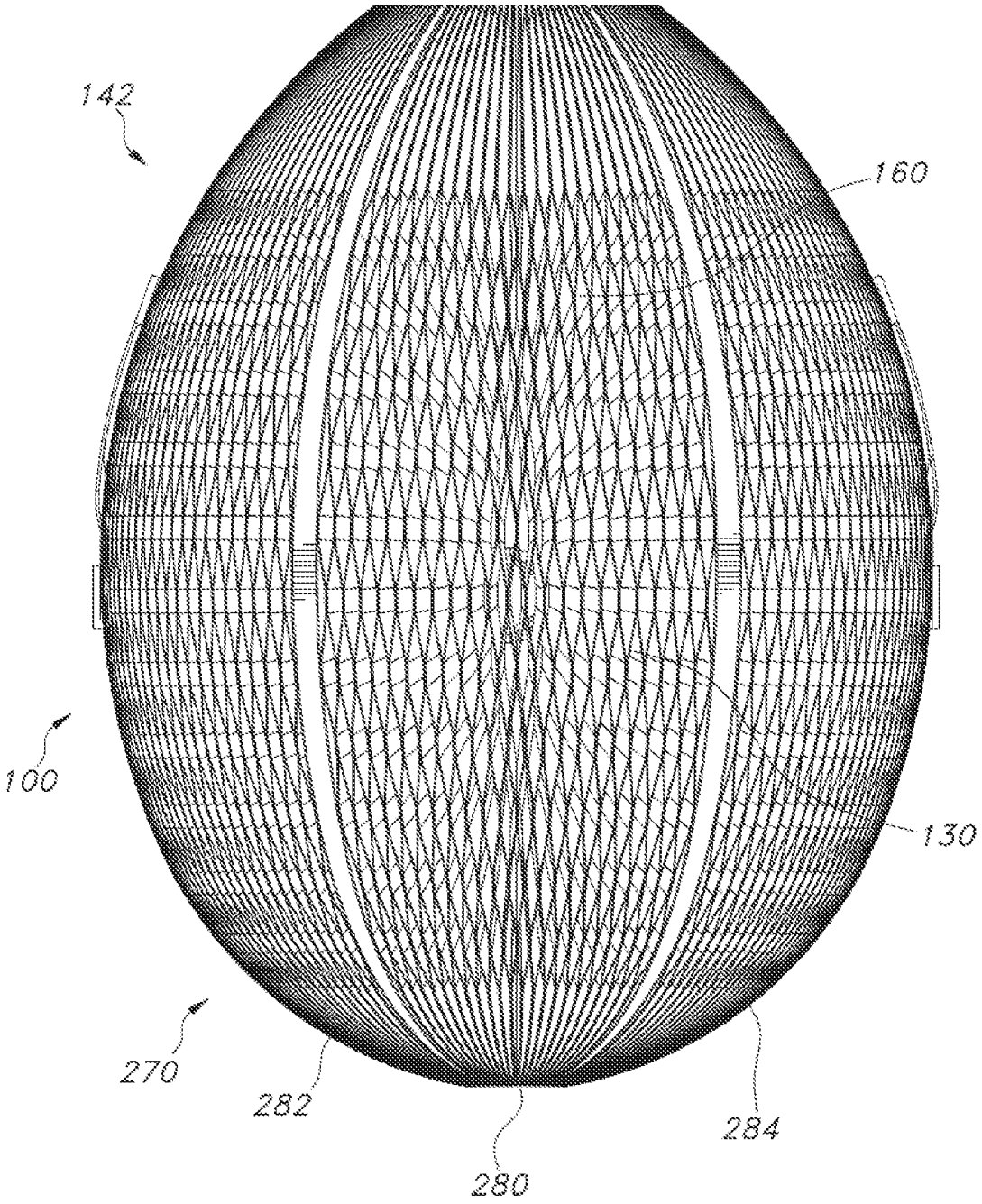
FIG. 11 is a top view of the bicycle helmet of FIG. 5.
Figure 12:
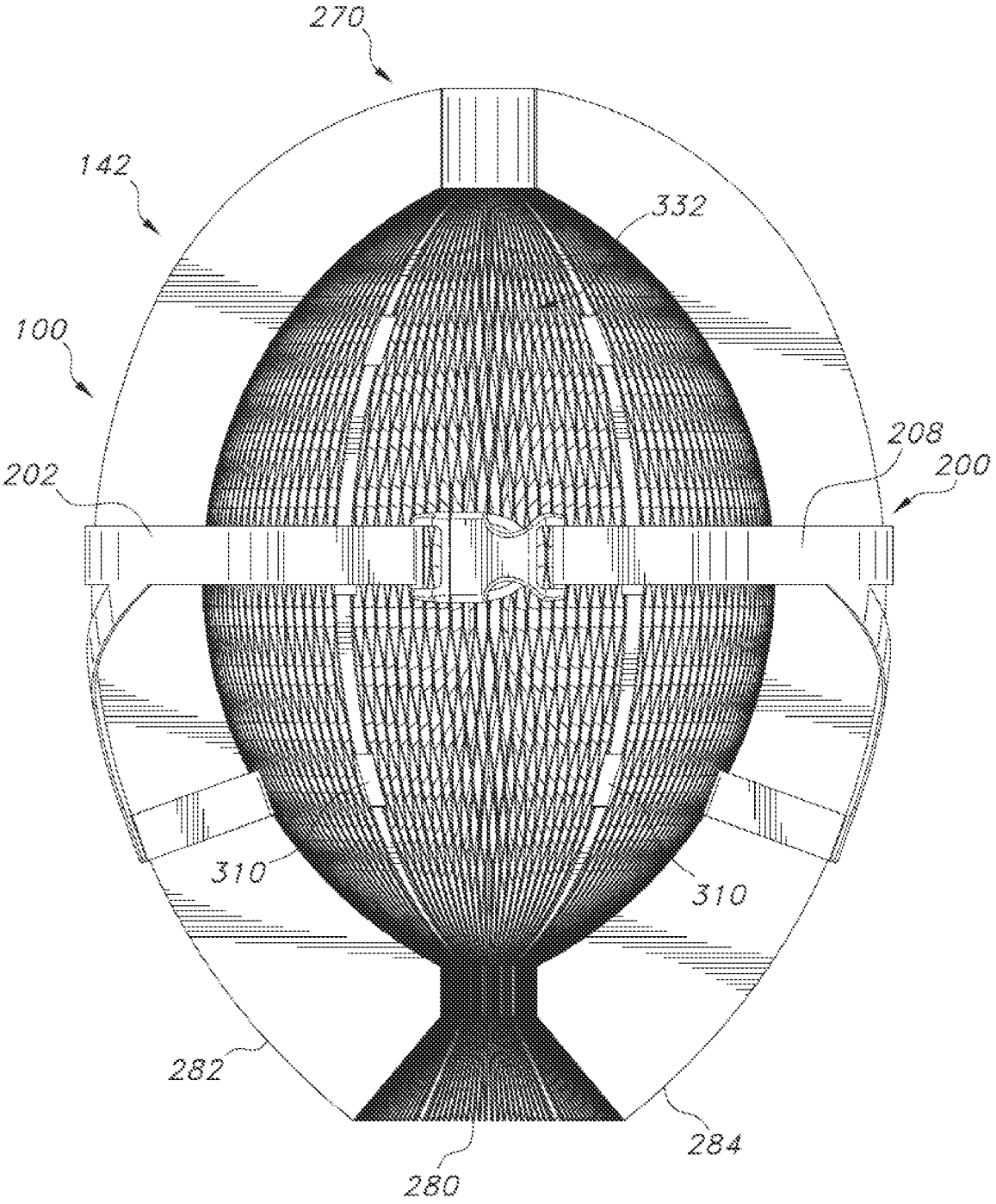
FIG. 12 is a bottom view of the bicycle helmet of FIG. 5.
Figure 13:
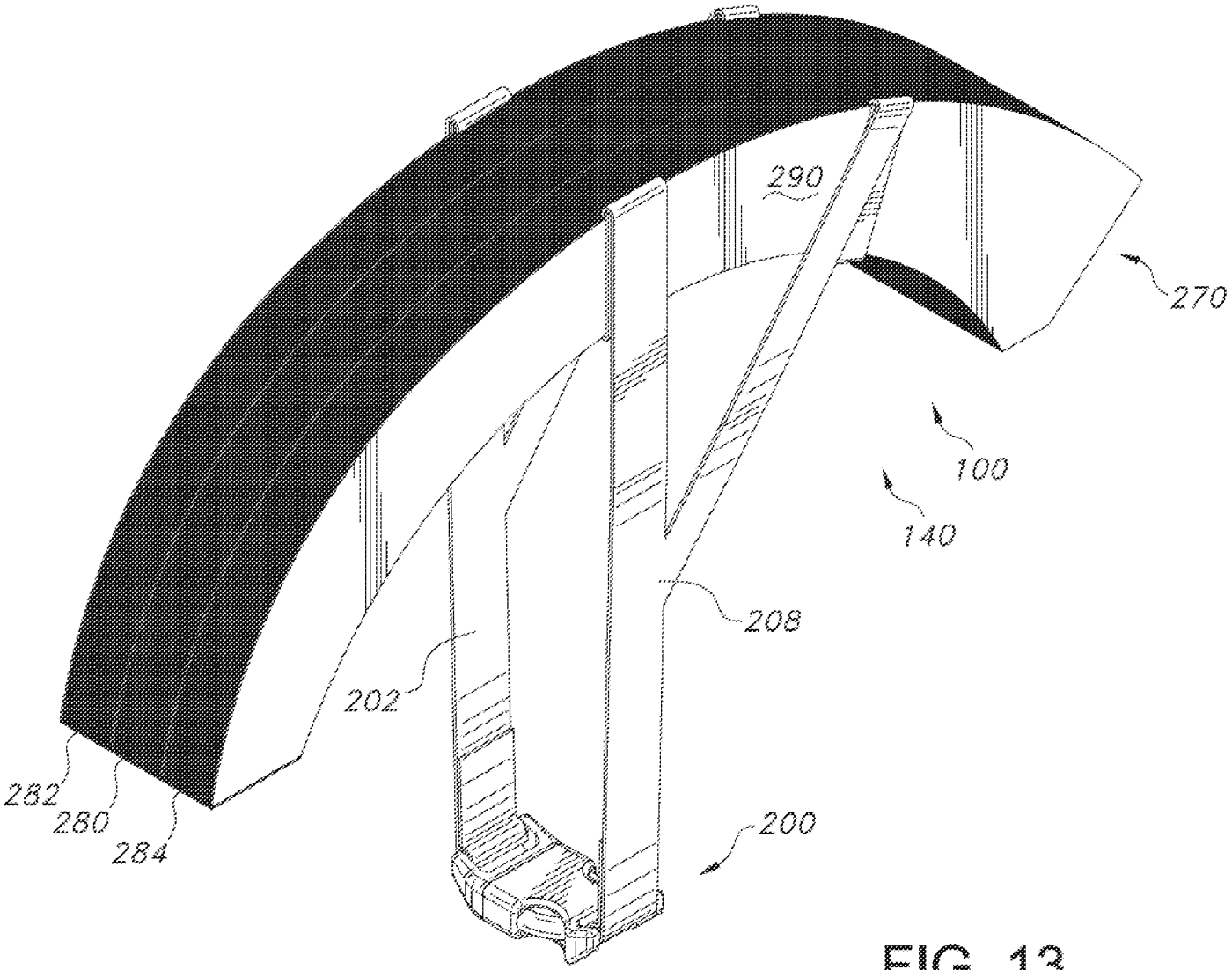
FIG. 13 is a top perspective view of a bicycle helmet in a collapsed or folded condition in accordance with the present disclosure.
Figure 14:
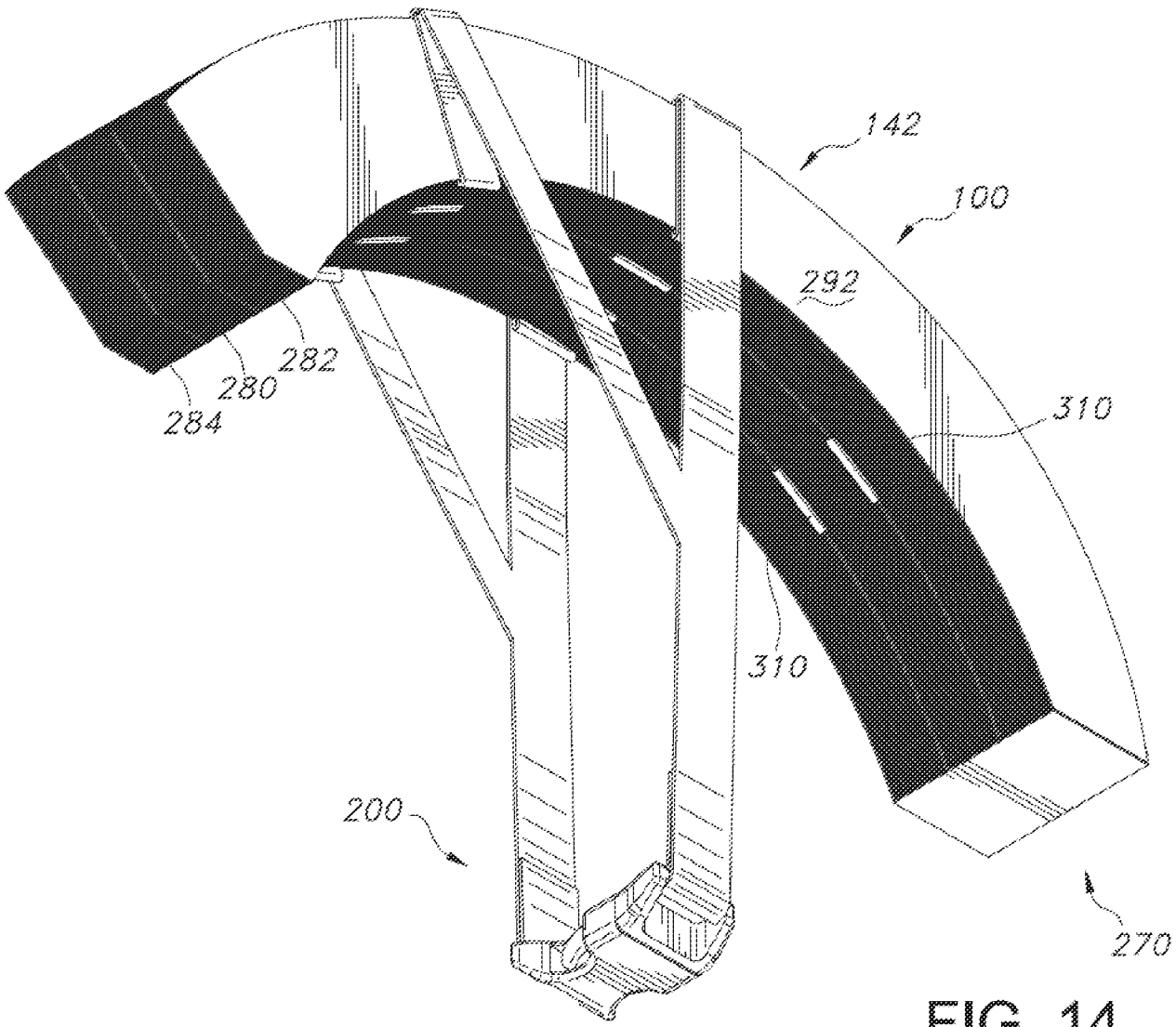
FIG. 14 is a bottom perspective view of the bicycle helmet of FIG. 13.

As depicted in FIGS. 5 and 10, the chin strap assembly 200 may include upper chin straps 240 and lower chin straps 242. In one example, the upper chin straps 240 may include two upper chin strap portions 250, 252 on each side of the bicycle helmet 100. The lower chin straps 242 may each connect to the latches 204, 210 that may form a buckle 254. By way of these examples, the first side strap 202 and the second side strap 208 may each include one of the upper chin straps 240 and one of the lower chin straps 242 and may releasably connect at the buckle 254.

With reference to FIG. 5 through FIG. 12, the bicycle helmet 100 may be assembled from multiple segments 270. In embodiments, the segments 270 may be separated by and define gaps 272 between the segments 270. In embodiments, the bicycle helmet 100 may include three segments 270. The three segments 270 may include a middle segment 280 and two side segments 282, 284. In embodiments, each of the segments 270 may each include the honeycomb matrix 130 with radially aligned cell structures 160. In embodiments, the cell structures 160 may cooperate in combination to form the honeycomb matrix 130. The honeycomb matrix 130 and its cell structures 160 may be formed from layers of helmet material 230 such as paper, plastics, and other suitable materials.

In embodiments, layers of the helmet material 230 may be glued in a pattern to form the cell structures 160. The pattern of the layers of the helmet material 230 may be arranged so that the cell structures 160 may stand orthogonal to the outer surface 152 of the head 150 the user 110 and the cell structures 160 may also permit the bicycle helmet 100 to move between the folded condition 140 and the expanded condition 142. In embodiments, the pattern of the layers of the helmet material 230 may also be arranged to permit the cell structures 160 to collapse or fold and allow the segments 270 to each lay flat laterally in the folded condition 140. In embodiments, layers of the helmet material 230 may be glued in an alternating radial pattern that may form the individual structural cells 160 of the honeycomb matrix 130. In embodiments, the structural cells 160 may be configured so as to be less than or equal to 1.5 cm wide in any direction when the bicycle helmet 100 is in the expanded condition 142.

In embodiments, the first side strap 202 and the second side strap 208 of the upper chin straps 240 may each attach to the two side segments 282, 284. In embodiments, various configurations of chin strap assembly 200 and other mechanisms to secure the bicycle helmet 100 to the user 110 may be employed. In embodiments, the side segment 282 may have an external face 290 and the side segment 284 may have the external face 292. In the folded condition 140 of the bicycle helmet 100, the external faces 290 and 292 may be about parallel. The first and second side straps 202, 208 of the chin strap assembly 200 may attach to the two side segments 282, 284 at attachment points 294, 298 on the external faces 290, 292, respectively. In embodiments, at least one of the upper chin straps 240 and the two upper chin strap portions 250, 252 may be secured to the attachment points 294, 298 with glue, other appropriate adhesives, mechanical fasteners, or the like. In embodiments, the at least one of the upper chin straps 240 and the two upper chin strap portions 250, 252 may also lock or tie into a portion of the two side segments 282, 284, or the like.

Figure 6:
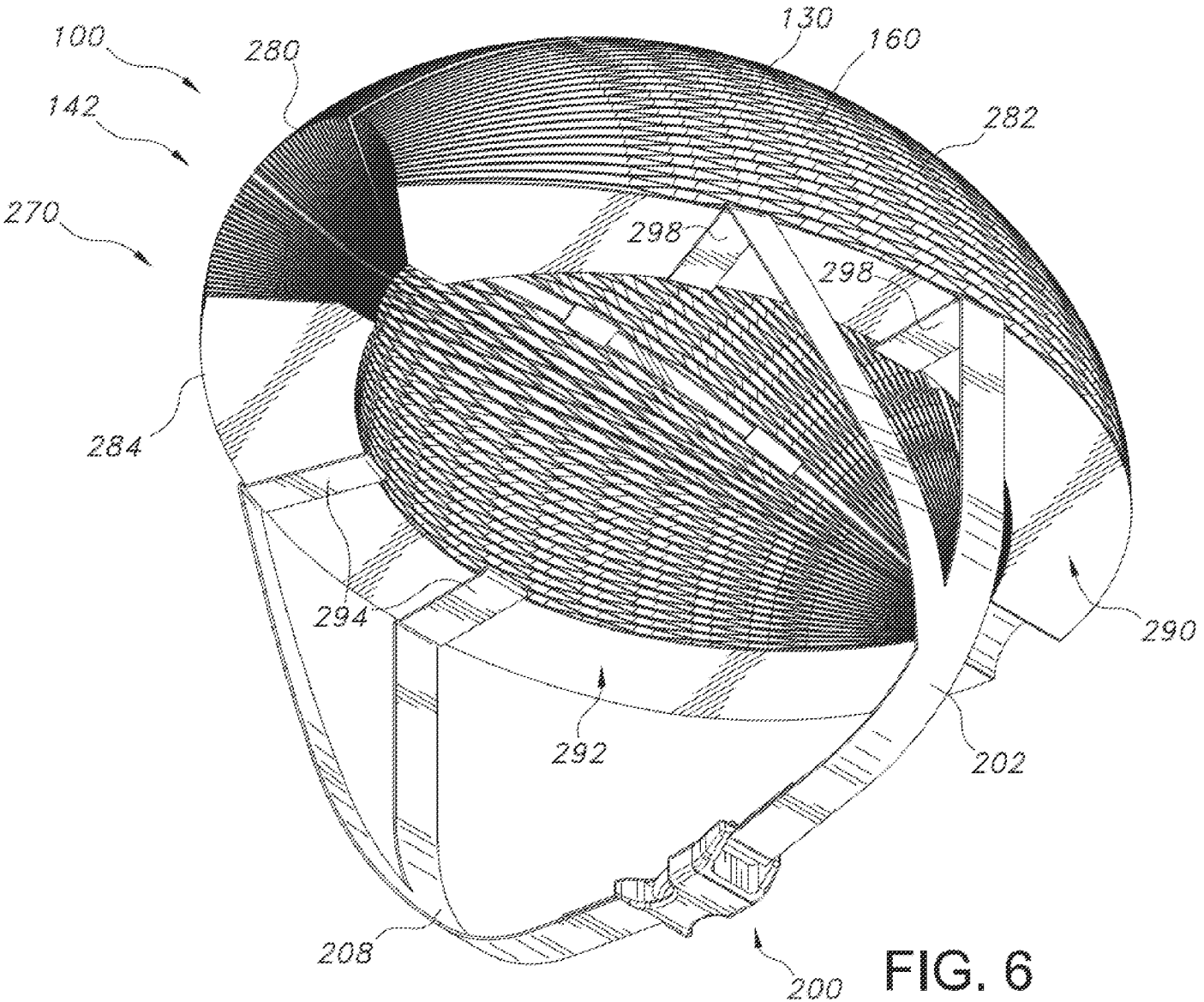
FIG. 6 is a bottom perspective view of the bicycle helmet of FIG. 5.
Figure 7:
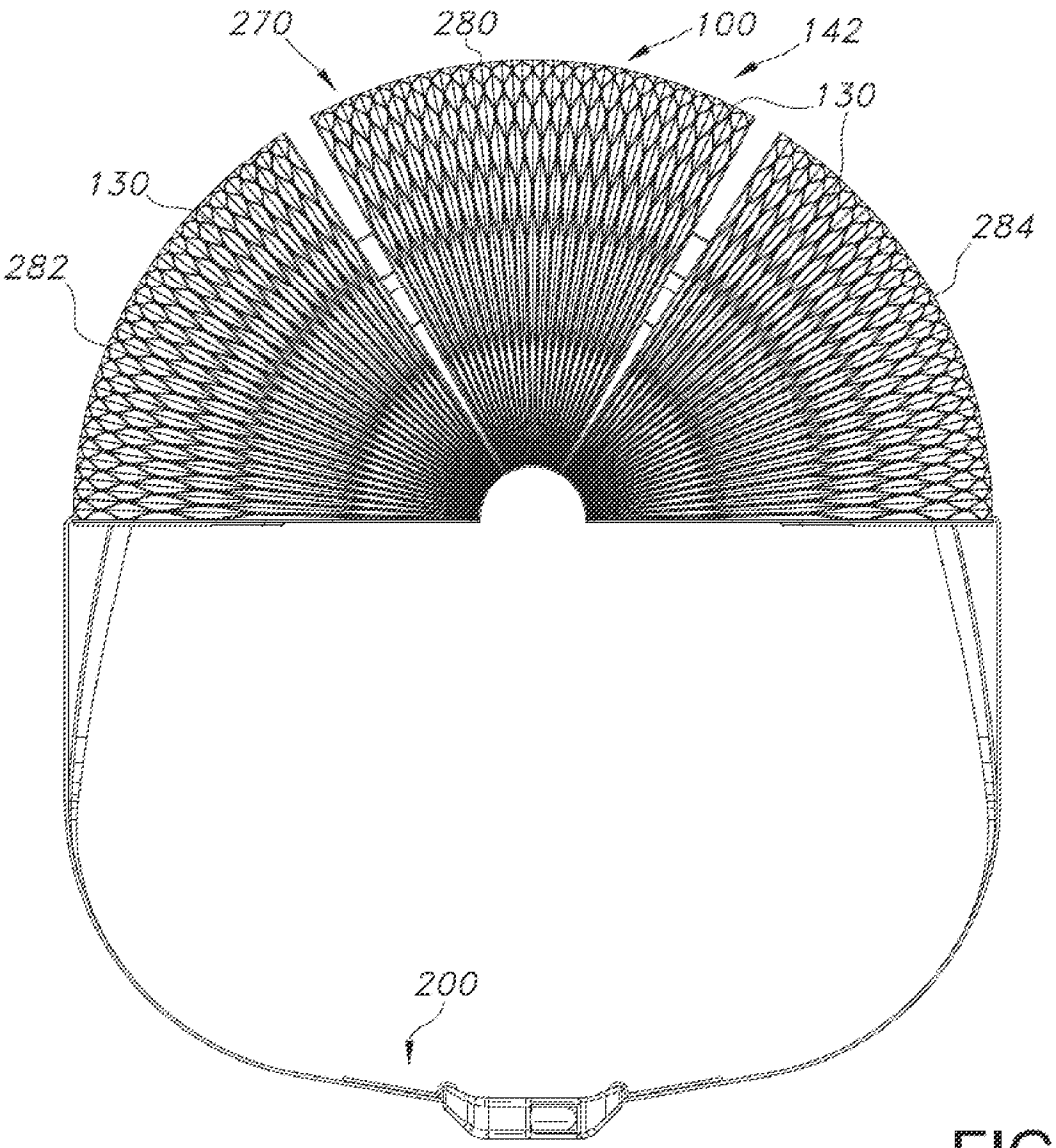
FIG. 7 is a front view of the bicycle helmet of FIG. 5.
Figure 8:
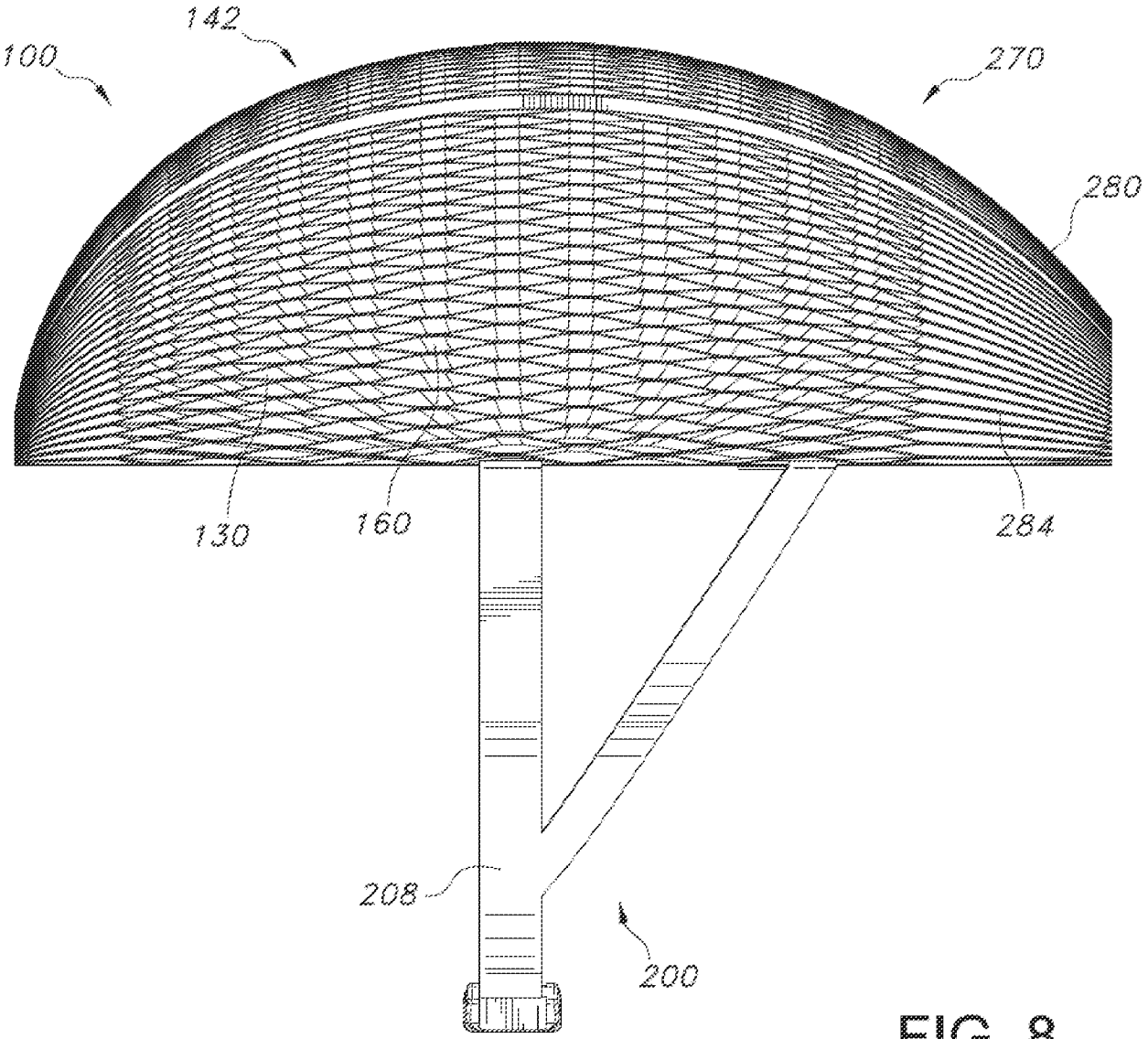
FIG. 8 is a right side view of the bicycle helmet of FIG. 5.
Figure 9:
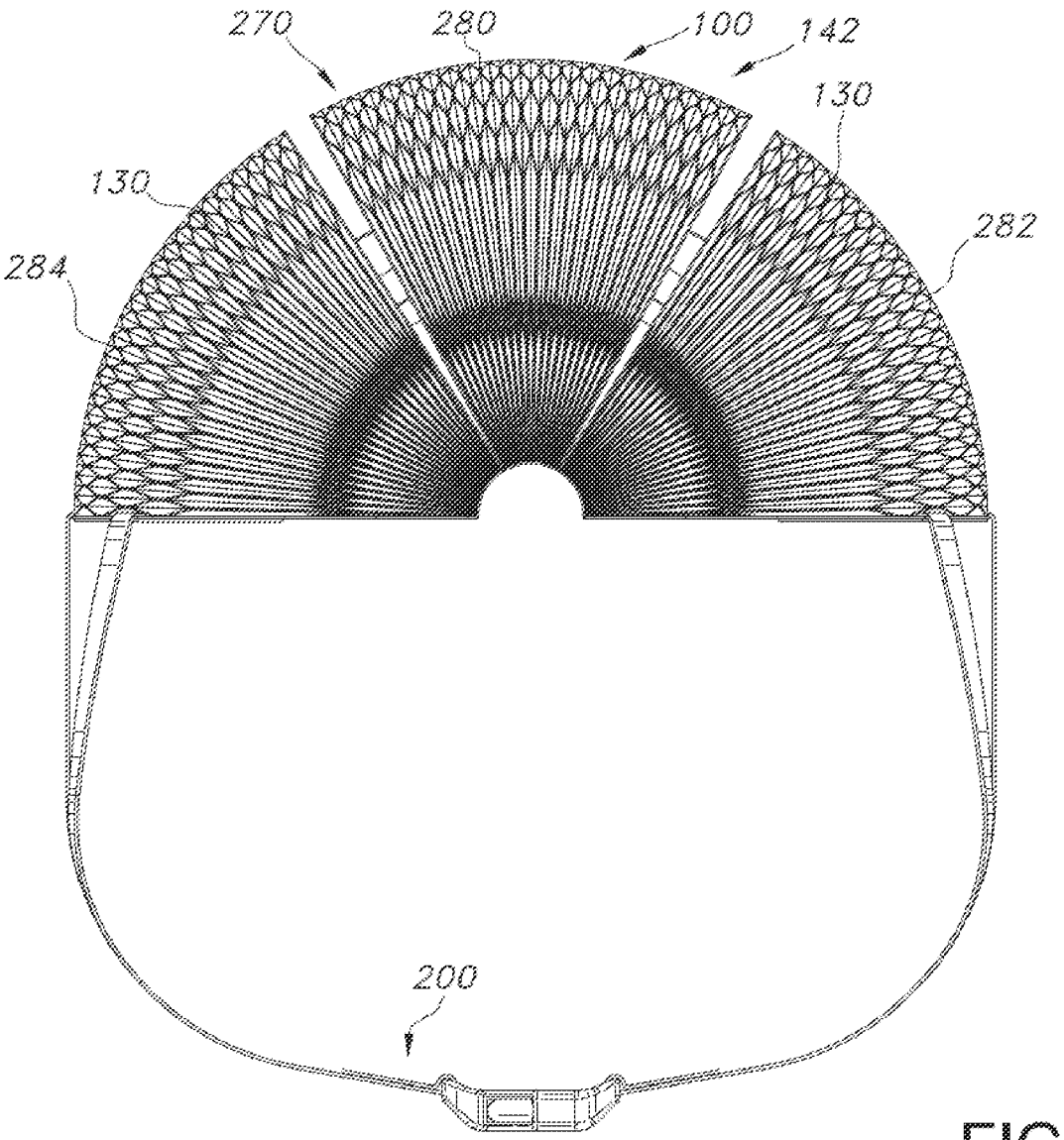
FIG. 9 is a rear view of the bicycle helmet of FIG. 5.
Figure 16:
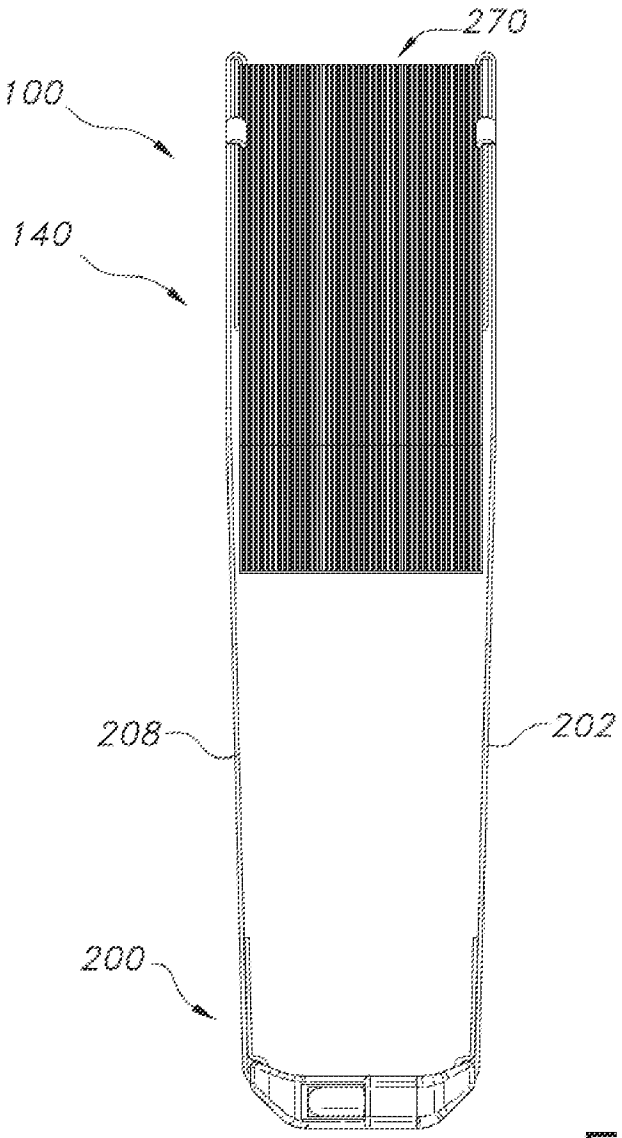
FIG. 16 is a rear view of the bicycle helmet of FIG. 13.
Figure 15:
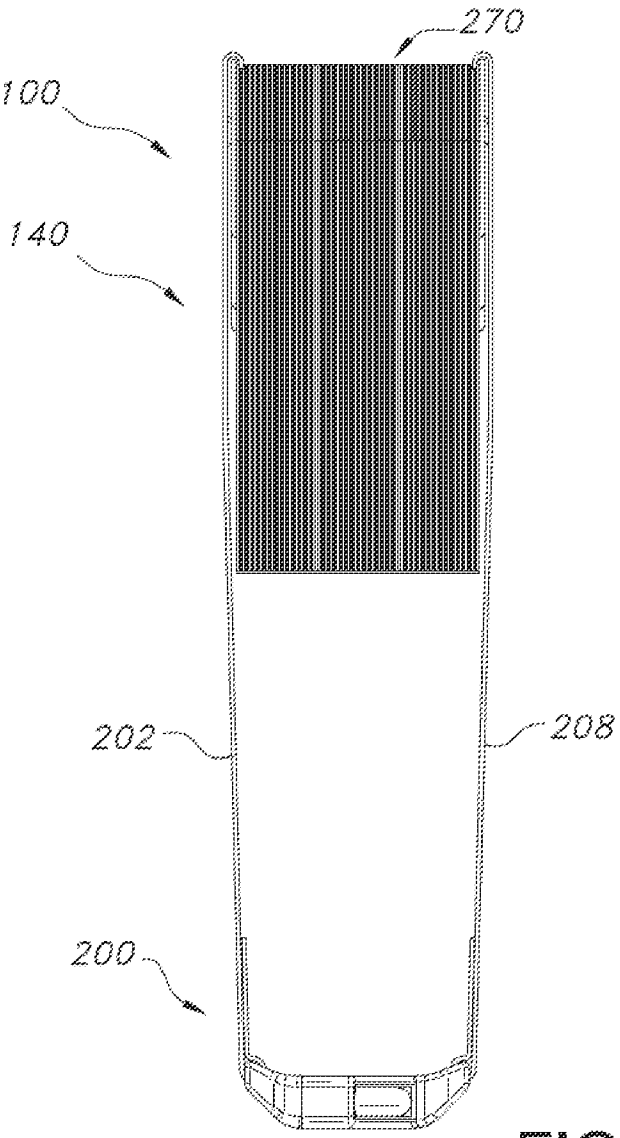
FIG. 15 is a front view of the bicycle helmet of FIG. 13.
Figure 17:
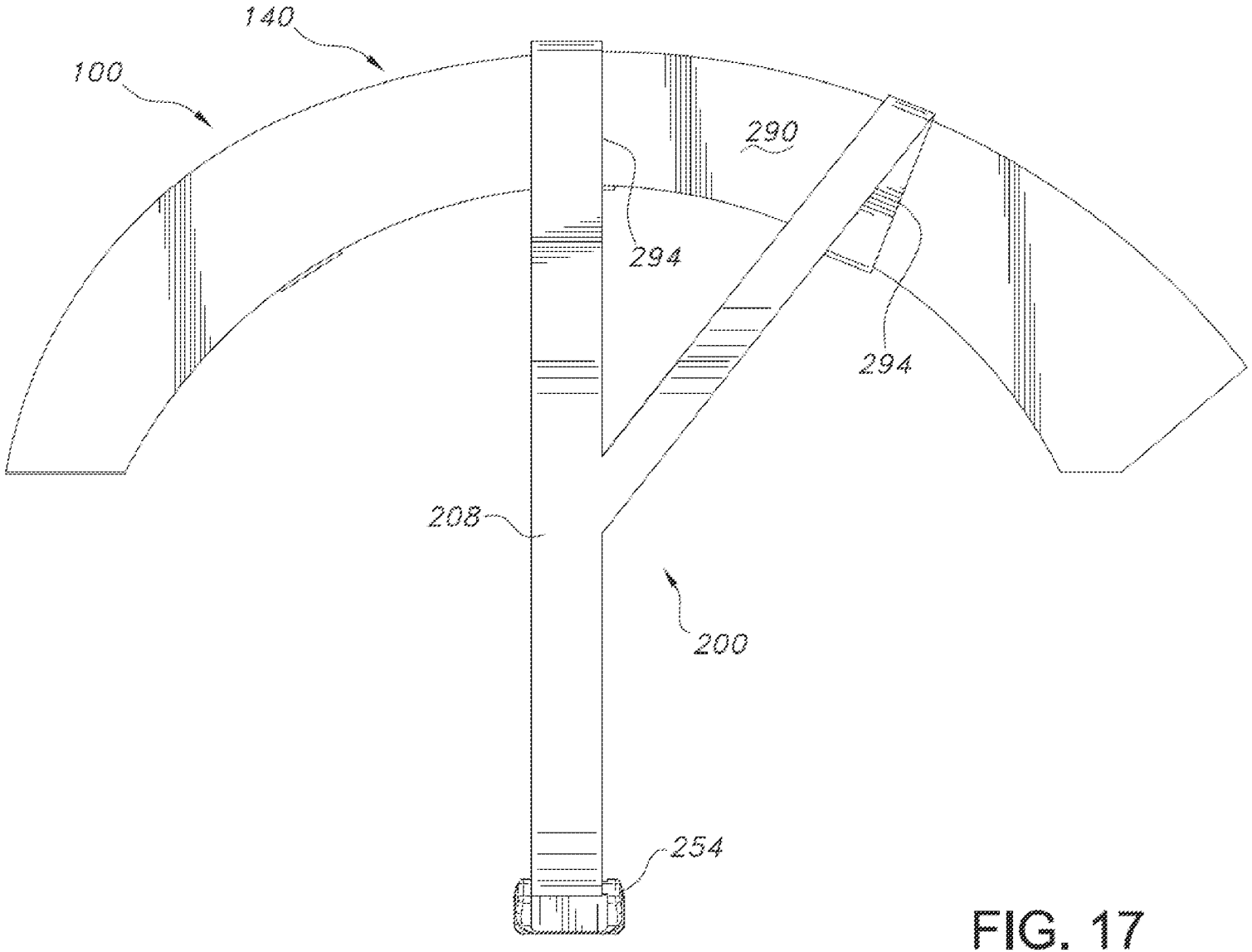
FIG. 17 is a right side view of the bicycle helmet of FIG. 13.
Figure 18:
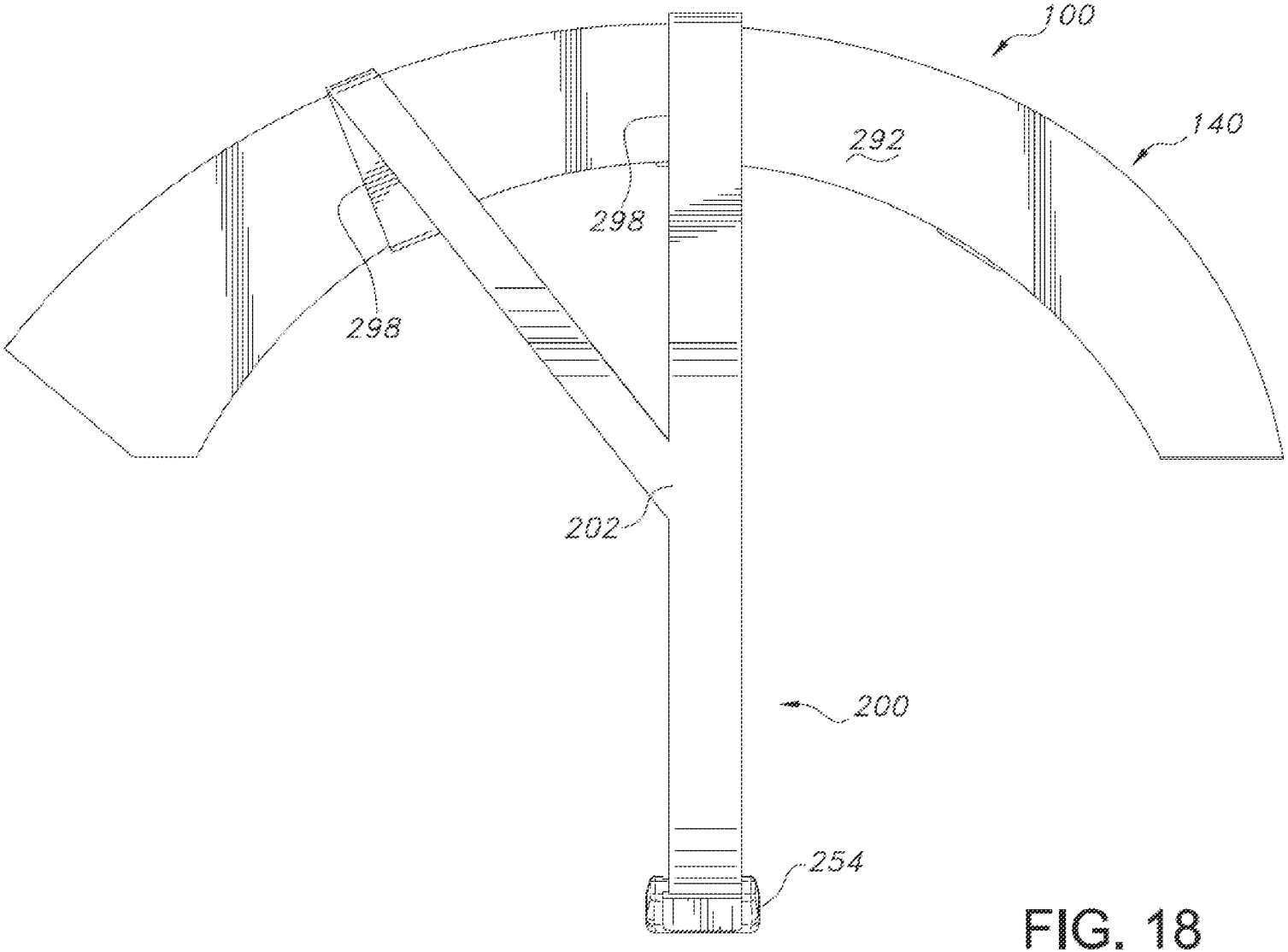
FIG. 18 is a left side view of the bicycle helmet of FIG. 13.
Figure 19:
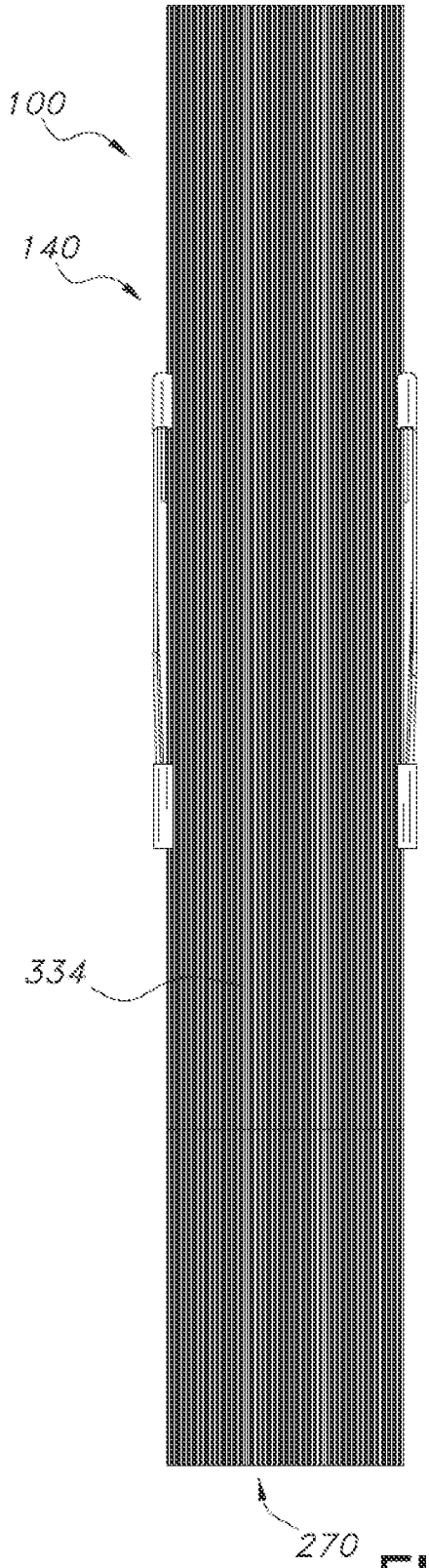
FIG. 19 is a top view of the bicycle helmet of FIG. 13.
Figure 20:
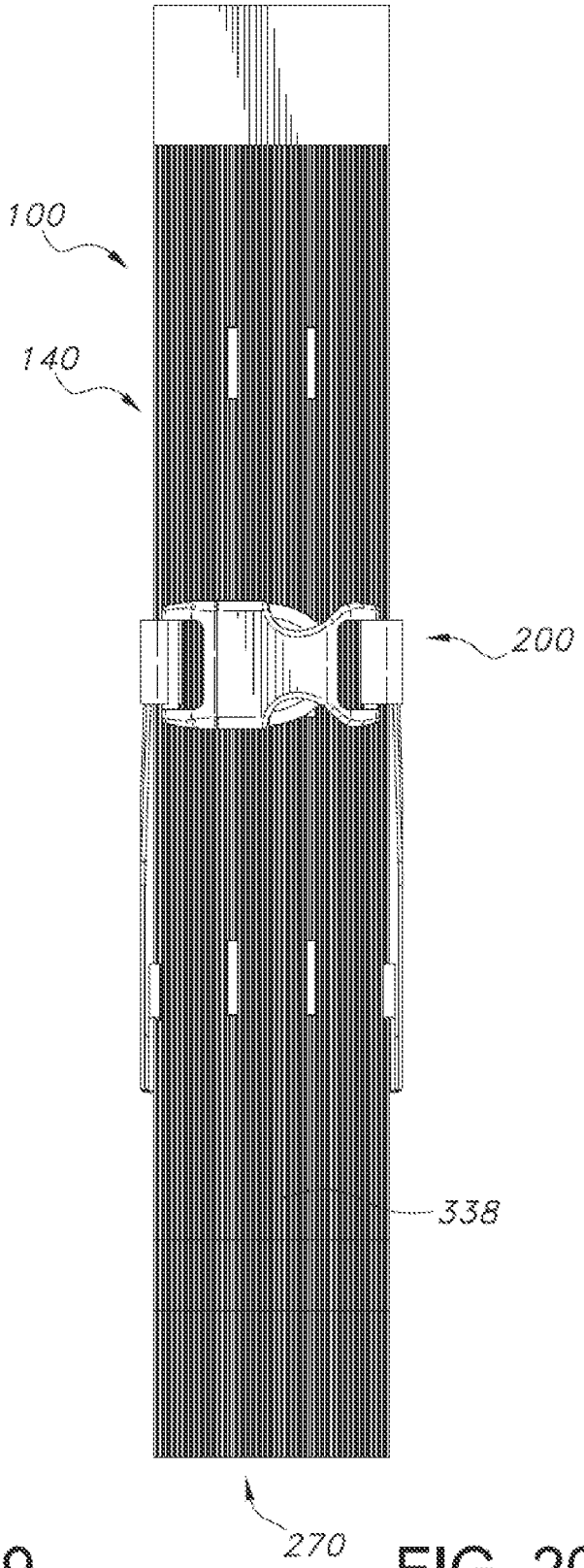
FIG. 20 is a bottom view of the bicycle helmet of FIG. 13.
Figure 21:
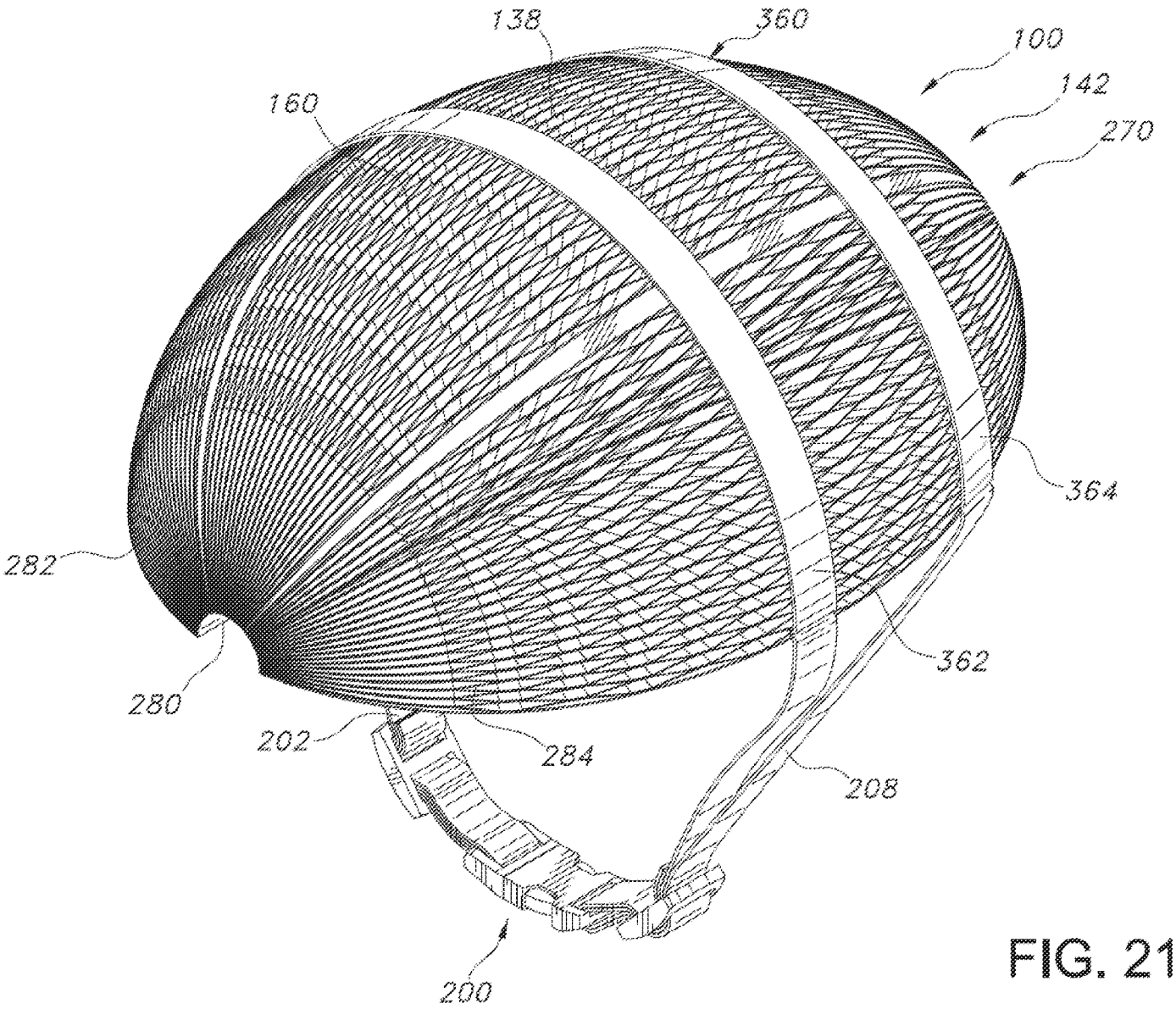
FIG. 21 is a top perspective view of a bicycle helmet with straps over the bicycle helmet opened in an operational or expanded condition in accordance with the present disclosure.
Figure 22:
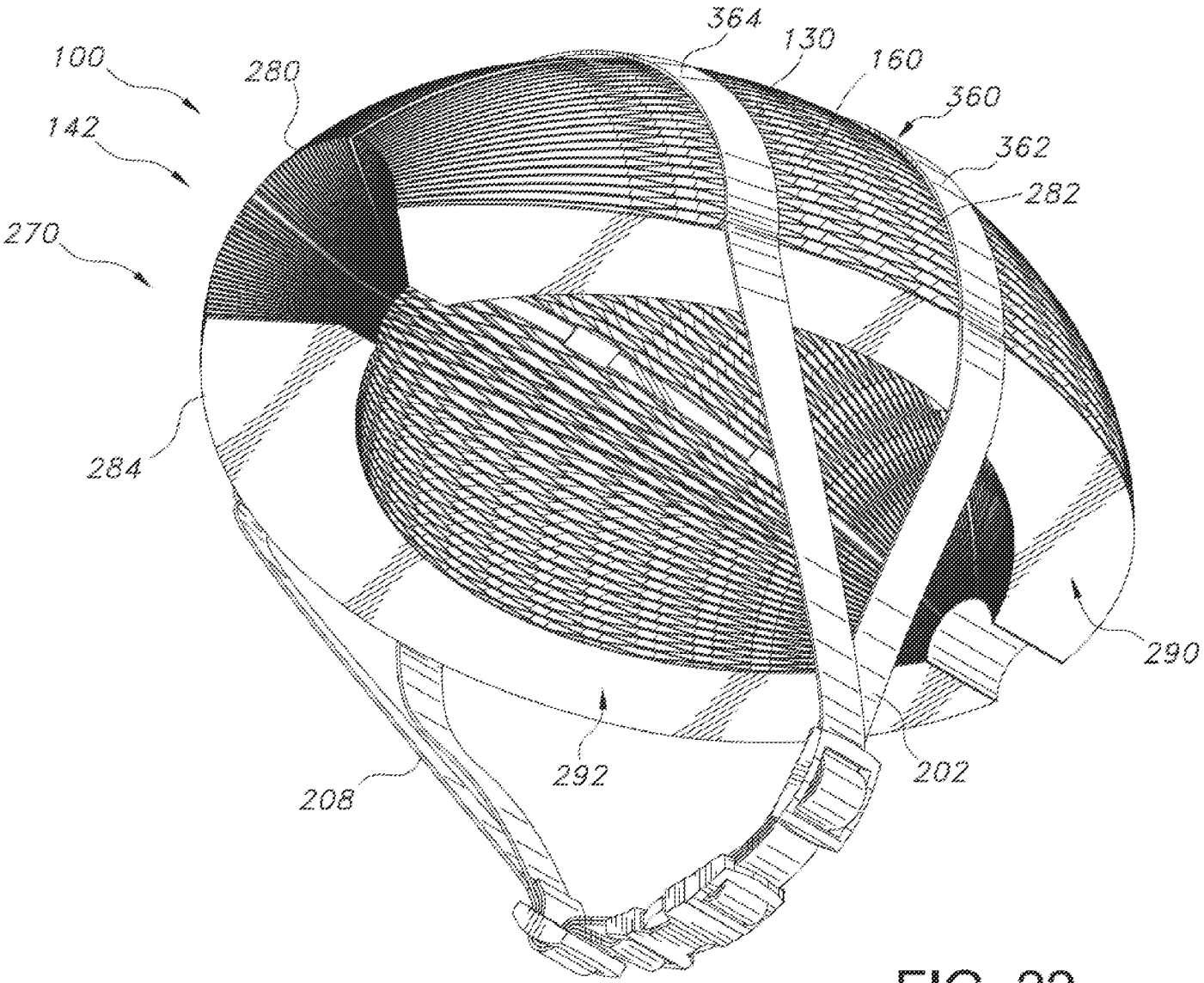
FIG. 22 is a bottom perspective view of the bicycle helmet of FIG. 21.
Figure 23:
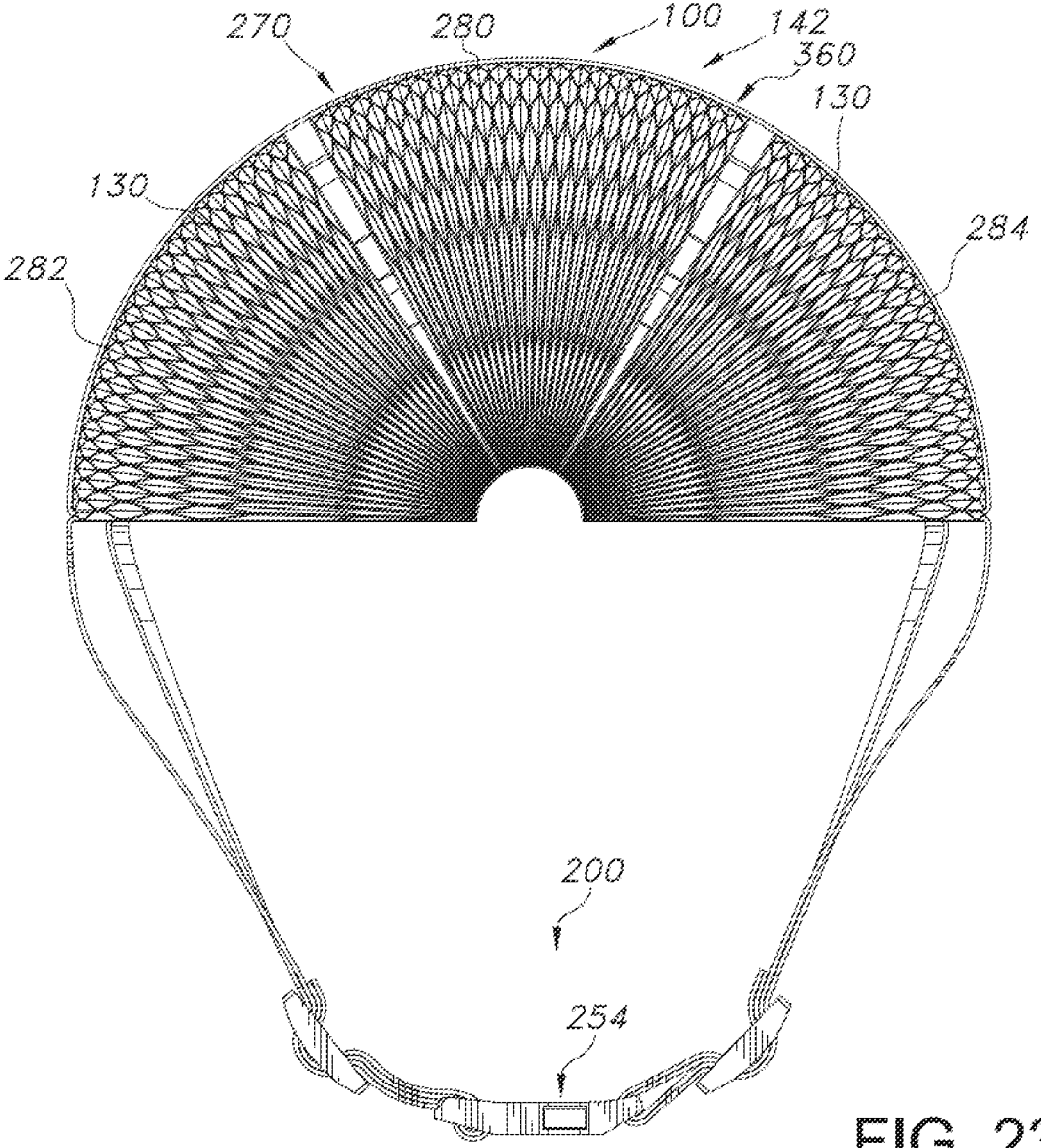
FIG. 23 is a front view of the bicycle helmet of FIG. 21.
Figure 24:
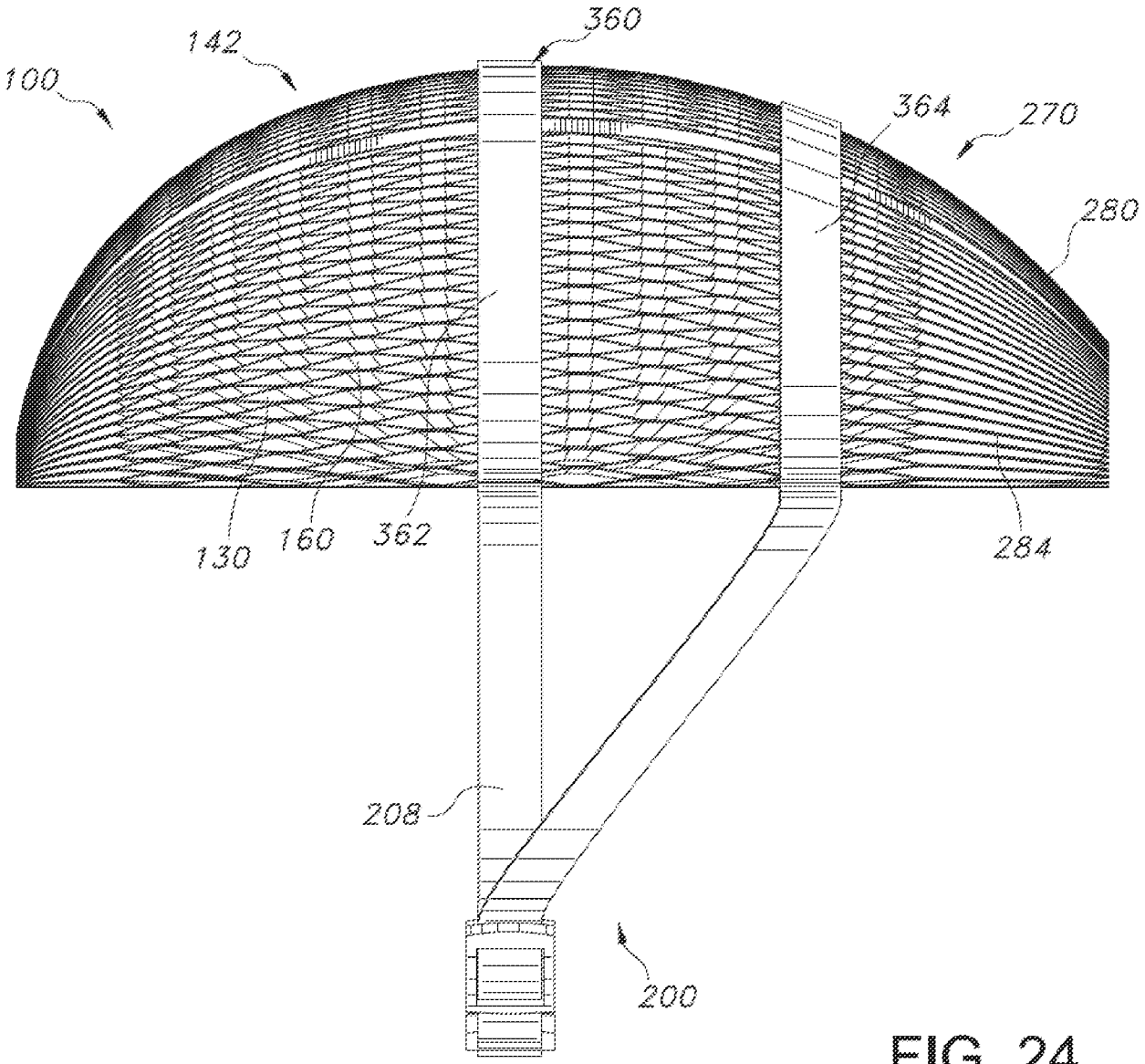
FIG. 24 is a right side view of the bicycle helmet of FIG. 21.
Figure 25:
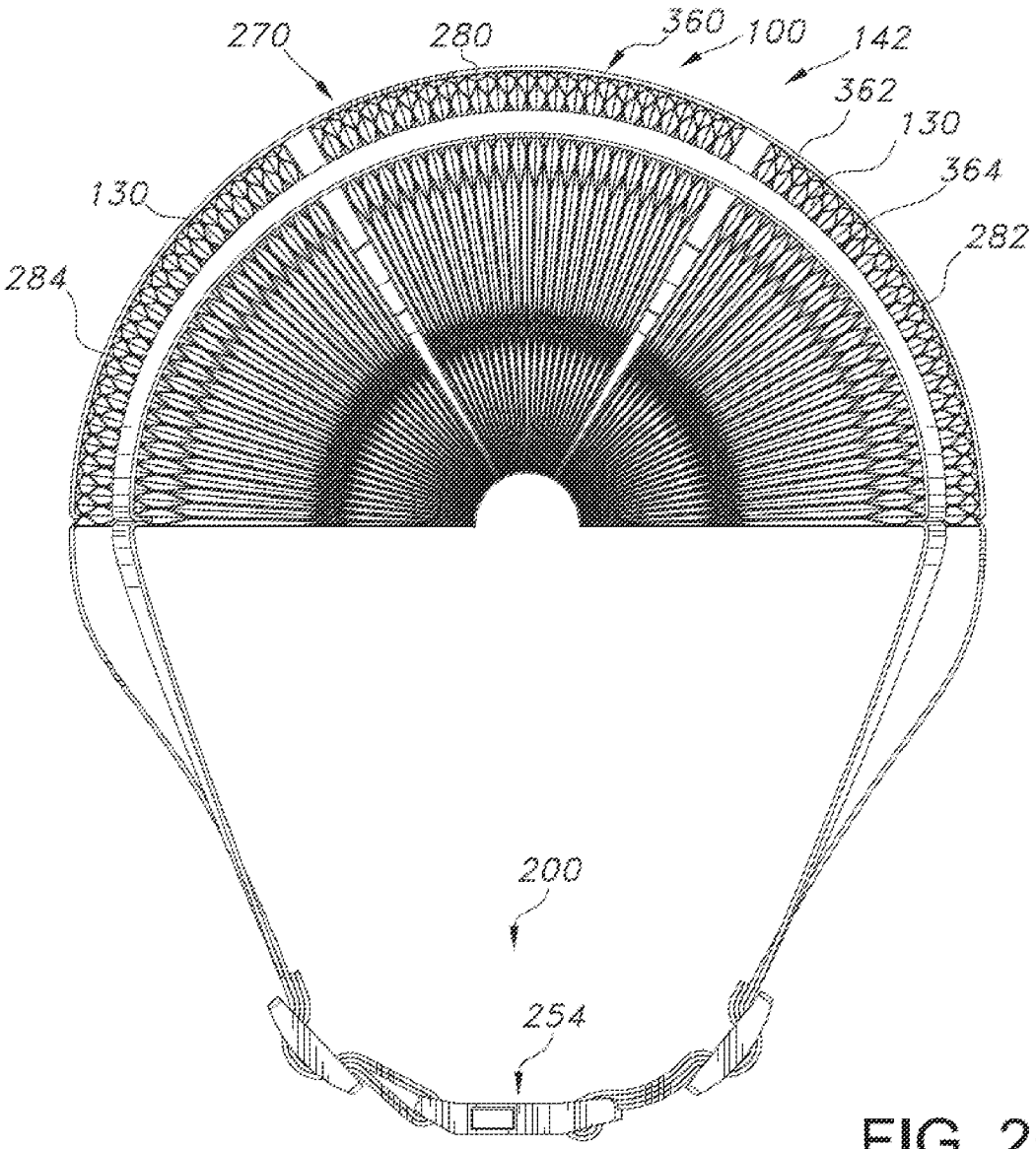
FIG. 25 is a rear view of the bicycle helmet of FIG. 21.
Figure 26:
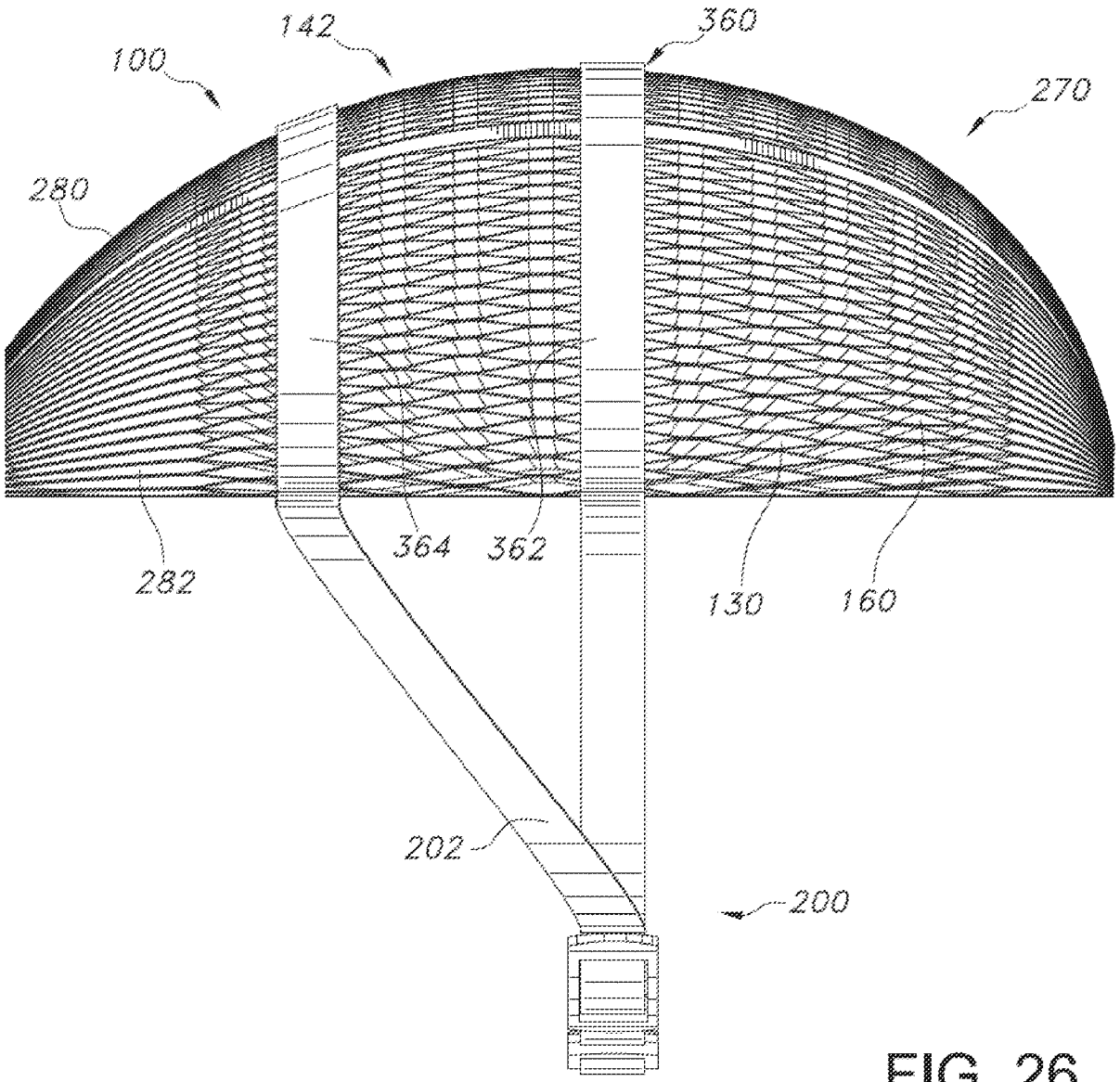
FIG. 26 is a left side view of the bicycle helmet of FIG. 21.
Figure 27:
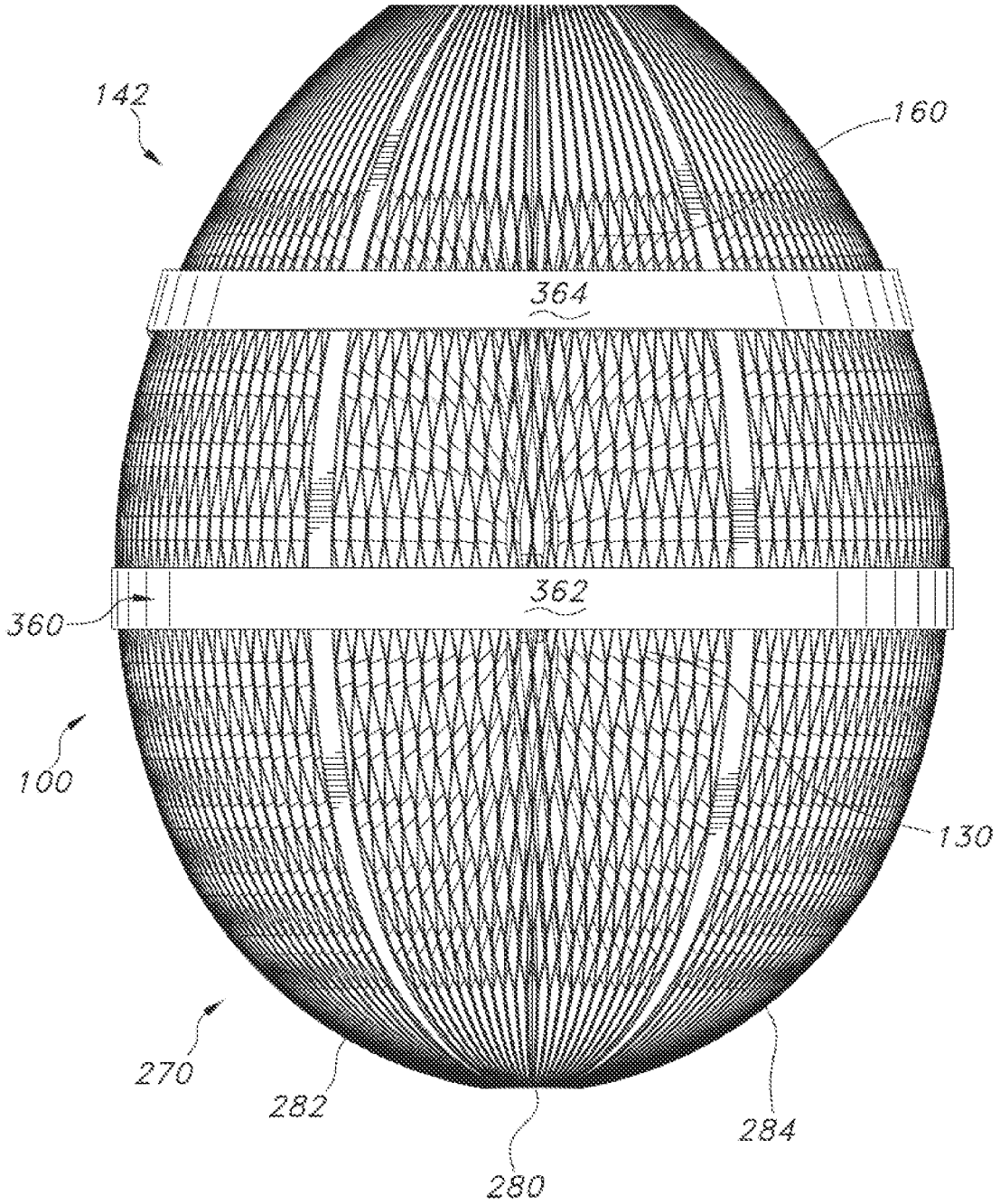
FIG. 27 is a top view of the bicycle helmet of FIG. 21.
Figure 28:
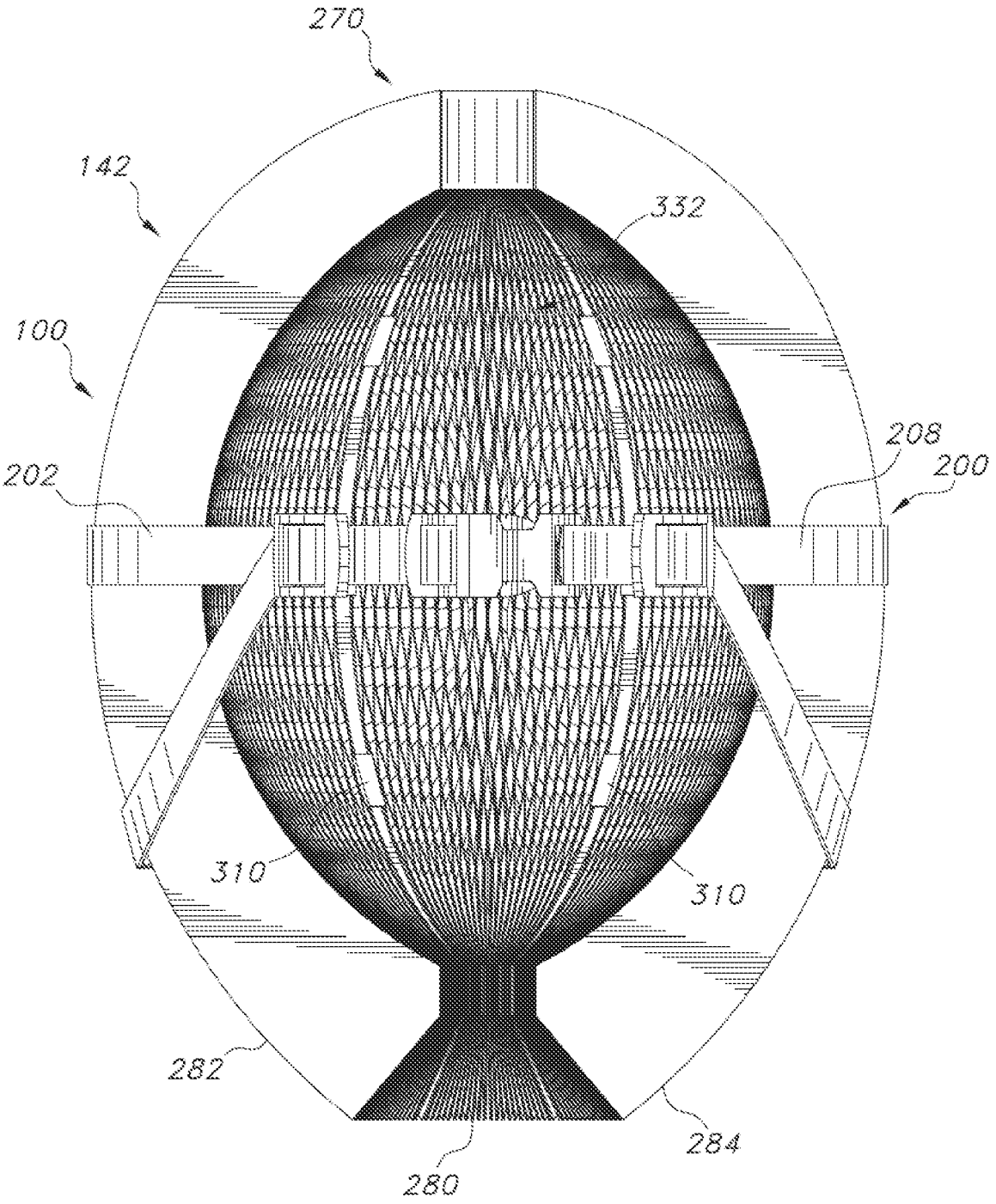
FIG. 28 is a bottom view of the bicycle helmet of FIG. 21.
Figure 29:
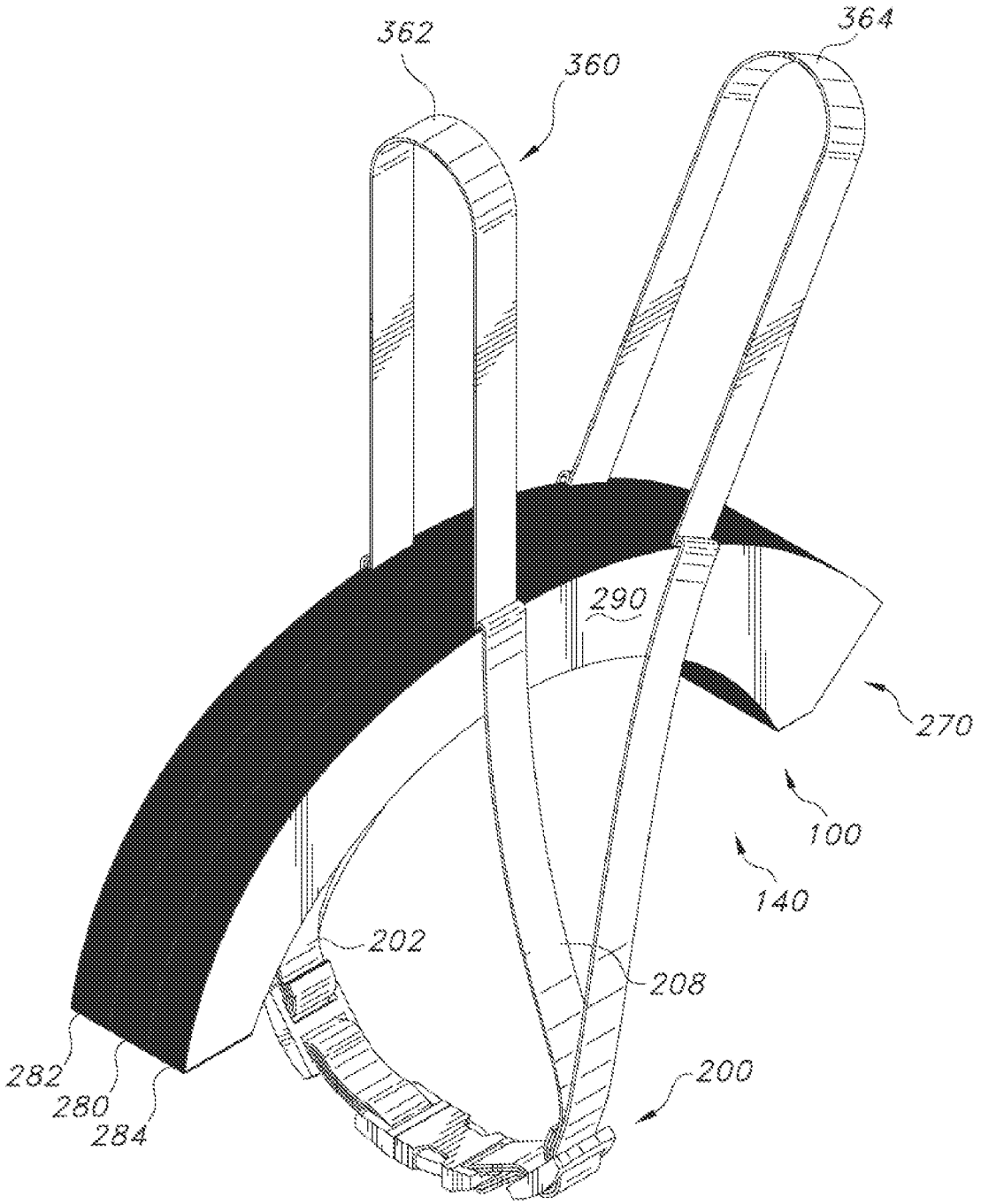
FIG. 29 is a top perspective view of a bicycle helmet with straps over the bicycle helmet in a collapsed or folded condition in accordance with the present disclosure.
Figure 30:
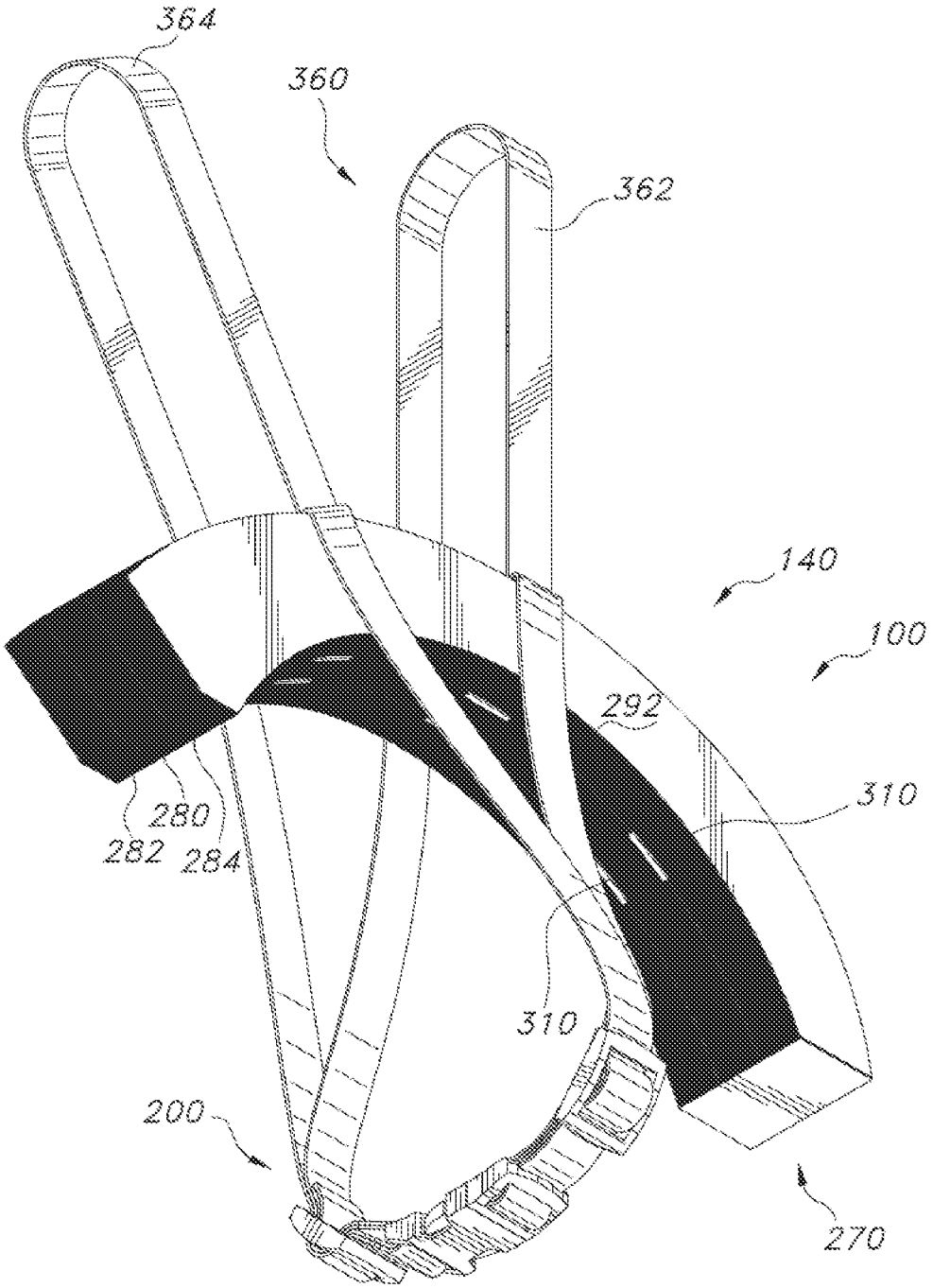
FIG. 30 is a bottom perspective view of the bicycle helmet of FIG. 29.
Figure 31:
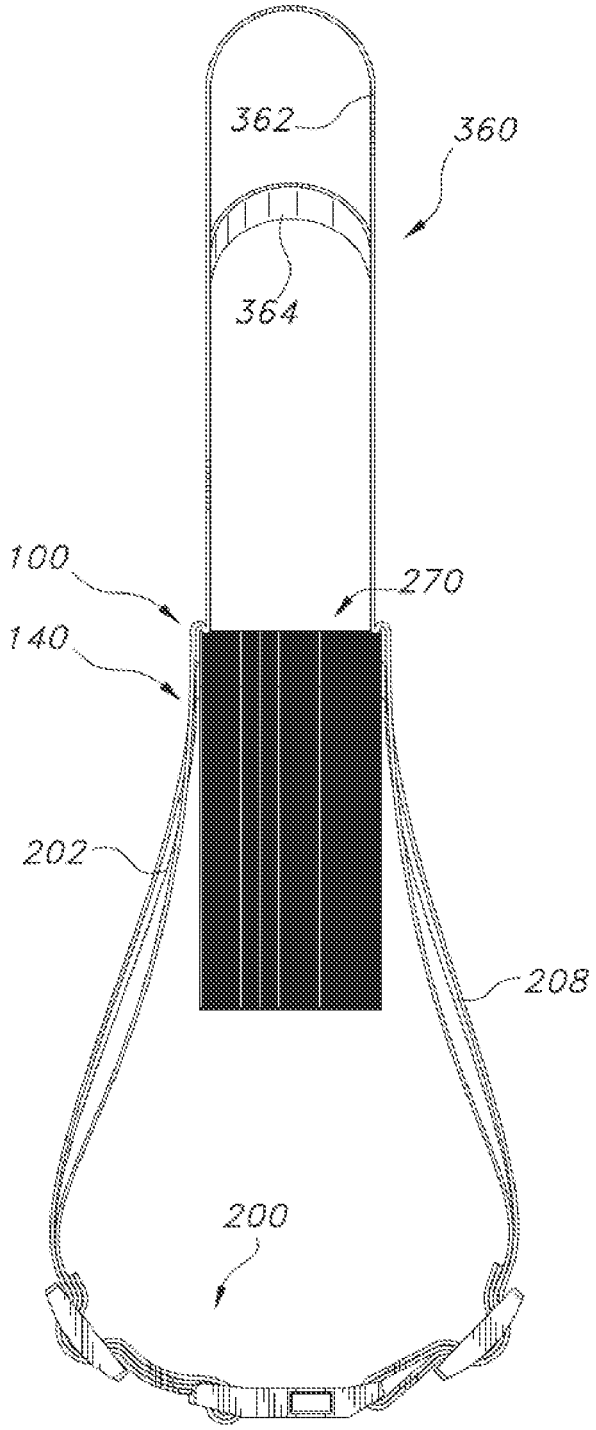
FIG. 31 is a front view of the bicycle helmet of FIG. 29.
Figure 32:
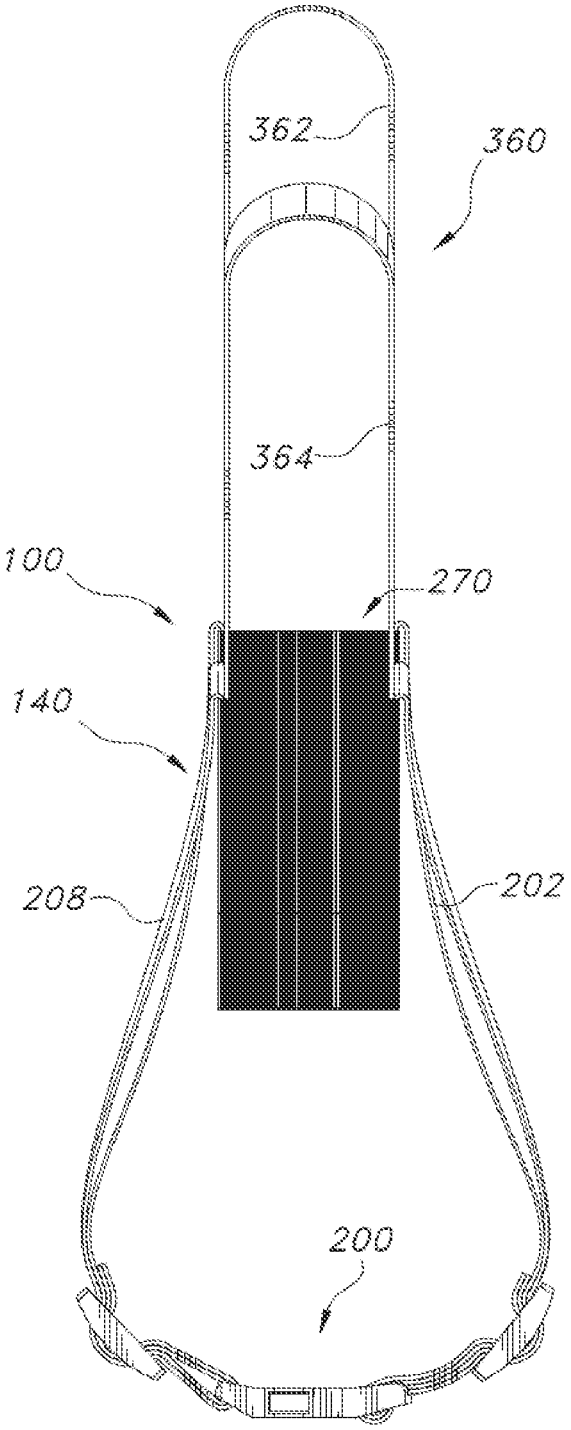
FIG. 32 is a rear view of the bicycle helmet of FIG. 29.
Figure 33:
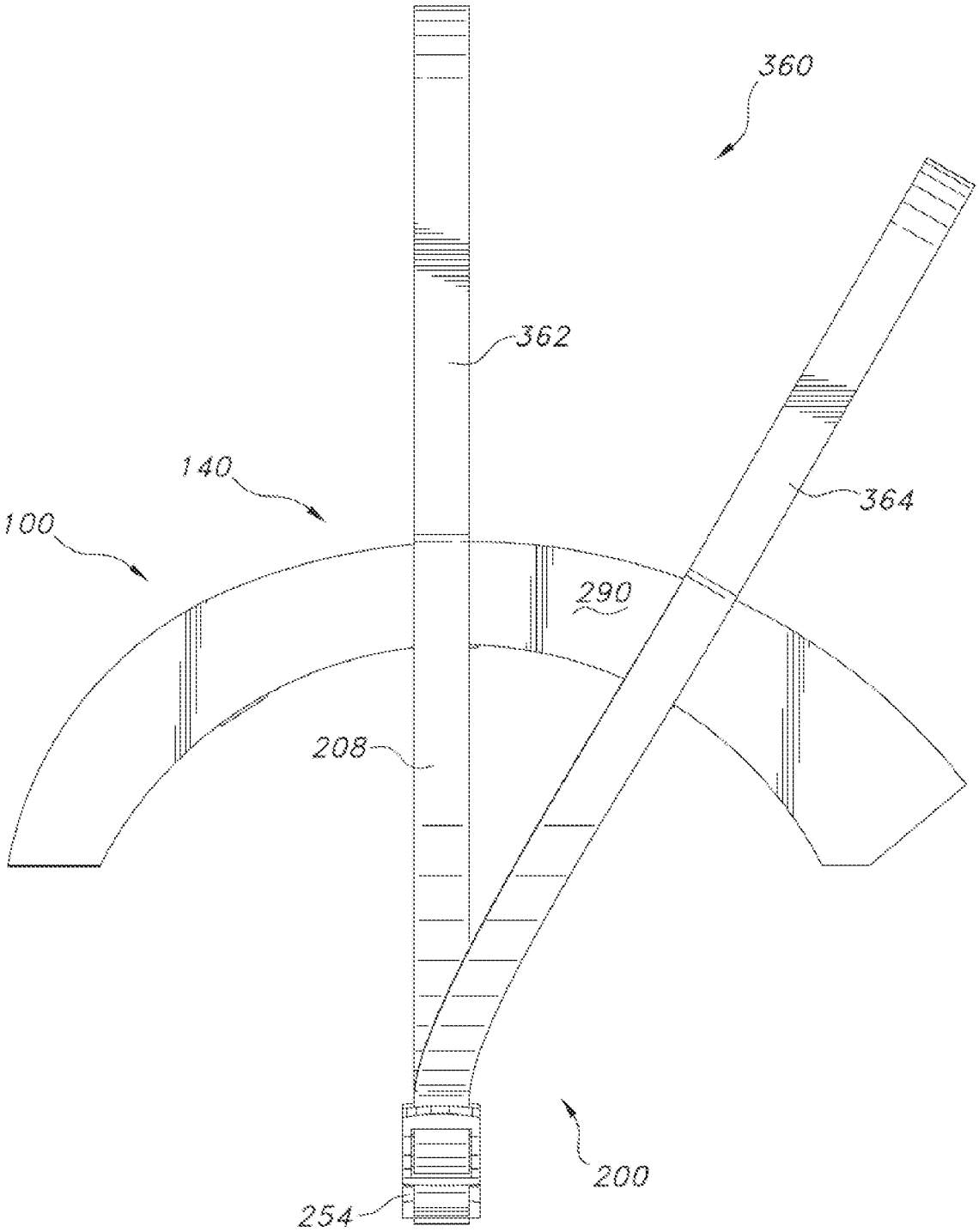
FIG. 33 is a right side view of the bicycle helmet of FIG. 29.
Figure 34:
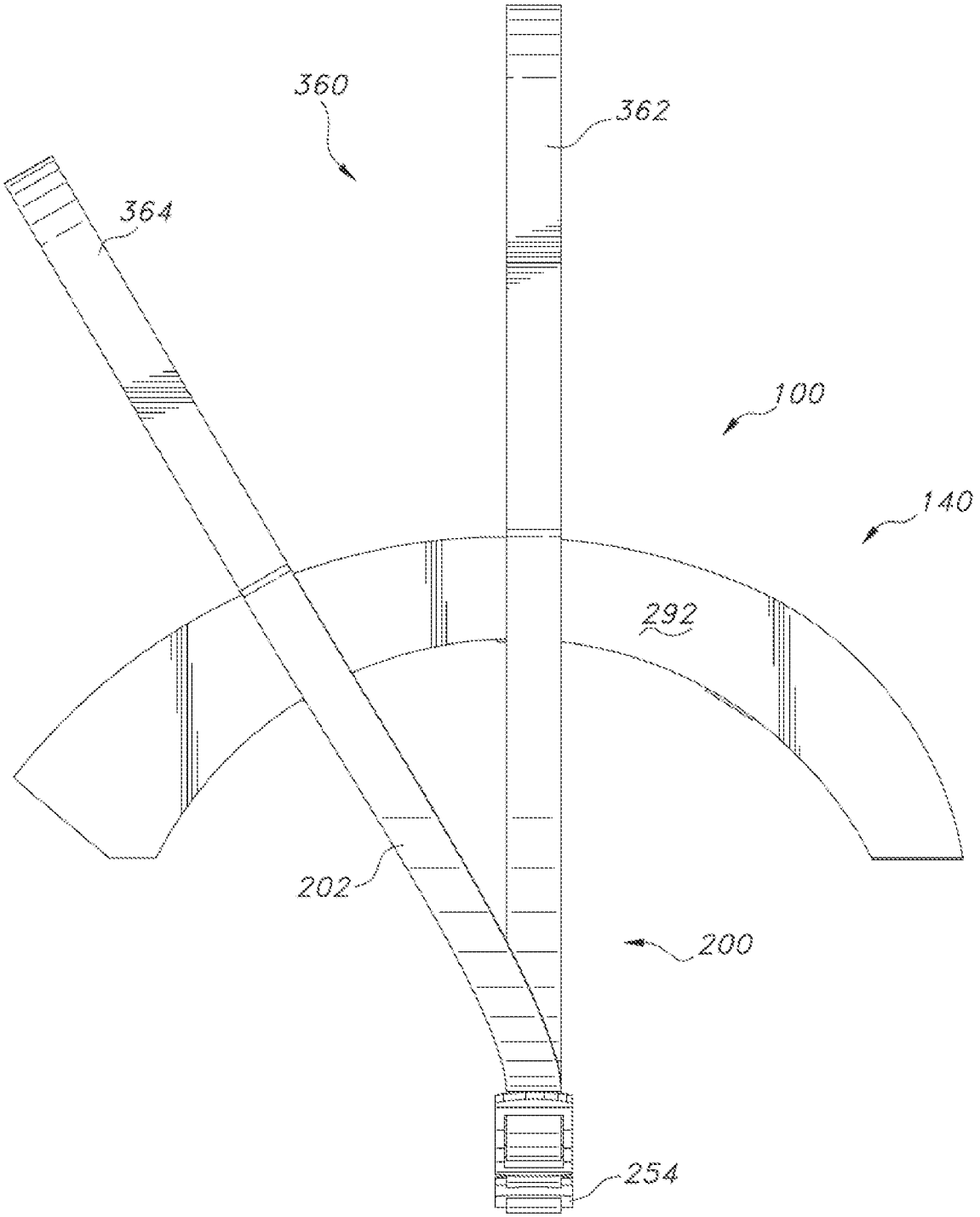
FIG. 34 is a left side view of the bicycle helmet of FIG. 29.
Figure 35:
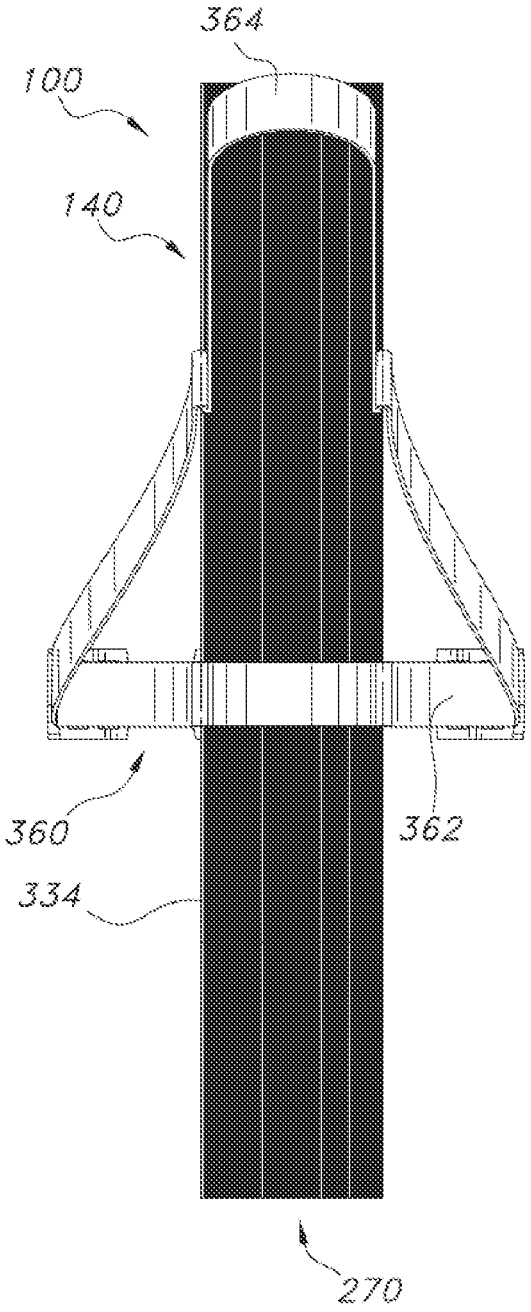
FIG. 35 is a top view of the bicycle helmet of FIG. 29.
Figure 36:
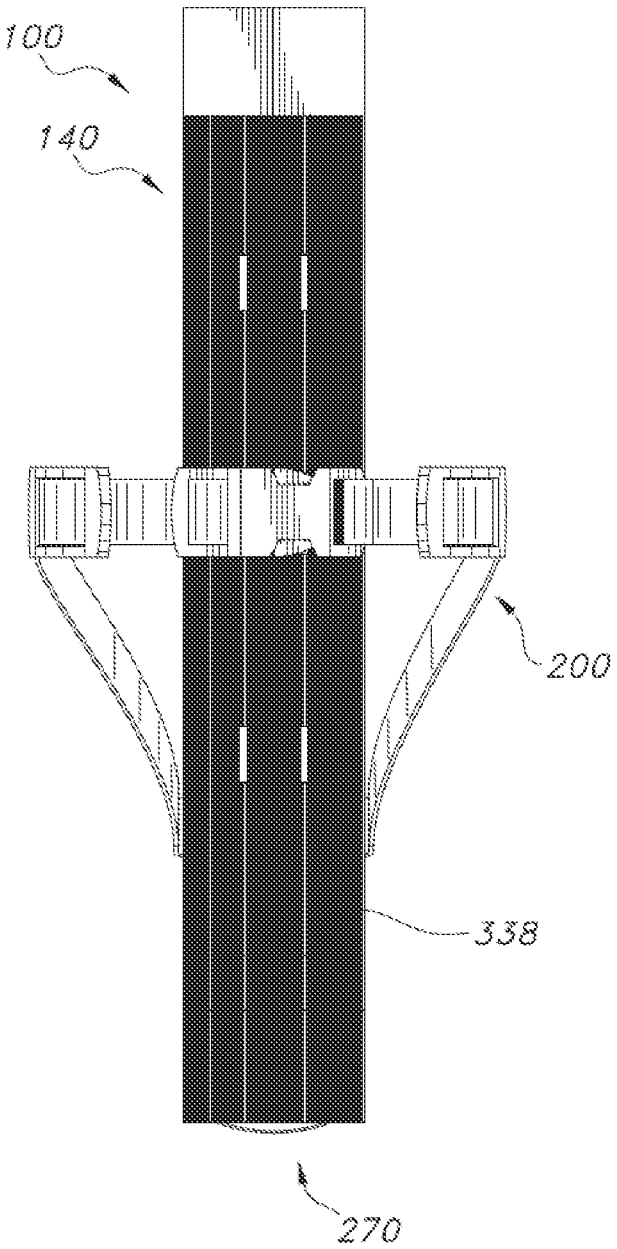
FIG. 36 is a bottom view of the bicycle helmet of FIG. 29.

In embodiments, the segments 270 may be held together by connecting straps 310 as depicted in FIG. 6 and FIG. 16. The connecting straps 310 may collapse or fold and lay flat when the bicycle helmet 100 is deployed in its folded condition 140, as depicted in FIG. 6. The connecting straps 310 may also expand when the bicycle helmet 100 is deployed in its expanded condition 142. In embodiments, the connecting straps 310 may also be deployed as spacers or bumpers that may be slightly flexible or rigid. In embodiments, the connecting straps 310 may be made from a strap material similar to the straps of the chin strap assembly 200. By way of the many examples, the material of the connecting straps 310 may be a paper composite material, polypropylene material, or the like. In the many examples, a portion of the material of the connecting straps 310 may be the same material as a portion of the structural cells 160 of the honeycomb matrix 130.

Figure 49:
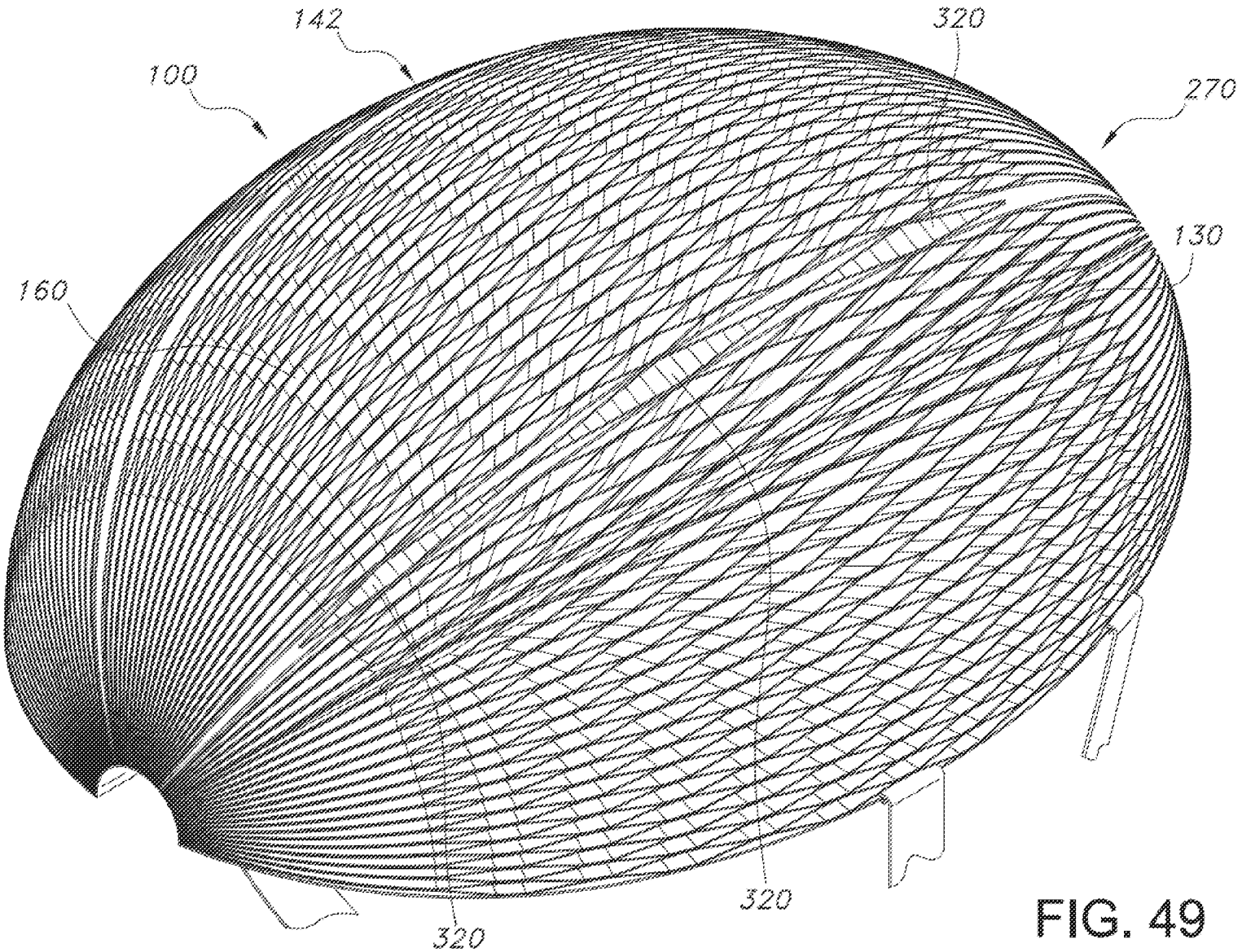
FIG. 49 is a diagrammatic view of embodiments of a bicycle helmet with structures between the segments of the bicycle helmet in accordance with the present disclosure.

As depicted in FIG. 49, the segments 270 of the bicycle helmet 100 may be configured, in embodiments, to be held together by honeycomb blocks 320 that may be made of similar material to the honeycomb matrix 130. In embodiments, the segments 270 of the bicycle helmet 100 may be attached to one another through a front to back strip comprising one or more the honeycomb blocks 320 whose cells may expand wider than the cells structure 160 in the honeycomb matrix 130. The honeycomb blocks 320 may also contribute to the overall structure of the bicycle helmet 100 including impact resistance. The honeycomb blocks 320 may be shown to be more flexible and may allow a portion of the structural cells 160 that may be adjacent the exterior curvature 330 of the bicycle helmet 100 to expand much more than a portion of the structural cells 160 adjacent an inner curvature 332 so that an outer surface 334 of the bicycle helmet 100 may have a larger area than its inner surface 338, which is a surface closest to the head 150 of the user 110 when the bicycle helmet 100 is expanded into its expanded condition 142.

In embodiments, the segments 270 of the bicycle helmet 100 may be sized smaller with using the honeycomb blocks 320 in lieu of the connecting straps 310. By way of these examples, the segments 270 may include fewer cell structures 160 of the honeycomb matrix 130 relative to the segments 270 using the honeycomb blocks 320 while spanning substantially the same distance from the front to the back (and side to side) of the bicycle helmet 100. In embodiments, the segments of the bicycle helmet may be configured with five segments each connected to one another using the honeycomb blocks 320. In embodiments, the segments of the bicycle helmet may be configured with five segments each connected to one another using the connecting straps 310.

In embodiments, the cell structures 160 that make up the honeycomb matrix 130 may be configured radially to relative to one another and to align each of the cell structures 160 to be substantially perpendicular to the outer surface 152 of the head 150 of the user 110. In embodiments, the cell structures 160 of the radially-disposed honeycomb matrix 160 of at least one of the segments 270 is configured to be located adjacent to and positioned generally perpendicular to a portion of the surface 152 of the head 150 of the user 110 proximate to that cell in the honeycomb matrix 130. The cell structures 160 from the honeycomb matrix 130 may, therefore, be shown to provide protection against a blow to the head 150 of the user 110 from any almost any angle that would be experienced during normal operation of the bicycle 120. Upon receiving a blow, the material of the cell structures 160 from the honeycomb matrix 130 may crumple or crush in the vicinity of the impact and absorb a sufficient amount of the impact of the blow while protecting the user 110.

In embodiments, the bicycle helmet 100 may be shown to withstand many safety tests such as those testing impact, placement, and safety for the user. In embodiments, the bicycle helmet may be impacted with an impactor to confirm its impact resistance. In embodiments, the impactor is a spherical impactor that may be larger than 146 mm (5.75 inches) in diameter. In embodiments, the impactor is made of aluminum. In embodiments, the impactor may be dropped at a velocity that is in excess of five meters per second. In one example, the velocity is 5.44 m/s. In embodiments, the impactor may be a flat anvil. In embodiments, the impactor may be a hemispherical anvil. In embodiments, the impactor may be a curbstone anvil. In embodiments, the bicycle helmet may be dropped at a velocity that is in excess of four meters per second. In one example, the velocity is 6.2 m/s. In one example, the velocity is 4.8 m/s When not being worn by a user, the bicycle helmet 100 may be deployed in the folded condition 140. The bicycle helmet 100 deployed in the folded condition 140 may facilitate storage of the bicycle helmet 100 because it may lay flat and be compressed and, therefore, may take up less space than a typical hard-shell bicycle helmet. In embodiments, the bicycle helmet 100 has many advantages including being lighter and folding more flatly than other available folding helmets. The bicycle helmet 100 may be shown to distribute crush impact more evenly around the head than available polystyrene helmets. Moreover, the construction and materials used to construct the bicycle helmet 100 may allow for a relatively inexpensive production and bill of materials.

In embodiments, the bicycle helmet 100 may be configured with a single segment unfolding from a central point. The honeycomb matrix 130 of the bicycle helmet 100 may include adhesive to hold and fix portions of the honeycomb matrix 130 in place. By way of this example, the cells 204 of the honeycomb matrix 130 may include adhesive strips on the outside that are pressed together to assemble and may flatten laterally in the folded condition 140. In embodiments, the layers of the helmet material 230 of the honeycomb matrix 130 may be glued in an alternating radial fashion or a suitable pattern to create the cell structures 160 that may be disposed in a direction that is perpendicular to the outer surface 152 of the head 150 of the user 110.

In embodiments, the bicycle helmet 100 with at least one segment 270 includes a middle segment 280 of flexible helmet material 230 between two side segments 282, 284 of the flexible helmet material 230. The middle segment 280 and the side segments 282, 284 may each be movable from the folded condition 140 where each side of the side segments 282, 284 are disposed generally parallel and an expanded condition 142 where the middle segment 280 and the side segments 282, 284 may be expanded and in cooperation are at least partially disposed over the head 150 of the user 110.

In embodiments, the bicycle helmet 100 with the honeycomb matrix 130 may be formed of radially-aligned structural cells 160 that are disposed generally perpendicular to portions the outer surface 152 of the head 150 of the user 110 that are proximate to each of the structural cells 160. The combination of the exterior and interior curvatures 330, 332, the radially-aligned structural cells 160, and the narrowing and eventual termination of each of the rows of the cells 160 in the honeycomb matrix 130 at the front and at the rear of the bicycle helmet 100 may be shown to cause the cells 160 to arrange themselves automatically to be perpendicular to the outer surface 152 of the head 150 of the user 110 when the bicycle helmet 100 is placed in the expanded condition 142, or at least when the bicycle helmet is expanded at least to 85% of its expanded condition 142.

In embodiments, the honeycomb matrix 130 may be composed of several interconnected panels 350 that may be aligned front-to-back of the bicycle helmet 100. In embodiments, one or more of the panels 350 may extend over the entire front-to-back length of the bicycle helmet 100 and one or more of the panels 350 may extend only over a portion of the front-to-back length of the helmet 100. In embodiments, the panels 350 may be interconnected at a plurality of points to form and be integrated with the honeycomb matrix 130. In embodiments, flexing action of the honeycomb matrix 130 during expansion from the folded condition 140 to the expanded condition 142 may permit individual structural cells 160 in the honeycomb matrix 130 to open and arrange themselves in a substantially perpendicular orientation relative to the interior curvature 332 of the bicycle helmet that is configured to accept the outer surface 152 of the head 150 of the user 110.

In embodiments, the bicycle helmet 100 may be disposed in the expanded condition 142 and the expansion into the expanded condition 142 may be limited by at least one strap 360 that may be disposed over the exterior curvature 330 of the bicycle helmet, as shown in FIG. 21 through FIG. 36. In embodiments, the at least one strap 360 includes two straps 362, 364. The two straps 362, 364 may be extended from the two upper chin strap portions 250, 252 of the chin strap assembly 200. In embodiments, the at least one strap 360 may be positioned over the bicycle helmet 100 and be configured to limit an amount of expansion of the honeycomb matrix 130 when moving into the expanded condition 142. In embodiments, the chin strap assembly 200 may be connected to at least one side of the at least one segment 270. A portion of the chin strap assembly 200 may include the at least one strap 360 that may be positioned over the bicycle helmet 100. By way of this example, a portion of the material that forms the chin strap assembly 200 may continue over the helmet 100 and may form a portion of the at least one strap 360. In embodiments, a portion of the chin strap assembly 200 may be made of the same material as the at least one strap 360 positioned over the bicycle helmet 100. In embodiments, a portion of the chin strap assembly 200 and the at least one strap 360 positioned over the bicycle helmet 100 may be a unitary construction.

Figure 37:
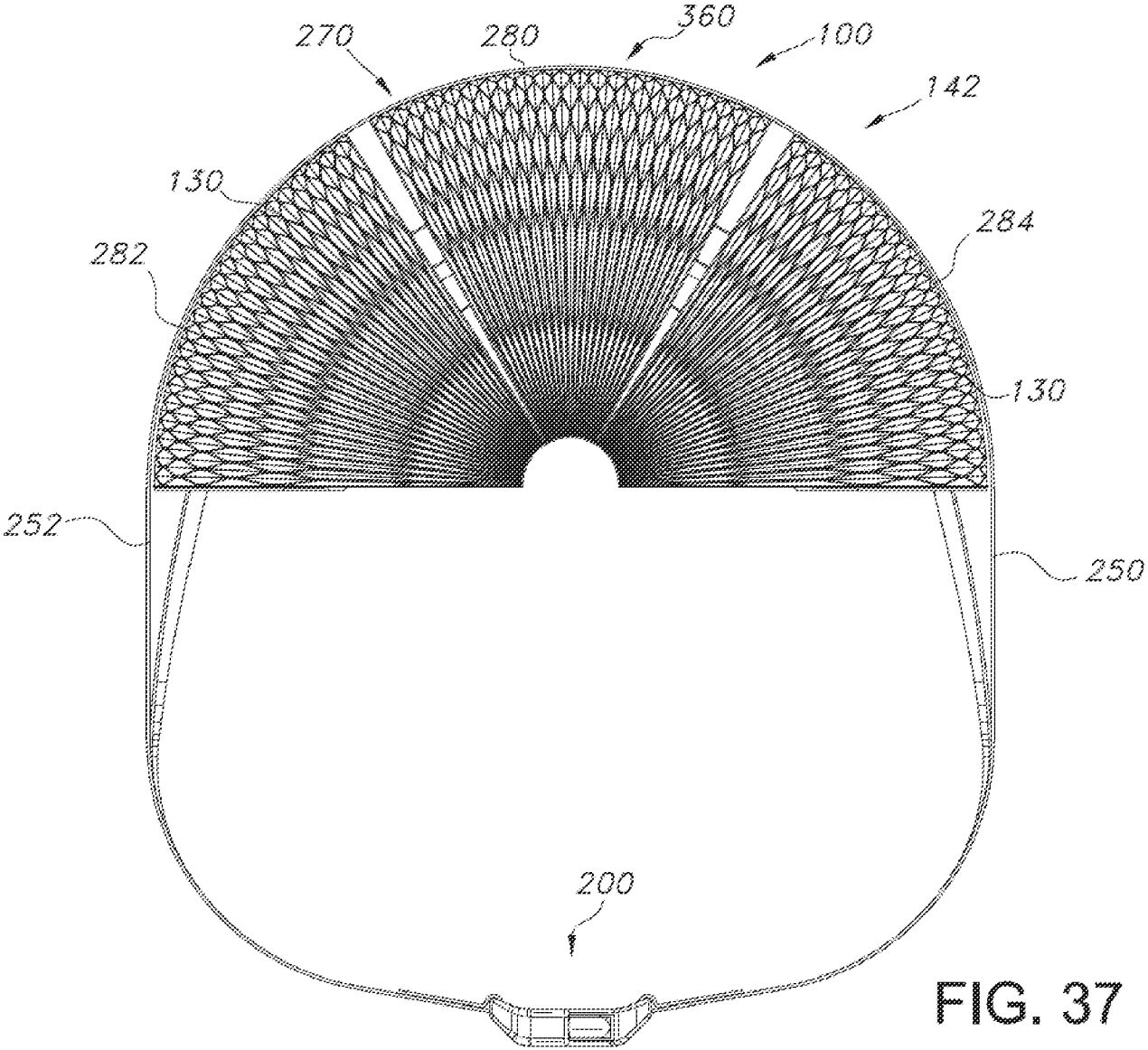
FIG. 37 is a diagrammatic view of embodiments of a bicycle helmet having straps that define a chin strip and continue over the bicycle helmet forming a unitary construction in accordance with the present disclosure.

In embodiments, the at least one strap 360 may continue as a single piece of material from the two upper chin strap portions 250, 252 all the way over to opposite side of the helmet 100 to re-connect with other portions of the chin strap assembly 200, as shown in FIG. 37. In embodiments, the at least one strap 360 may extend over the outer surface 334 of the bicycle helmet 100 and may not interfere with individual structural cells 160 of the honeycomb matrix 130 as the helmet 100 moves to the expanded condition 142, as shown in FIG. 21 through FIG. 36. In embodiments, the at least one strap 360 may extend over the outer surface 334 each of the segments 270 of the bicycle helmet 100 and may not interfere with individual structural cells 160 of the honeycomb matrix 130 as the helmet 100 moves to the expanded condition 142. In embodiments, the at least one strap 360 may extend over the outer surface 334 each of the segments 270, may extend over the entirety of the bicycle helmet 100, and combinations thereof while not interfering with individual structural cells 160 of the honeycomb matrix 130 as the helmet 100 moves to the expanded condition 142. By way of these examples, the at least one strap 360 may gather above bicycle helmet 100 when the bicycle helmet 100 is in its folded condition 140 and then may be positioned on top of the outer surface 334 of the helmet 100 in its expanded condition.

Figure 38:
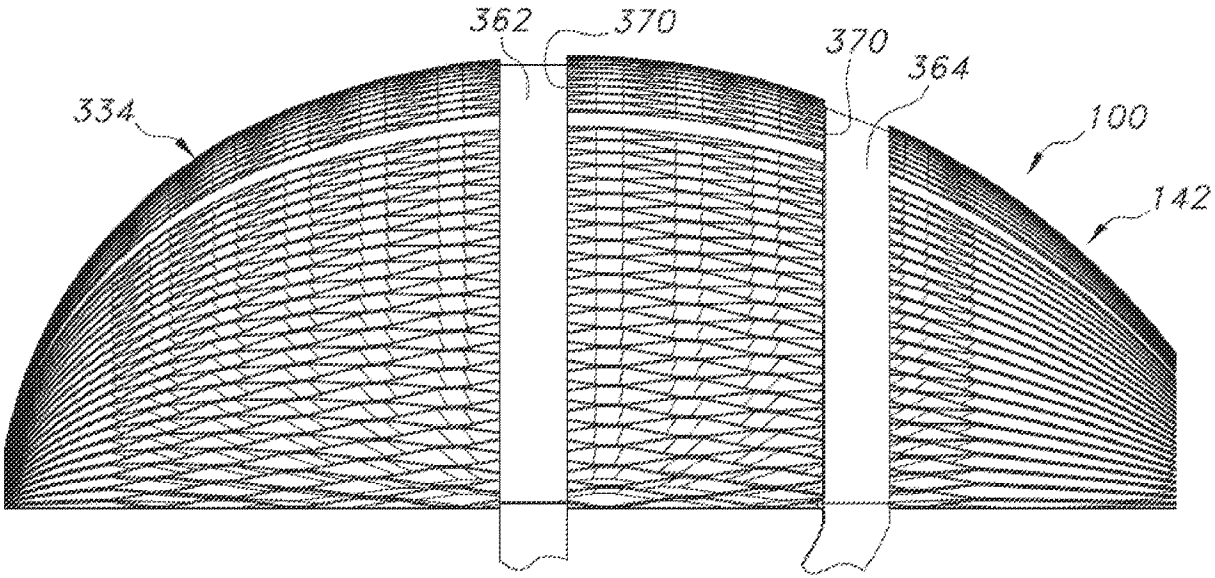
FIG. 38 is a diagrammatic view of embodiments of a bicycle helmet with straps over the helmet in areas recessed into the bicycle helmet in accordance with the present disclosure.
Figure 40:
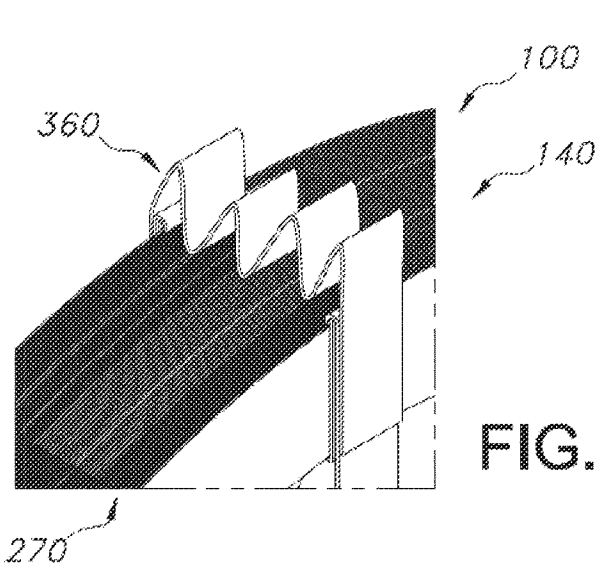
FIGS. 39 and 40 are diagrammatic views embodiments of bicycle helmets in a collapsed or folded condition in accordance with the present disclosure.
Figure 39:
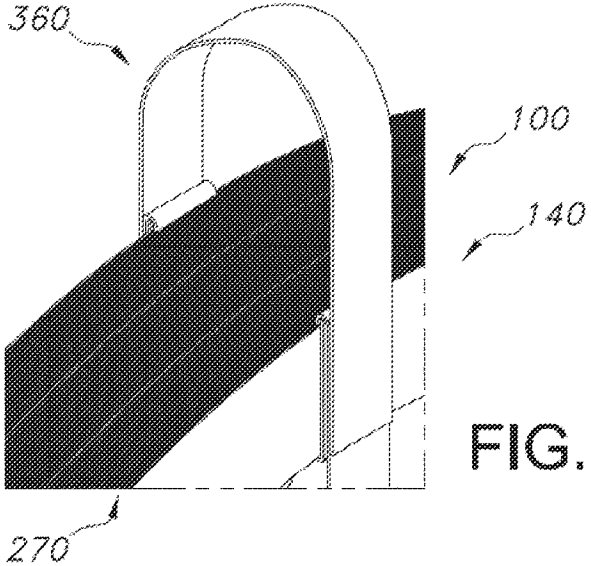
Figure 42:
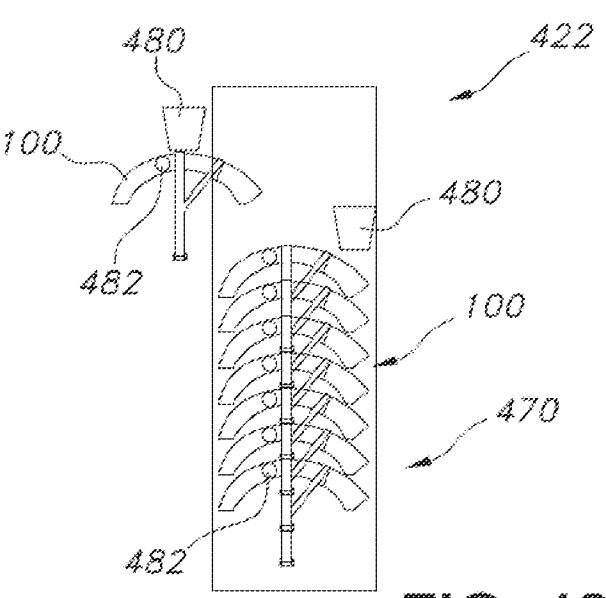
FIGS. 41, 42, and 43 are diagrammatic views of embodiments of bicycle helmets in an ecosystem including vending, tracking, receipt, recycling, use, and the like of the bicycle helmets in accordance with the present disclosure.
Figure 41:
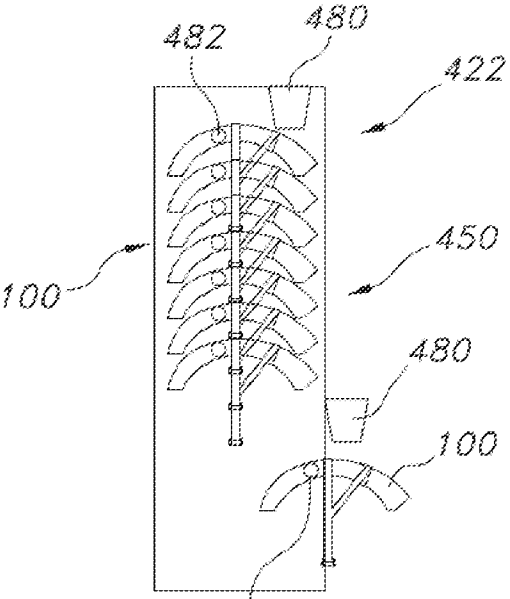
Figure 43:
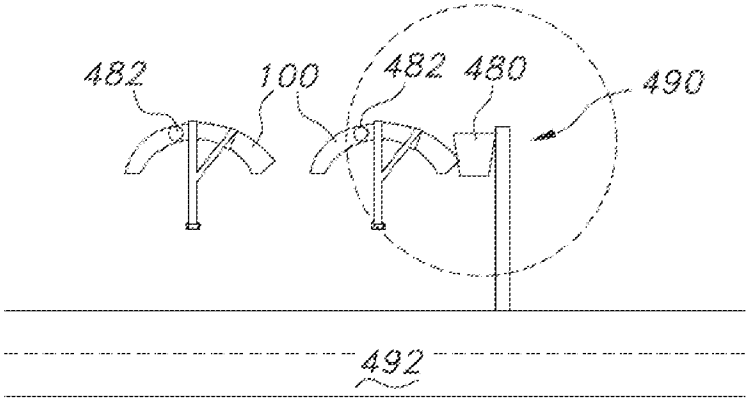

In embodiments, the bicycle helmet 100 may be configured with a recess 370 in the honeycomb matrix to accept the at least one strap 360, as shown in FIG. 38. In embodiments, the bicycle helmet 100 may be configured with the recess 370 in the honeycomb matrix 130 to accept one of the two straps 362, 364. In embodiments, the bicycle helmet 100 may be configured with the recess 370 in the honeycomb matrix 130 to accept both of the two straps 362, 364. In embodiments, the at least one strap 360 may fold when the bicycle helmet 100 is in its folded condition 140, as shown in FIG. 39. In embodiments, the at least one strap 360 may coil when the bicycle helmet 100 is in its folded condition 140, as shown in FIG. 40. In embodiments, the at least one strap 360 that is configured to limit the amount of expansion may be configured to one of gather, fold, or coil when the honeycomb matrix 130 of the bicycle helmet 100 is in its folded condition 140. In embodiments, limiting the expansion of the bicycle helmet 100 may enable the helmet 100 to completely expand to an expanded condition 142 without allowing it to expand too far as to possibly reduce structural integrity. In embodiments, limiting the expansion of the bicycle helmet 100 with the at least one strap 360 may enable the helmet 100 to completely expand to an expanded condition 142 without allowing it to expand too much and to more easily counter the pulling force of the user 110 on the first and second side straps 202, 208. In embodiments, limiting expansion of the bicycle helmet 100 may be accomplished with only the structural rigidity of the honeycomb matrix 130 resisting a possible over-expansion of the bicycle helmet 100

In embodiments, the at least one strap 360 may be a fixed length or may be elastic to expand with the bicycle helmet 100 as it is moved to its expanded condition 142. The at least one strap 360 may be made of a stretchable material, such as an elastic-type material that is normally contracted and extends when a force is applied by the user expanding the bicycle helmet 100. In embodiments, the at least one strap 360 may be made of an accordion-like material that alternately coils upon itself when collapsed or folded and unfolds when expanded. By way of these examples, the maximum unfolded length of such at least one strap 360 may impose a limit on the degree of expansion permitted for the helmet.

Referring to FIGS. 1, 41, 42 and 43, the bicycle helmet 100 may be configured to include tracking, usage, and inventory features 400 that may be deployed in a bicycle ride share system 170. In embodiments, the preferences and/or priorities including the user profiles 172 may be used by the one or more bicycle systems 170 to help the user 110 gain the most benefit such as a customized experience, a fast check in and departure, and the like from the bicycle system 170. In embodiments, the one or more bicycle systems 170 may require that the user 110 obtain and wear the bicycle helmet 100 or another helmet as a condition of receiving the bicycle 120 (or others) from the bicycle system 170.

In embodiments, the user 110 may use one or more cameras 410 on their connected device 180 to capture one or more headshots that may be used to recommend a size of the helmet or to ensure that the helmet is being worn correctly. In embodiments, the user may access one or more bicycles at a bicycle sharing depot 420 or the like associated with the bicycle system 170. By way of these examples, the user 110 may select one of a plurality of available bicycles, such as a subset of bicycles that may be recommended to the user based on the user's preferences and the user profiles 172. In embodiments, the user 110 may request to reserve one or more bicycles in advance to ensure that a bicycle will be available at the reserved place and time. Reserving and/or selecting one or more of the bicycles, including checking an inventory of bicycles and/or access to helmets at bicycle sharing depots may be done through the connected device 180 of the user 110, such as through a bicycle sharing or helmet sharing mobile application and the like. In embodiments, accessing a bicycle and/or reserving a bicycle may also include access and/or reservation of one or more of the bicycle helmets 100 from a helmet vending machine 422, a helmet vending facility 424, or any helmet dispensing system 450 offering the bicycle helmets 100 that may be co-located with the bicycle sharing depot 420 that the user 110 may access and/or at which the user has reserved one or more of the bicycles 120.

The bicycle system 170 may coordinate and manage bicycle sharing and may also coordinate and manage helmet access and/or may maintain an inventory of bicycles and or helmets by depot location. In embodiments, the bicycle systems 170 may similarly coordinate maintaining an inventory 460 of the bicycle helmets 100 and provide visibility to what helmets 100 may be available at or near depot locations. By way of these examples, the user 110 may access the bicycle 120 by activating the bike system 170 through the application on the connected device 180 to be granted access to the helmet 100 for use while using the bicycle 120. In embodiments, use of a helmet may be optional so that the user may opt out of accessing a helmet. In other embodiments, use of a helmet may be mandatory, such as to comply with local regulations. In these other embodiments, the user may have to confirm the use of their own helmet or the bicycle helmet 100.

In embodiments, the bicycle helmet 100 may be provided through the vending machine 422 or other helmet dispensing systems 450 that dispenses the helmet 100 to the user 110 in the folded condition 140. The user 110 may accept the bicycle helmet 100, expand it, and wear it, as shown in FIGS. 2, 3, and 4. When the user 110 no longer needs the helmet 100, the user 110 may return the helmet 100 to a destination helmet receptacle 470 (FIG. 42) or other helmet dispensing systems 450 or may place it in a suitable recycling container or system. Methods and systems for tracking helmet inventories 460, uses, locations, and reuse may be deployed in application embodiments, such as the vending depicted in FIG. 1.

In embodiments, accessing and/or reserving one or more of the bicycle helmets 100 may include benefits associated with sponsors of the bicycle helmets 100, other bike sharing programs, retail bike locations, other retail locations, and the like. One or more businesses may opt to sponsor access, giveaways, contests, and other programs with the bicycle helmet 100 such as through paying a fee for each helmet 100 that is dispensed to the public. In embodiments, sponsoring access to a bicycle helmet 100 as described herein, a business may offer users of the helmet 100 an incentive, such as a digital coupon for a reduced-price product or service of the sponsor. Incentives for access and use of the bicycle helmet 100 may include promotions (e.g., digital coupons and the like) by sponsors in exchange for a user accessing or obtaining the bicycle helmet 100. In embodiments, incentives may also be associated with the detected use of one or helmets 100, such as through video capture of bicycle users riding along a public bike path and the like. Users 110 who are detected wearing one or more of the helmets 100 may be offered incentives that may be electronically delivered directly to the user's bicycle sharing account and accessed through the user's connected device 180.

The user 110 of the bicycle helmet 100 may also be offered incentives for proper disposal of the bicycle helmet 100 after use, such as through a proper recycling facility or used helmet receptacle facility that may be located at bicycle sharing depots as described herein. One or more of the bicycle helmets 100 may be dispensed at a first location and may include electronic and/or physical markings that facilitate detecting the helmet 100 when it is delivered to a recycling or helmet access facility. In embodiments, one or more of the bicycle helmets 100 may include electronic markings such as RFID tags, or the like. In embodiments, one or more of the bicycle helmets 100 may include physical markings such as serial numbers, authentication holograms, or the like. When the bicycle helmet 100 is detected as retrieved after it was earlier dispensed, the helmet 100 may be designated as being properly recycled. In embodiments, the return of the bicycle helmet 100 for recycling may generate a reward, a core deposit refund, a social media indicator, or the like. In embodiments, incentives such as discounts or free future bicycle use may be offered for making reservations, using bicycle sharing, helmet use detection, helmet disposal detection, or the like.

Deployment environments may include the helmet dispensing systems 450, return systems, reuse systems, and other techniques, such as the destination helmet receptacle. In the numerous ride sharing environment embodiments including bike sharing programs, the user 110 may pick up the bicycle 120 and the bicycle helmet 100 at a first location (e.g., a location near a residence) and ride the bicycle 120 with the helmet 100 to travel to another location at which point the user 110 may drop off the bicycle 120 and the bicycle helmet 100 at a bicycle receptacle and the destination helmet receptacle 470 near the final destination. Moreover, the user 110 may retain the helmet 100 and use it again if their bicycle journey continues.

In embodiments, the helmet dispensing system 450, the helmet vending machine 422, the helmet vending facility 424, or the like, may be configured with a helmet detection system 480 that may detect presence or proximity of one or more tracking devices 482 on each of the bicycle helmets 100. Each tracking device 482 may be configured with a serial number that facilitates individual helmet detection and tracking. Dispensing one or more of the bicycle helmets 100 may include the serial number of each of the dispensed helmets that may be captured by the helmet detection system 480 thereby providing an indication of access to or dispensing of one of the helmets 100. In embodiments, tracking of inventory may be used to automatically order additional inventory so that one or more of the helmet dispensing systems 450 may be replenished and may also be used in maintaining a record of inventory for each dispensing station. As an example, when an inventory of bicycle helmets 100 at a dispensing station falls below a threshold, or a rate at which the helmets 100 are being dispensed exceeds a dispensing threshold, automated techniques may be employed to facilitate replenishing inventories of the helmets 100 at one or more of the helmet vending machines 422, the helmet vending facilities 424, the helmet dispensing systems 450, or the like.

In embodiments, the helmet tracking devices 482 may facilitate tracking a location of the bicycle helmet 100. By way of these examples, tracking the location of the bicycle helmet 100 may be used to report, such as through a cellular network, via a Wi-Fi hot spot, or other methods a location of the helmet 100. In embodiments, the helmet tracking devices 482 may be available when connected to the connected device 180 of the user 110 to provide local connectivity. In embodiments, a location of the helmet 100 may be determined when the helmet 100 is presented before a detection system, such as a local helmet dispensing system 450, a detection station 490 along a bicycle path 492, and the like.

Figure 44:
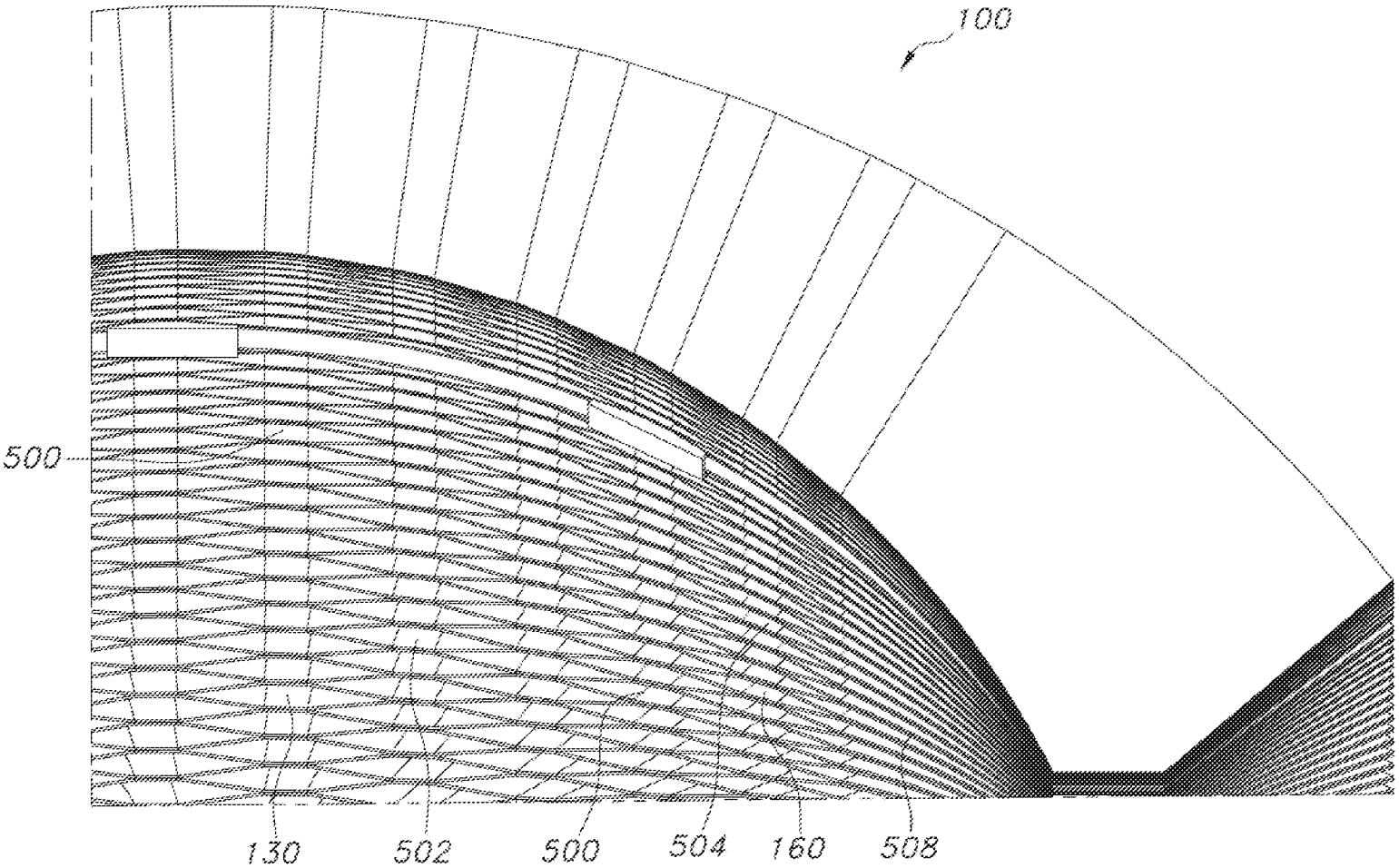
FIGS. 44, 45, and 46 are diagrammatic views of embodiments of bicycle helmets with cell structures of the honeycomb matrix having different shapes relative to positions along a surface of a head of a user in accordance with the present disclosure.
Figure 45:
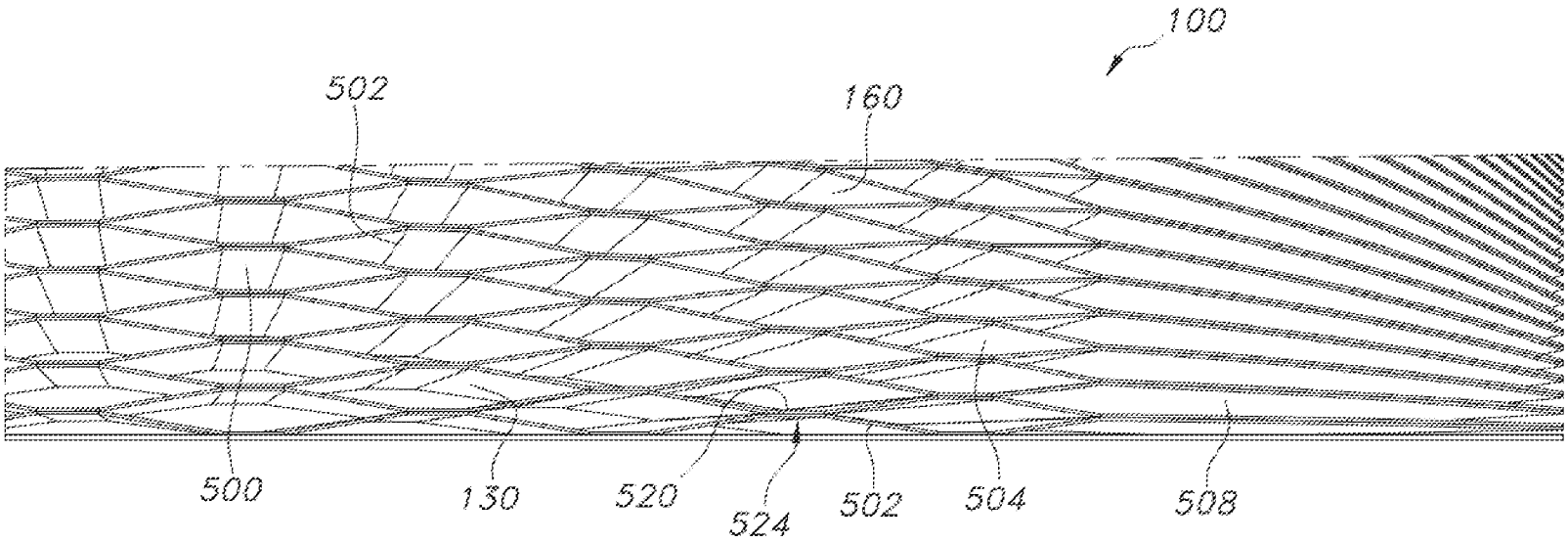
Figure 46:
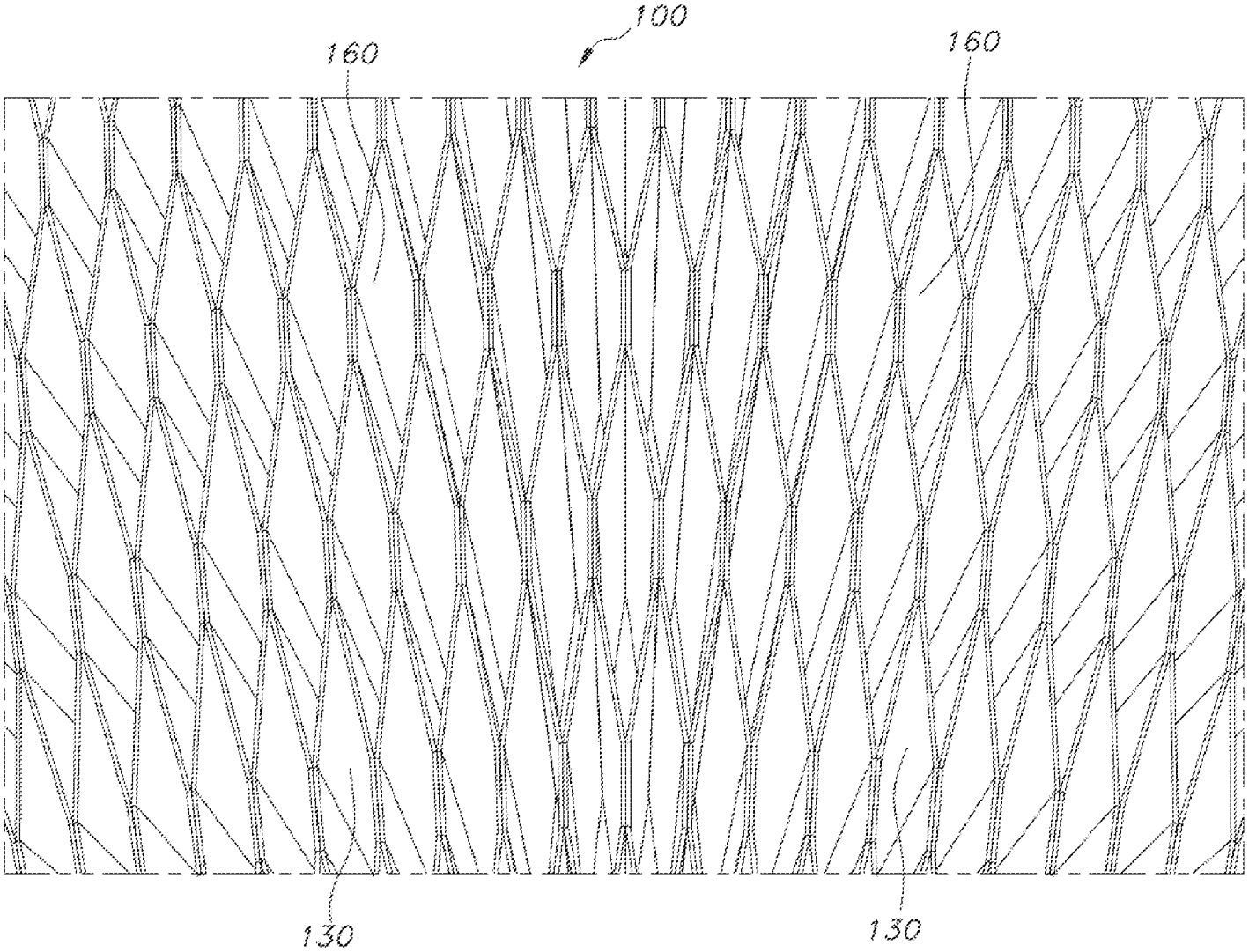

FIGS. 44, 45, and 46 depict embodiments of the bicycle helmet 100 having shapes 500 of the structural cells 160 of the honeycomb matrix 130 that vary in response to the pre-determined position of the cells 160, which proximate the contours 154 of the head 150 of the user 110 (FIG. 2) when the bicycle helmet 100 is disposed in an expanded condition 142. The shape of the structural cells 160 may be fixed but vary in a predetermined fashion relative to the contours 154 of the user's head 150 proximate those structural cells 160. In embodiments, the change in shape of adjacent cells, such as cells 502, 504, 508, may be based on a rate of change of the contours 154 of the outer surface 152 of the head 150 of the user 110. By way of these examples, the cells 502, 504, 508 may have different shapes to accommodate the changes in curvature of the contours 154 of the user's head 150 and may maintain the radial direction of the structural cells 160 that keep them generally perpendicular to the head 150 of the user 110 and not perpendicular relative to one another.

In embodiments, a front and a rear portion of the helmet 100 (FIGS. 44 and 45) may expand substantially less than a midsection (FIG. 46) or near a central portion of the helmet 100. To enable this variation in the expansion of the helmet 100 from the central portion of the helmet 100 to either the front or the back, the honeycomb matrix 130 may narrow nearer to the front and nearer to the back of the head relative to what is disposed in the more central location of the helmet 100. In embodiments, a fewer number of the structural cells 160 may be present in locations of the honeycomb matrix 130 proximal to and at the front or back of the user's head 150, while the number of the structural cells 160 may increase for a given area more toward the central portion of the helmet 100.

In embodiments, one technique for reducing the number of the structural cells 160 in the honeycomb matrix 130 may be to merge cells. In embodiments, one technique for reducing the number of the structural cells 160 in the honeycomb matrix 130 may be to terminate one or more of the panels 350 that include portions of multiple structural cells 160. In embodiments, walls 520, 522 may combine with or extended from the panel 350 to form multiple structural cells 160 of the honeycomb matrix 130 but may be combined to reduce the number of structural cells 160 toward the front or the back of the helmet 100. In many examples, the wall 522 may be terminated at a point of connection with the wall 520, such as at connection region 524. The wall 520 may continue toward the front or toward the rear of the helmet 100 to complete a desired length for the helmet 100, but the wall 522 (or one or more walls) may be terminated in the connection region 524 or at one or more other predetermined locations to facilitate a certain pattern or shape. In embodiments, merging the walls 520, 522 and others by attaching the walls continuously from a merge point until a predetermined terminus toward the front or the back the helmet may also be used to reduce the number of structural cells 160. In embodiments, merging walls may be combined with reducing the thickness or rigidity of the merged walls, terminating walls, or the like and combinations thereof to reduce a local count of structural cells 160.

Figure 48:
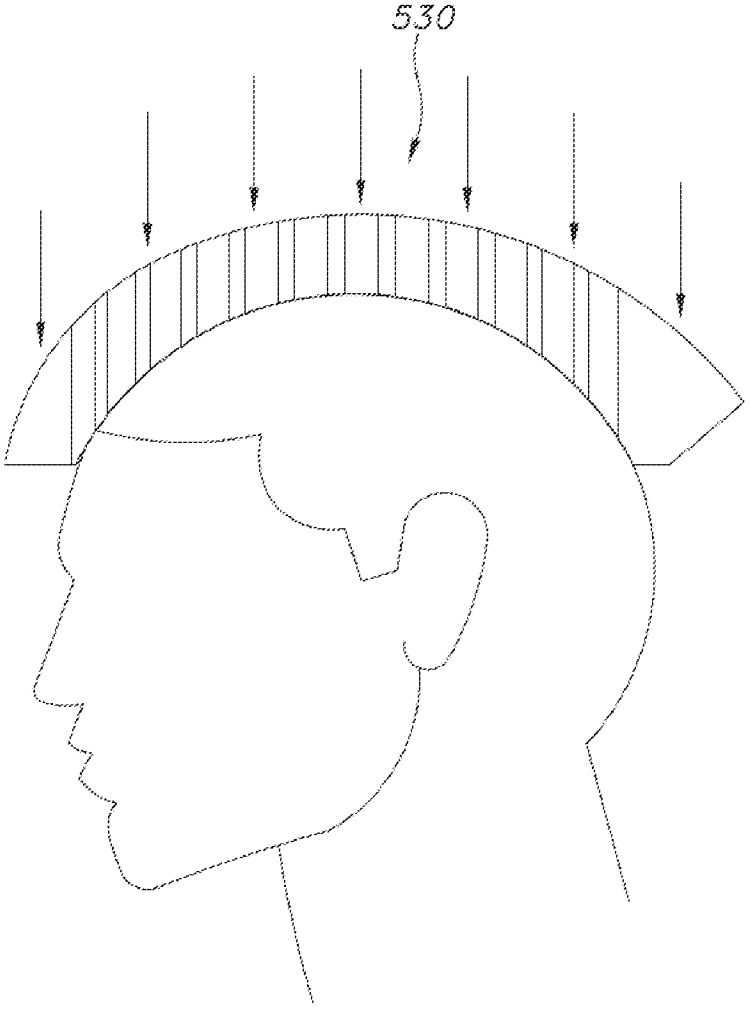
FIG. 48 is a diagrammatic view of a bicycle helmet with cell structures that have a parallel alignment and a honeycomb matrix is aligned in directions that are not perpendicular to many locations of an outer surface of a head of a user.
Figure 47:
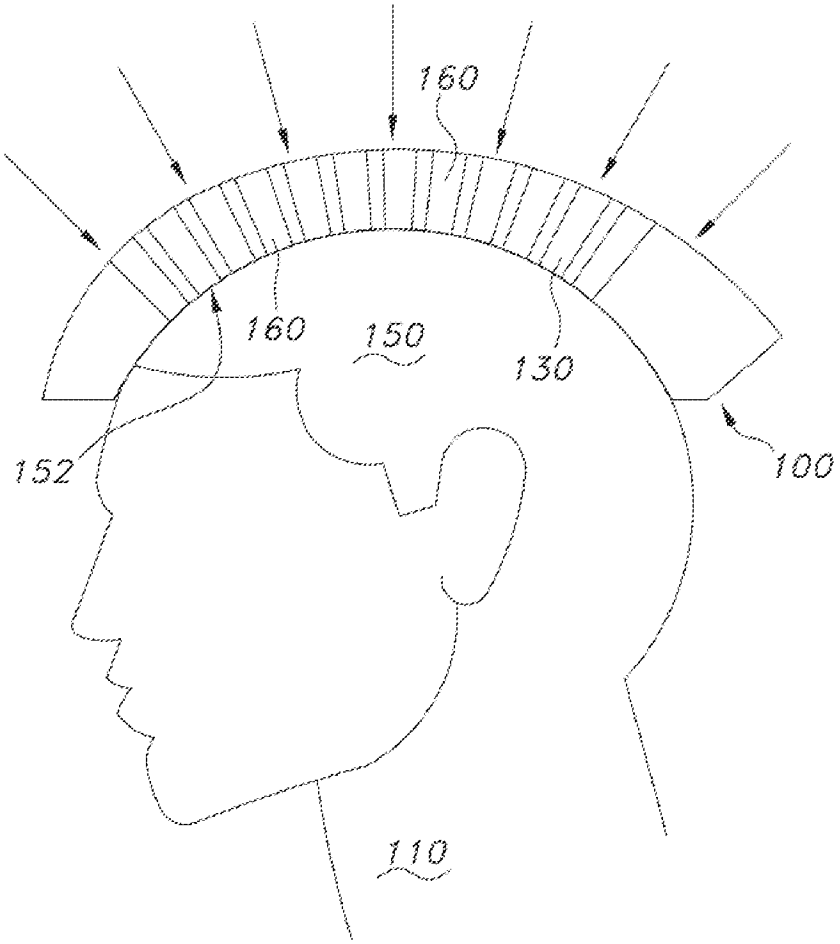
FIG. 47 is a diagrammatic view of embodiments of a bicycle helmet with radially-aligned cell structures of a honeycomb matrix in directions that are perpendicular to the outer surface of a head of a user in accordance with the present disclosure.

FIG. 47 depicts the radial alignment of the structural cells 160 of the honeycomb matrix 130 relative to the outer surface 152 of the head 150 of the user 110 that facilitates radial absorption of impact forces in accordance with the many embodiments of the present disclosure. FIG. 48 depicts a parallel alignment 530 of the cells of a helmet that do not direct impact radially and therefore may be unable to withstand impact forces in an accident or similar situation or that may be required from an impactor, anvil, or other tests that may qualify the helmet for sale under local rules and regulations.

Figure 50:
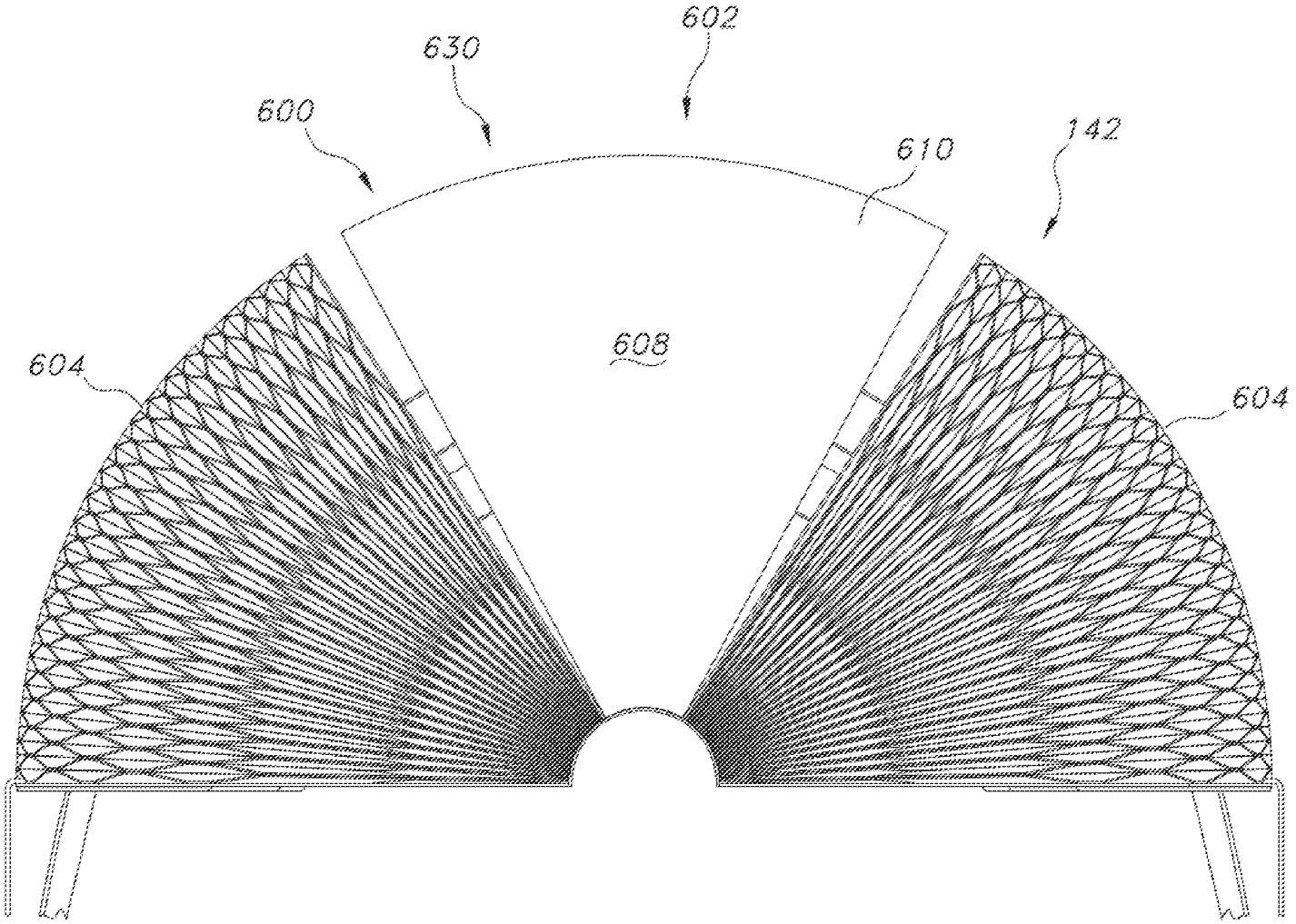
FIGS. 50 and 51 are diagrammatic views of embodiments of bicycle helmets with segments or portions of segments of a honeycomb matrix filled or replaced with structures lacking the honeycomb matrix in accordance with the present disclosure.
Figure 51:
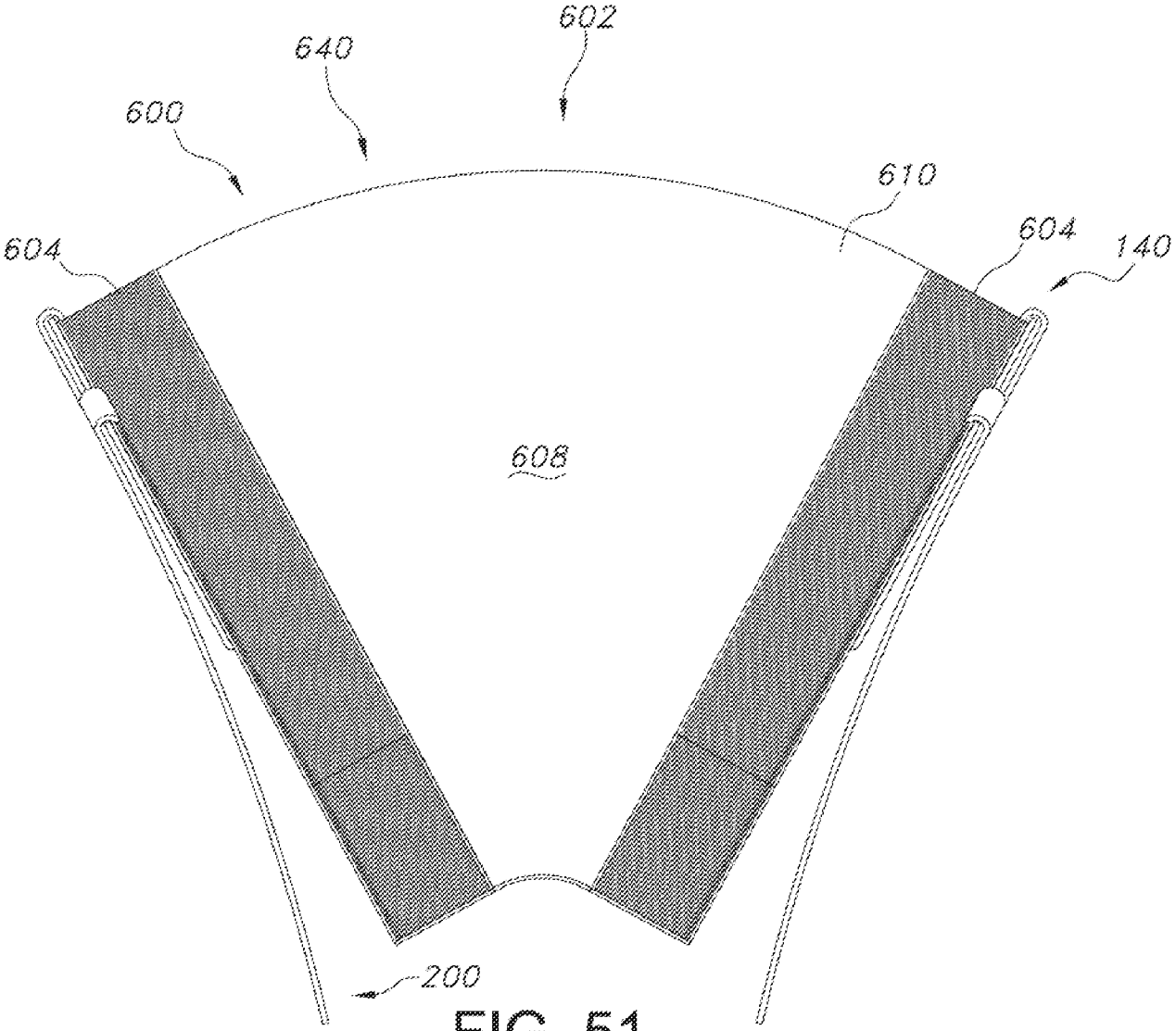

FIGS. 50 and 51 depict a bicycle helmet 600 having a combination of segments 602 that includes two segments 604 made of the honeycomb matrix 130 and a segment 608 that made of a solid impact absorbing material 610. The number and position of the segments 602 and the selection of materials for the segments 602 may be based on cost, impact protection goals or results, weight, the desired degree of collapsing, the compactness in the folded condition, the smallness of helmet when collapsed, folded, and the like. The bicycle helmet 600 in an expanded condition 630 that may be an expanded condition similar to the expanded condition 142 of the bicycle helmet 100. FIG. 51 depicts a partially folded condition 640 that shows the two segments 604 folded against the segment 608 that is solid and thus does not fold. In embodiments, the segment 608 may include polystyrene, a solid matrix, and the like. Attachment of the two segments 604 to the solid segment 608 may be done through methods and systems comparable to those described herein for attaching segments 270 in embodiments of the bicycle helmet 100 herein. In embodiments, the segments 602 may be radially-oriented and include the structural cells 160 of the honeycomb matrix 130.

Figure 52:
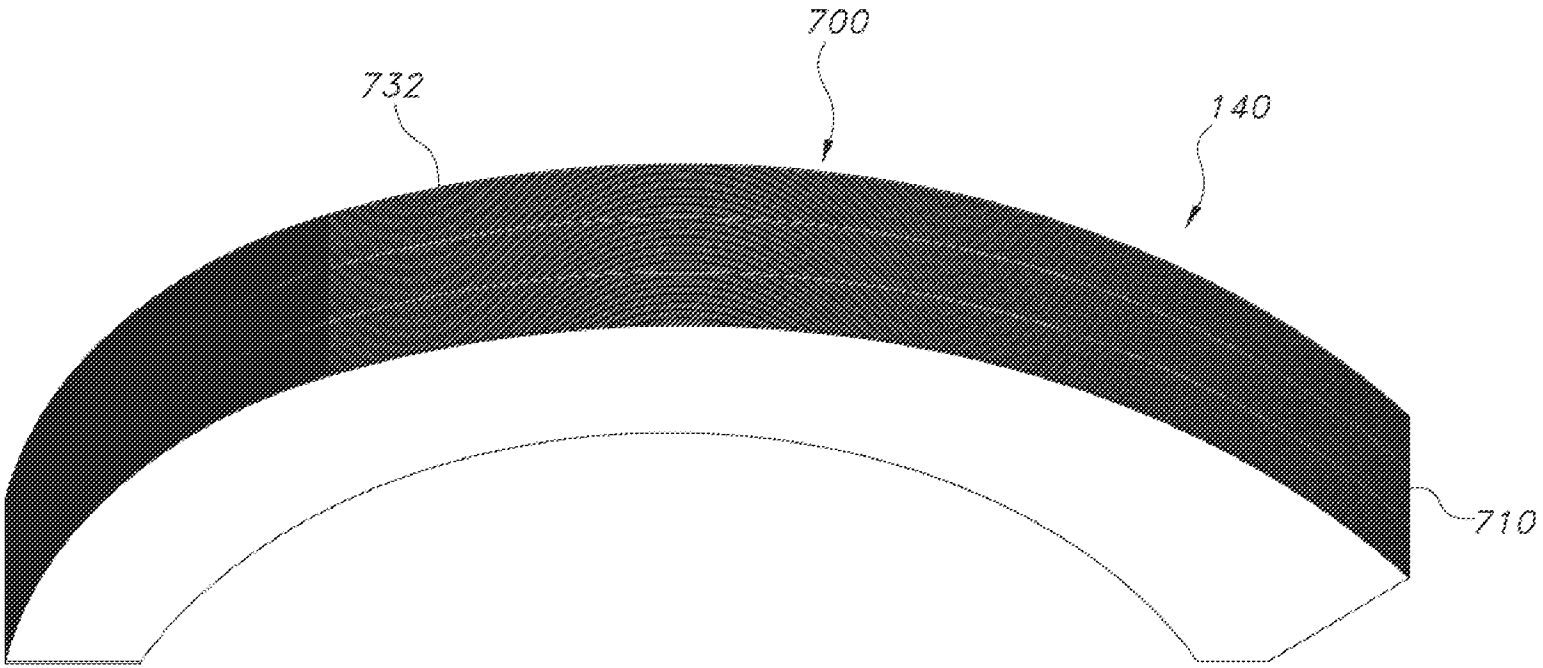
FIGS. 52, 53, and 54 are diagrammatic views of embodiments of bicycle helmets depicting a progression of moving the bicycle helmet to its operational or expanded condition to reveal a logo or other predetermined graphic or the like formed on a honeycomb matrix in accordance with the present disclosure.
Figure 53:
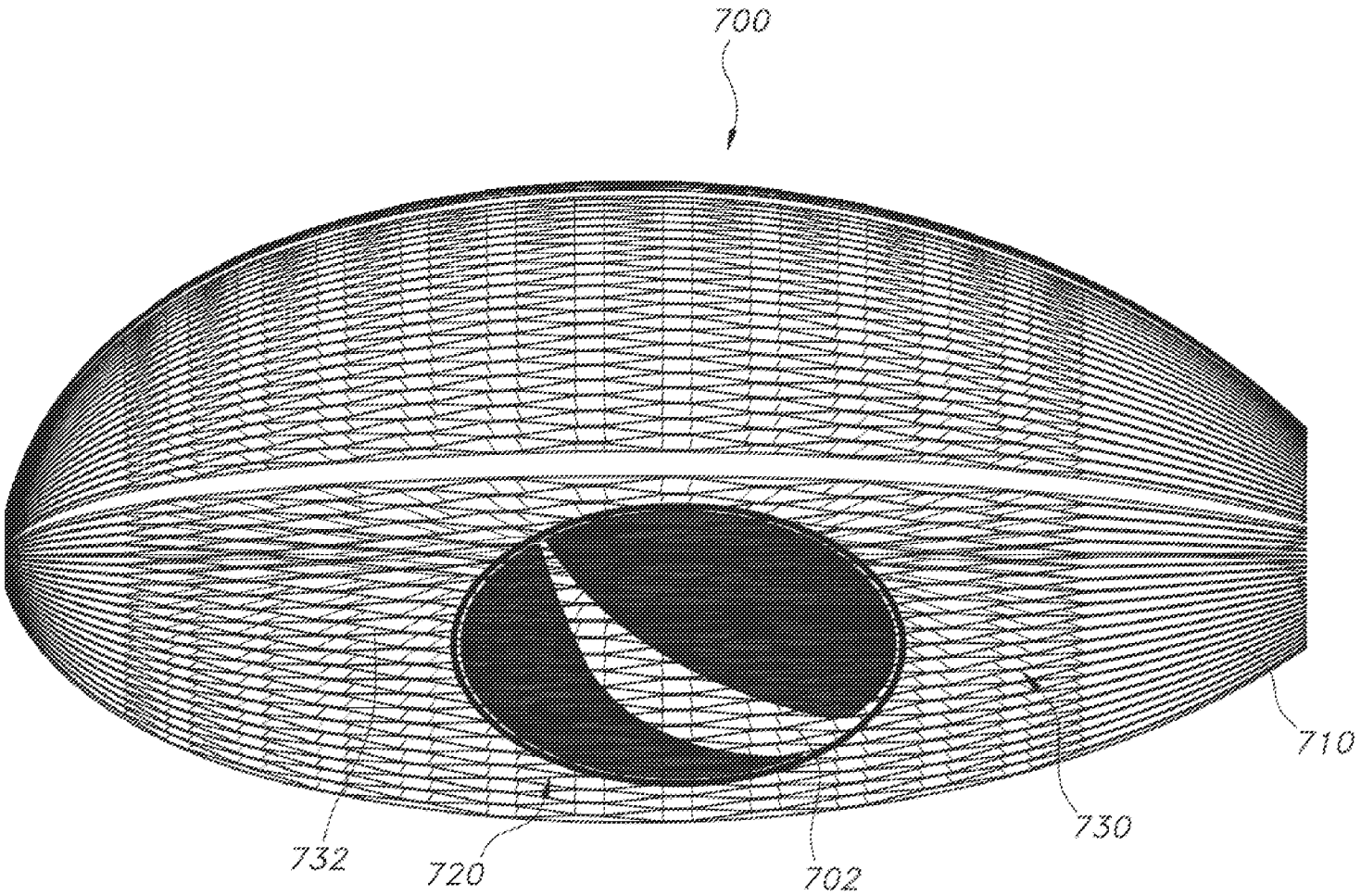
Figure 54:
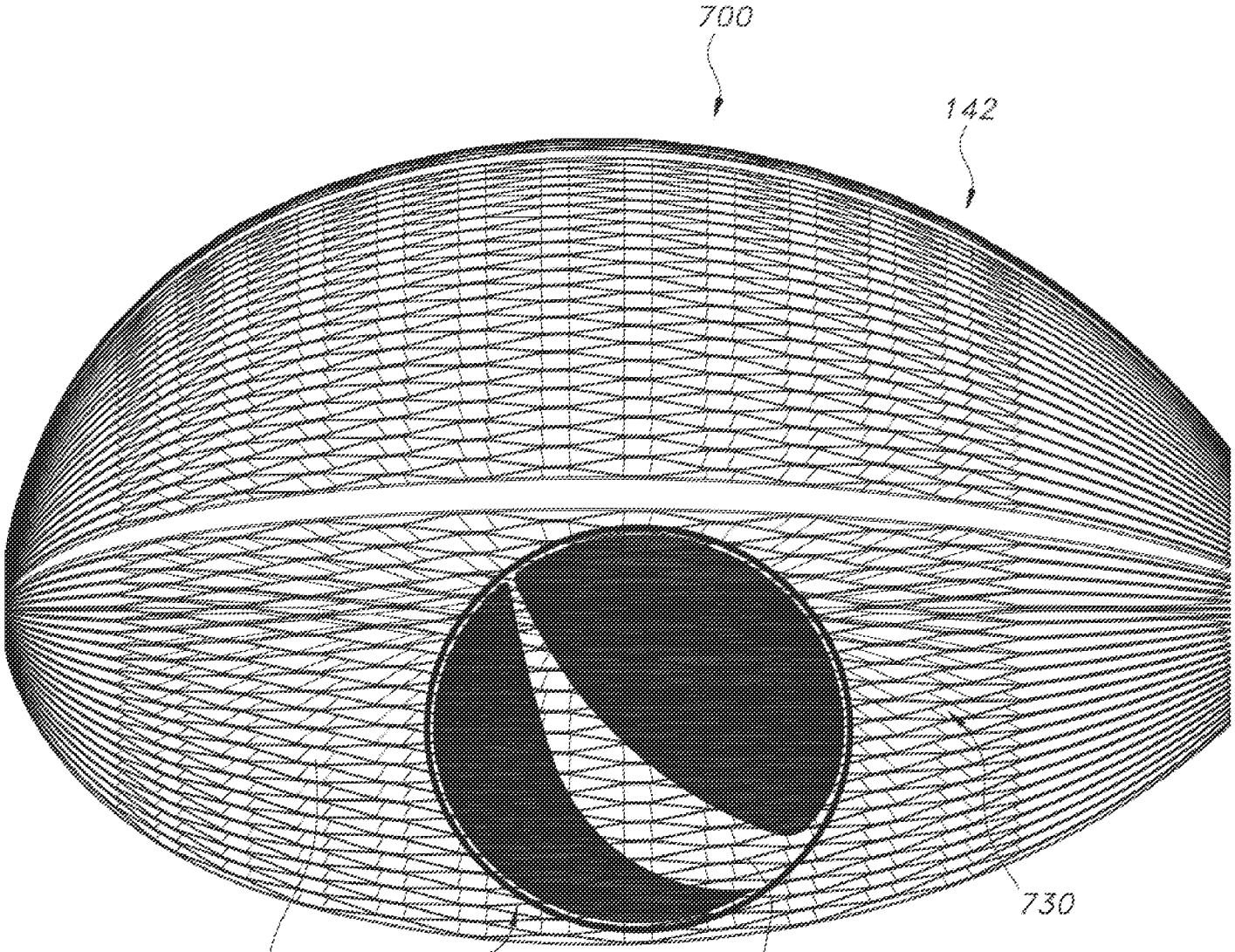

FIGS. 52, 53 and 54 depict a bicycle helmet 700 that includes one or more regions 702 for branding or depicting a graphic such as for a logo or other marketing indicia. One of the regions 702 may be on a segment 710 having the structural cells 160 of the honeycomb matrix 130. The segment 710 may move between the folded condition 140 and the expanded condition 142. In embodiments, the segment 710 in its expanded condition 142 may be configured to display a portion of advertising, a graphic, text, or the like 720 on an outer surface 730 that defines an exterior curvature 732 of the segment 710. In embodiments, the segment 710 in its folded condition 140 may be configured to reduce the visibility of the portion of advertising, a graphic, text, or the like 720 on the outer surface 730 that defines the exterior curvature 732 of the segment 710. The segment 710 may be further configured to reveal the portion of advertising, a graphic, text, or the like 720 on the outer surface 730 as the segment 710 moves from the folded condition 140 to the expanded condition 142. In embodiments, the portion of advertising 720 may include a trademark 740. In embodiments, the portion of advertising may include an intended indicator of source. In embodiments, the portion of advertising 720 may include artwork for which a license is obtained to produce the artwork on each of the bicycle helmets 700. In embodiments, the portion of advertising 720 may be associated with one or more of the helmet dispensing systems 450.

In embodiments, the advertising 720 may be printed onto the outer surface 730 of the honeycomb matrix of the segment 710 to be visible when the segment 710 is in its expanded condition 142. In embodiments, the advertising 720 may be viewed from a pose that permits viewing more easily or exclusively from a left or right side of the segment 710. In embodiments, the printing of the advertising 720 onto the outer surface 730 may permit viewing at least partially of the advertising 720 when the bicycle helmet 700 is in its folded condition 140. In embodiments, the printing of the advertising 720 onto the outer surface 730 may be configured to not be discernable when the bicycle helmet 700 is in its folded condition 140.

In embodiments, the advertising 720 may be applied using any known technique including, without limitation, printing, silk screening, laser etching, chemical etching, embossing, mechanical etching, sublimation, and the like. The graphic, logo and the like may be applied as part of a manufacturing step, such as applying a coating to the honeycomb matrix 130, such as to improve water repellency and the like. The advertising 720 may be added to the honeycomb matrix walls before assembly so that relevant portions of the advertising 720 may be present on the structural cells 160 of the honeycomb matrix 130. In embodiments, the advertising 720 may be added to the bicycle helmet 700 at the time it is dispensed. By way of these examples, information may be printed on the bicycle helmet 700 to facilitate a recipient of the dispensed helmet accessing information such as online content, a prize, or the like as a benefit for using the helmet. The information may include codes (e.g., a 2D barcode, batch and inventory numbers, retail price information, package information, or the like) or prize information (e.g., a URL, a QR code, or the like). In this way, the costs associated with making, vending, and recycling the helmet may be shared with a sponsor, an advertiser, a philanthropic partner, or the like in exchange for an opportunity to interact through the code or prize information provided to the user 110 of the helmet 700.

FIGS. 55 and 56 depict a bicycle helmet 800 that includes one or more light mechanisms 802 that are capable of emitting light 804. The one or more light mechanisms 802 may include one or more safety lights, such as safety lights 810, 812, 814 each disposed on at least one of a front, a back, and sides of the bicycle helmet 800. In embodiments, the one or more light mechanisms 802 may be connected to the bicycle helmet 800 and may be configured to provide illumination when the bicycle helmet 800 is opened to its expanded condition. In embodiments, the one or more light mechanisms 802 may be connected to the bicycle helmet 800 may be configured as a telltale mechanism that may be configured to switch on illumination when the bicycle helmet 800 is opened to its expanded condition 142 and is also configured so that one illumination is activated it is also an indicator that the bicycle helmet 800 has been used.

In embodiments, each of the light mechanisms 802 on the bicycle helmet 800 may be self-powered. By way of these examples, each of the light mechanisms 802 may include a small cell battery and the like and may automatically activate when the helmet is no longer folded, such as upon expanding of the bicycle helmet to its expanded condition 142. In embodiments, a mechanical or proximity type switch (e.g., Hall effect) may be used to detect a portion of the bicycle helmet in a condition in which it is no longer in its folded condition 140 including moving the helmet 800 to the expanded condition 142. In embodiments, a mechanical switch may be disposed so that the switch disrupts a flow of energy (e.g., from a battery) to the one or more light mechanisms 802, and may provide an indication of when the helmet 800 is in its folded condition 140. A mechanical switch may be forced into an energy disrupting position by coming into contact with a portion of the helmet, such as the wall of a honeycomb when the honeycomb is folded.

In embodiments, the one or more light mechanisms 802, when activated, may be configured to sense the ambient light, and based thereon, may optionally turn on or off to achieve an acceptable level of illumination. In examples of an ambient light-based operation, one or more of the bicycle helmet safety lights safety lights 810, 812, 814 may include a sensor such as indicator 482 (FIGS. 41, 42, and 43) that may be configured to detect when the ambient light proximal to the bicycle helmet 800 is above a pre-determined threshold whereupon the bicycle helmet safety lights safety lights 810, 812, 814 may be configured to turn off, saving energy, and extending the operational life of the energy source. In embodiments, the one or more light mechanisms 802 and the bicycle helmet safety lights safety lights 810, 812, 814 may include an LED type light for low power consumption; however, other types of lights may be used based on application needs or the like. In embodiments, the one or more light mechanisms 802 and the bicycle helmet safety lights safety lights 810, 812, 814 may include a battery power source but may also use or integrate solar panels to charge the onboard batteries.

While the disclosure has been disclosed in connection with the examples shown and described in detail, various modifications and improvements thereon will become readily apparent to those skilled in the art. Accordingly, the spirit and scope of the present disclosure is not to be limited by the foregoing examples but is to be understood in the broadest sense allowable by law.

Detailed aspects of the present disclosure are disclosed herein; however, it is to be understood that the disclosed aspects are merely exemplary of the disclosure, which may be constructed in various forms. Therefore, specific structural and functional details disclosed herein are not to be interpreted as limiting, but merely as a basis for the claims and as a representative basis for teaching one skilled in the art to variously employ the present disclosure in virtually any appropriately detailed structure.

The terms "a" or "an," as used herein, are defined as one or more than one. The term "another," as used herein, is defined as at least a second or more. The terms "including" and/or "having," as used herein, are defined as comprising (i.e., open transition). The use of the terms "a," "an," and "the" and similar references in the context of describing the disclosure (especially in the context of the following claims) is to be construed to cover both the singular and the plural unless otherwise indicated herein or clearly contradicted by context. The terms "comprising," "having," "including," and "containing" are to be construed as open-ended terms (i.e., meaning "including, but not limited to,") unless otherwise noted. Recitations of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g., "such as") provided herein, is intended merely to better illuminate the disclosure, and does not pose a limitation on the scope of the disclosure unless otherwise claimed. No language in the specification should be construed as indicating any non-claimed element as essential to the practice of the disclosure.

While the foregoing written description enables one skilled in the art to make and use what is considered presently to be the best mode thereof, those skilled in the art will understand and appreciate the existence of variations, combinations, and equivalents of the specific aspects, method, and examples herein.

The methods and systems described herein may be deployed in part or in whole through a machine having a computer, computing device, processor, circuit, and/or server that executes computer readable instructions, program codes, instructions, and/or includes hardware configured to functionally execute one or more operations of the methods and systems disclosed herein. The terms computer, computing device, processor, circuit, and/or server, as utilized herein, should be understood broadly.

Any one or more of the terms computer, computing device, processor, circuit, and/or server includes a computer of any type, capable to access instructions stored in communication thereto such as upon a non-transient computer readable medium, whereupon the computer performs operations of systems or methods described herein upon executing the instructions. In certain embodiments, such instructions themselves comprise a computer, computing device, processor, circuit, and/or server. Additionally or alternatively, a computer, computing device, processor, circuit, and/or server may be a separate hardware device, one or more computing resources distributed across hardware devices, and/or may include such aspects as logical circuits, embedded circuits, sensors, actuators, input and/or output devices, network and/or communication resources, memory resources of any type, processing resources of any type, and/or hardware devices configured to be responsive to determined conditions to functionally execute one or more operations of systems and methods herein.

Network and/or communication resources include, without limitation, local area network, wide area network, wireless, internet, or any other known communication resources and protocols. Example and non-limiting hardware, computers, computing devices, processors, circuits, and/or servers include, without limitation, a general purpose computer, a server, an embedded computer, a mobile device, a virtual machine, and/or an emulated version of one or more of these. Example and non-limiting hardware, computers, computing devices, processors, circuits, and/or servers may be physical, logical, or virtual. A computer, computing device, processor, circuit, and/or server may be: a distributed resource included as an aspect of several devices; and/or included as an interoperable set of resources to perform described functions of the computer, computing device, processor, circuit, and/or server, such that the distributed resources function together to perform the operations of the computer, computing device, processor, circuit, and/or server. In certain embodiments, each computer, computing device, processor, circuit, and/or server may be on separate hardware, and/or one or more hardware devices may include aspects of more than one computer, computing device, processor, circuit, and/or server, for example as separately executable instructions stored on the hardware device, and/or as logically partitioned aspects of a set of executable instructions, with some aspects of the hardware device comprising a part of a first computer, computing device, processor, circuit, and/or server, and some aspects of the hardware device comprising a part of a second computer, computing device, processor, circuit, and/or server.

A computer, computing device, processor, circuit, and/or server may be part of a server, client, network infrastructure, mobile computing platform, stationary computing platform, or other computing platforms. A processor may be any kind of computational or processing device capable of executing program instructions, codes, binary instructions, and the like. The processor may be or include a signal processor, digital processor, embedded processor, microprocessor, or any variant such as a co-processor (math co-processor, graphic co-processor, communication co-processor and the like) and the like that may directly or indirectly facilitate execution of program code or program instructions stored thereon. In addition, the processor may enable execution of multiple programs, threads, and codes. The threads may be executed simultaneously to enhance the performance of the processor and to facilitate simultaneous operations of the application. By way of implementation, methods, program codes, program instructions and the like described herein may be implemented in one or more threads. The thread may spawn other threads that may have assigned priorities associated with them; the processor may execute these threads based on priority or any other order based on instructions provided in the program code. The processor may include memory that stores methods, codes, instructions, and programs as described herein and elsewhere. The processor may access a storage medium through an interface that may store methods, codes, and instructions as described herein and elsewhere. The storage medium associated with the processor for storing methods, programs, codes, program instructions or other type of instructions capable of being executed by the computing or processing device may include but may not be limited to one or more of a CD-ROM, DVD, memory, hard disk, flash drive, RAM, ROM, cache, and the like.

A processor may include one or more cores that may enhance speed and performance of a multiprocessor. In embodiments, the process may be a dual core processor, quad core processors, other chip-level multiprocessor and the like that combine two or more independent cores (called a die).

The methods and systems described herein may be deployed in part or in whole through a machine that executes computer readable instructions on a server, client, firewall, gateway, hub, router, or other such computer and/or networking hardware. The computer readable instructions may be associated with a server that may include a file server, print server, domain server, internet server, intranet server and other variants such as secondary server, host server, distributed server, and the like. The server may include one or more of memories, processors, computer readable transitory and/or non-transitory media, storage media, ports (physical and virtual), communication devices, and interfaces capable of accessing other servers, clients, machines, and devices through a wired or a wireless medium, and the like. The methods, programs, or codes as described herein and elsewhere may be executed by the server. In addition, other devices required for execution of methods as described in this application may be considered as a part of the infrastructure associated with the server.

The server may provide an interface to other devices including, without limitation, clients, other servers, printers, database servers, print servers, file servers, communication servers, distributed servers, and the like. Additionally, this coupling and/or connection may facilitate remote execution of instructions across the network. The networking of some or all of these devices may facilitate parallel processing of program code, instructions, and/or programs at one or more locations without deviating from the scope of the disclosure. In addition, all the devices attached to the server through an interface may include at least one storage medium capable of storing methods, program code, instructions, and/or programs. A central repository may provide program instructions to be executed on different devices. In this implementation, the remote repository may act as a storage medium for methods, program code, instructions, and/or programs.

The methods, program code, instructions, and/or programs may be associated with a client that may include a file client, print client, domain client, internet client, intranet client and other variants such as secondary client, host client, distributed client, and the like. The client may include one or more of memories, processors, computer readable transitory and/or non-transitory media, storage media, ports (physical and virtual), communication devices, and interfaces capable of accessing other clients, servers, machines, and devices through a wired or a wireless medium, and the like. The methods, program code, instructions, and/or programs as described herein and elsewhere may be executed by the client. In addition, other devices utilized for execution of methods as described in this application may be considered as a part of the infrastructure associated with the client.

The client may provide an interface to other devices including, without limitation, servers, other clients, printers, database servers, print servers, file servers, communication servers, distributed servers, and the like. Additionally, this coupling and/or connection may facilitate remote execution of methods, program code, instructions, and/or programs across the network. The networking of some or all of these devices may facilitate parallel processing of methods, program code, instructions, and/or programs at one or more locations without deviating from the scope of the disclosure. In addition, all the devices attached to the client through an interface may include at least one storage medium capable of storing methods, program code, instructions, and/or programs. A central repository may provide program instructions to be executed on different devices. In this implementation, the remote repository may act as a storage medium for methods, program code, instructions, and/or programs.

The methods and systems described herein may be deployed in part or in whole through network infrastructures. The network infrastructure may include elements such as computing devices, servers, routers, hubs, firewalls, clients, personal computers, communication devices, routing devices and other active and passive devices, modules, and/or components as known in the art. The computing and/or non-computing device(s) associated with the network infrastructure may include, apart from other components, a storage medium such as flash memory, buffer, stack, RAM, ROM, and the like. The methods, program code, instructions, and/or programs described herein and elsewhere may be executed by one or more of the network infrastructural elements.

The methods, program code, instructions, and/or programs described herein and elsewhere may be implemented on a cellular network having multiple cells. The cellular network may either be frequency division multiple access (FDMA) network or code division multiple access (CDMA) network. The cellular network may include mobile devices, cell sites, base stations, repeaters, antennas, towers, and the like.

The methods, program code, instructions, and/or programs described herein and elsewhere may be implemented on or through mobile devices. The mobile devices may include navigation devices, cell phones, mobile phones, mobile personal digital assistants, laptops, palmtops, netbooks, pagers, electronic books readers, music players, and the like. These mobile devices may include, apart from other components, a storage medium such as a flash memory, buffer, RAM, ROM and one or more computing devices. The computing devices associated with mobile devices may be enabled to execute methods, program code, instructions, and/or programs stored thereon. Alternatively, the mobile devices may be configured to execute instructions in collaboration with other devices. The mobile devices may communicate with base stations interfaced with servers and configured to execute methods, program code, instructions, and/or programs. The mobile devices may communicate on a peer to peer network, mesh network, or other communications networks. The methods, program code, instructions, and/or programs may be stored on the storage medium associated with the server and executed by a computing device embedded within the server. The base station may include a computing device and a storage medium. The storage device may store methods, program code, instructions, and/or programs executed by the computing devices associated with the base station.

The methods, program code, instructions, and/or programs may be stored and/or accessed on machine readable transitory and/or non-transitory media that may include: computer components, devices, and recording media that retain digital data used for computing for some interval of time; semiconductor storage known as random access memory (RAM); mass storage typically for more permanent storage, such as optical discs, forms of magnetic storage like hard disks, tapes, drums, cards and other types; processor registers, cache memory, volatile memory, non-volatile memory; optical storage such as CD, DVD; removable media such as flash memory (e.g., USB sticks or keys), floppy disks, magnetic tape, paper tape, punch cards, standalone RAM disks, Zip drives, removable mass storage, off-line, and the like; other computer memory such as dynamic memory, static memory, read/write storage, mutable storage, read only, random access, sequential access, location addressable, file addressable, content addressable, network attached storage, storage area network, bar codes, magnetic ink, and the like.

Certain operations described herein include interpreting, receiving, and/or determining one or more values, parameters, inputs, data, or other information. Operations including interpreting, receiving, and/or determining any value parameter, input, data, and/or other information include, without limitation: receiving data via a user input; receiving data over a network of any type; reading a data value from a memory location in communication with the receiving device; utilizing a default value as a received data value; estimating, calculating, or deriving a data value based on other information available to the receiving device; and/or updating any of these in response to a later received data value. In certain embodiments, a data value may be received by a first operation, and later updated by a second operation, as part of the receiving a data value. For example, when communications are down, intermittent, or interrupted, a first operation to interpret, receive, and/or determine a data value may be performed, and when communications are restored an updated operation to interpret, receive, and/or determine the data value may be performed.

Certain logical groupings of operations herein, for example, methods or procedures of the current disclosure, are provided to illustrate aspects of the present disclosure. Operations described herein are schematically described and/or depicted, and operations may be combined, divided, re-ordered, added, or removed in a manner consistent with the disclosure herein. It is understood that the context of an operational description may require an ordering for one or more operations, and/or an order for one or more operations may be explicitly disclosed, but the order of operations should be understood broadly, where any equivalent grouping of operations to provide an equivalent outcome of operations is specifically contemplated herein. For example, if a value is used in one operational step, the determining of the value may be required before that operational step in certain contexts (e.g. where the time delay of data for an operation to achieve a certain effect is important), but may not be required before that operation step in other contexts (e.g., where usage of the value from a previous execution cycle of the operations would be sufficient for those purposes). Accordingly, in certain embodiments, an order of operations and grouping of operations as described is explicitly contemplated herein, and in certain embodiments, re-ordering, subdivision, and/or different grouping of operations is explicitly contemplated herein.

The methods and systems described herein may transform physical and/or intangible items from one state to another. The methods and systems described herein may also transform data representing physical and/or intangible items from one state to another.

The elements described and depicted herein, including in flow charts, block diagrams, and/or operational descriptions, depict and/or describe specific example arrangements of elements for purposes of illustration. However, the depicted and/or described elements, the functions thereof, and/or arrangements of these, may be implemented on machines, such as through computer executable transitory and/or non-transitory media having a processor capable of executing program instructions stored thereon, and/or as logical circuits or hardware arrangements. Example arrangements of programming instructions include at least: monolithic structure of instructions; stand-alone modules of instructions for elements or portions thereof; and/or as modules of instructions that employ external routines, code, services, and so forth; and/or any combination of these, and all such implementations are contemplated to be within the scope of embodiments of the present disclosure Examples of such machines include, without limitation, personal digital assistants, laptops, personal computers, mobile phones, other handheld computing devices, medical equipment, wired or wireless communication devices, transducers, chips, calculators, satellites, tablet PCs, electronic books, gadgets, electronic devices, devices having artificial intelligence, computing devices, networking equipment, servers, routers and the like. Furthermore, the elements described and/or depicted herein, and/or any other logical components, may be implemented on a machine capable of executing program instructions. Thus, while the foregoing flow charts, block diagrams, and/or operational descriptions set forth functional aspects of the disclosed systems, any arrangement of program instructions implementing these functional aspects are contemplated herein. Similarly, it will be appreciated that the various steps identified and described above may be varied and that the order of steps may be adapted to particular applications of the techniques disclosed herein. Additionally, any steps or operations may be divided and/or combined in any manner providing similar functionality to the described operations. All such variations and modifications are contemplated in the present disclosure. The methods and/or processes described above, and steps thereof, may be implemented in hardware, program code, instructions, and/or programs or any combination of hardware and methods, program code, instructions, and/or programs suitable for a particular application. Example hardware includes a dedicated computing device or specific computing device, a particular aspect or component of a specific computing device, and/or an arrangement of hardware components and/or logical circuits to perform one or more of the operations of a method and/or system. The processes may be implemented in one or more microprocessors, microcontrollers, embedded microcontrollers, programmable digital signal processors or other programmable devices, along with internal and/or external memory. The processes may also, or instead, be embodied in an application specific integrated circuit, a programmable gate array, programmable array logic, or any other device or combination of devices that may be configured to process electronic signals. It will further be appreciated that one or more of the processes may be realized as a computer executable code capable of being executed on a machine readable medium.

The computer executable code may be created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and computer readable instructions, or any other machine capable of executing program instructions.

Thus, in one aspect, each method described above and combinations thereof may be embodied in computer executable code that, when executing on one or more computing devices, performs the steps thereof. In another aspect, the methods may be embodied in systems that perform the steps thereof, and may be distributed across devices in a number of ways, or all of the functionality may be integrated into a dedicated, standalone device or other hardware. In another aspect, the means for performing the steps associated with the processes described above may include any of the hardware and/or computer readable instructions described above. All such permutations and combinations are contemplated in embodiments of the present disclosure.

What is claimed is:

1. A helmet for fitting over a head of a user, the helmet comprising:

a radial honeycomb matrix having a plurality of walls that are arranged to form cells of the radial honeycomb matrix, wherein a first portion of the plurality of walls extends from a front of the bicycle helmet to a rear of the bicycle helmet and a second portion of the plurality of walls extends from a central location of the bicycle helmet part way toward the front and the rear of the bicycle helmet resulting in a reduced number of cells proximate the front and rear of the bicycle helmet relative to the central location that is distal from the front and rear of the bicycle helmet, the radial honeycomb matrix movable between a folded condition where the cells of the matrix are disposed generally parallel and an expanded condition where the cells of the matrix are configured to be arranged radially over a surface of said head of said user.

2. The helmet of claim 1 further comprising a chin strap assembly connected to at least two portions of the radial honeycomb matrix and is configured to be releasably coupled around said head of said user.

3. The helmet of claim 1 further comprising at least one strap positioned over the helmet configured to limit an amount of expansion of the radial honeycomb matrix when moving into the expanded condition.

4. The helmet of claim 3 wherein the chin strap assembly includes the at least one strap positioned over the helmet.

5. The helmet of claim 3 wherein a portion of the chin strap assembly is made of the same material as the at least one strap positioned over the helmet.

6. The helmet of claim 1 wherein the cells cooperate to form segments of the radial honeycomb matrix configured to be arranged radially over said surface of said head of the user, the walls configured to be located adjacent to and positioned generally perpendicular to a portion of said surface of said head of said user.

7. The helmet of claim 1 further comprising at least one light mechanism connected to the helmet that is configured to switch on illumination when the helmet is opened to its expanded condition.

8. The helmet of claim 1 wherein the radial honeycomb matrix in its expanded condition is configured to display a portion of one of advertising, a graphic, and text on an outer surface of the helmet.

9. A helmet for fitting over a surface of a head of a user, their ears, and under their chin, the helmet comprising:

a honeycomb matrix expandable from a folded condition to an operational condition in which cells of the honeycomb matrix are configured to be at least partially disposed over and generally perpendicular to a surface of said head of said user;

a chin strap assembly connected to portions of the honeycomb matrix that is configured to retain the honeycomb matrix in the operational condition when portions of the chin strap assembly are positioned around said ears and under said chin of said user; and wherein the chin strap assembly comprises at least one strap positioned over the honeycomb matrix and configured to limit an amount of expansion of the honeycomb matrix when moving into the expanded condition.

10. The helmet of claim 9 wherein portions of the chin strap assembly and the at least one strap positioned over the honeycomb matrix are made of the same material.

11. The helmet of claim 9 wherein the honeycomb matrix includes multiple cells each radially aligned with each other.

12. The helmet of claim 9 wherein the radial honeycomb matrix in its expanded condition is configured to display a portion of one of advertising, a graphic, and text on an outer surface that defines an exterior curvature of the helmet.

13. A method for securing a helmet over a surface of a head of a user, their ears, and under their chin, the method comprising:

expanding a honeycomb matrix of the helmet from a folded condition to an operational condition in which cells of the honeycomb matrix are aligned to be at least partially disposed over and generally perpendicular to said surface of said head of said user;

limiting, with at least one strap positioned over the radial honeycomb matrix, an amount of expansion of the helmet when moving it into the expanded condition; and securing the helmet on said head by pulling opposite ends of a chin strap assembly past said ears of said user and under said chin to retain the honeycomb matrix in the operational condition.

14. The method of claim 13 further comprising radially aligning multiple cells of the honeycomb matrix when expanding the helmet from the folded condition to the operational condition.

15. The method of claim 13 further comprising displaying a portion of one of advertising, a graphic, and text on an outer surface that defines an exterior curvature of the helmet.

* * * * *